US006184848B1

(12) United States Patent
Weber

(10) Patent No.: US 6,184,848 B1
(45) Date of Patent: Feb. 6, 2001

(54) POSITIVE COLUMN AC PLASMA DISPLAY

(75) Inventor: Larry F. Weber, New Paltz, NY (US)

(73) Assignee: Matsushita Electric Industrial Co., Ltd., Kadoma Osaka (JP)

( * ) Notice: Under 35 U.S.C. 154(b), the term of this patent shall be extended for 0 days.

(21) Appl. No.: 09/310,446

(22) Filed: May 12, 1999

Related U.S. Application Data

(63) Continuation-in-part of application No. 09/159,211, filed on Sep. 23, 1998, now abandoned.

(51) Int. Cl.[7] ..... G09G 3/28
(52) U.S. Cl. ..... 345/60; 345/67; 345/68
(58) Field of Search ..... 345/60, 62–68; 315/169.4

(56) References Cited

U.S. PATENT DOCUMENTS

| | | | | |
|---|---|---|---|---|
| Re. 31,231 | * | 5/1983 | Ogle et al. | 345/62 |
| 3,666,981 | | 5/1972 | Lay . | |
| 4,613,854 | * | 9/1986 | Holz et al. | 345/58 |
| 4,728,864 | | 3/1988 | Dick . | |
| 4,924,218 | | 5/1990 | Weber et al. . | |
| 5,446,344 | * | 8/1995 | Kanazawa | 315/169.4 |
| 5,519,520 | * | 5/1996 | Stoller | 349/32 |
| 5,745,086 | * | 4/1998 | Weber | 345/63 |
| 5,825,128 | * | 10/1998 | Betsui et al. | 313/582 |
| 5,852,347 | * | 12/1998 | Marcotte | 315/169.4 |
| 5,877,734 | * | 3/1999 | Amemiya | 345/60 |
| 5,889,501 | * | 3/1999 | Sasaki et al. | 345/60 |
| 6,034,482 | * | 3/2000 | Kanazawa et al. | 315/169.4 |
| 6,037,916 | * | 3/2000 | Amemiya | 345/60 |

OTHER PUBLICATIONS

Flat Panel Displays and CRT'S; L. E. Tannis, Editor; Van Nostrand–Reinhold 1985; pp. 332–352; Larry F. Weber; "Plasma Displays".

Proc. of Int'l Display Workshop, 1998, pp. 575–578, D. I. Kim et al., "New AC–PDP Structure with Floating Electrodes".

* cited by examiner

*Primary Examiner*—Richard A. Hjerpe
*Assistant Examiner*—Henry N. Tran
(74) *Attorney, Agent, or Firm*—Ohlandt, Greeley, Ruggiero & Perle, L.L.P.

(57) ABSTRACT

An AC PDP has a plurality of addressable subpixel sites, each subpixel site including an address electrode positioned on one substrate and first and second sustain electrodes positioned on an opposed substrate. An intersection between the address electrode and the first sustain electrode defines a first discharge site and an intersection between the address electrode and the second electrode defines a second discharge site. A scan driver is active during an address phase, and applies a negative going signal to the first sustain electrode. An address driver applies an address signal to the address electrode which creates a discharge at the first discharge site. As a result, a positive column moves along the address electrode to the second discharge site and causes a discharge thereat which induces a wall voltage at the second discharge site in accordance with a determined subpixel value. A sustain driver applies a sustain signal to both the first sustain electrode and the second sustain electrode and creates a "ping pong" action of the wall charge states at the discharge sites and enables the use of positive column light emission in the PDP.

48 Claims, 21 Drawing Sheets

| DESIGN | SUSTAIN ELECTRODE WIDTH (EW) μm | SUSTAIN GAP SusG μm | SUBSTRATE GAP SubG μm | INTER PIXEL GAP IPG μm | RATIO: SusG/SubG | RATIO: SusG/IPG | PIXEL PITCH PP μm | ELECTRODE TYPE T=TRANSPARENT O=OPAQUE | |
|---|---|---|---|---|---|---|---|---|---|
| F | 316 | 102 | 121 | 346 | 0.84 | 0.29 | 1080 | T | PRIOR ART |
| N | 300 | 105 | 100 | 345 | 1.05 | 0.30 | 1050 | T | |
| M | 375 | 80 | 100 | 250 | 0.80 | 0.32 | 1080 | T | |
| P | 80 | 135 | 110 | 365 | 1.23 | 0.37 | 660 | 0 | |
| INV | 100 | 700 | 110 | 420 | 6.36 | 1.67 | 1320 | 0 | |

TABLE 1

FIG.2d

DRIVING WAVEFORM

POSITIVE COLUMN AC PLASMA DISPLAY

This Application is a continuation in part of U.S. patent application, Ser. No. 09/159,211, filed Sep. 23, 1998, now abandoned.

FIELD OF THE INVENTION

This invention relates to AC plasma display panels and, more particularly, to a an AC plasma display panel that emits most of its light from the positive column region of a gas discharge and, as a result, exhibits substantially improved levels of image brightness and luminous efficiency.

BACKGROUND OF THE INVENTION

Prior art AC plasma display panels (PDPs) generate the majority of their emitted light from the negative glow region of a gas discharge. As is known to those skilled in the art, gas discharges exhibit two distinct light emitting regions, i.e. the negative glow wherein a plasma exists with an excess of positively charged ions and the positive column wherein the plasma evidences a balance of positively charged ions and electrons.

PDP subpixel sites operate using the same fundamental principle as a fluorescent lamp. More particularly, a PDP subpixel employs ultraviolet light generated by a gas discharge to excite visible light emitting phosphors. A fluorescent lamp uses the positive column region of a gas discharge to generate most of its light since the positive column has a much higher luminous efficiency than the negative glow.

The positive column has not been previously successfully applied to AC PDPs because the limited physical space of the small subpixel sites do not easily allow sufficient room for the usually long dimensions of a positive column.

The Positive Column and the Negative Glow

In qualitative terms, the power in a gas discharge is divided between the two major regions: the positive column and the negative glow. The positive column is characterized by an equal density of electrons and ions that are of a very high density that shields out most of an applied electric field. In the positive column the high density of highly conductive electrons and ions quickly move to cancel any high field region.

The negative glow is characterized by a very high level of positive ions and a very low level of negative electrons. The high density of positive charge means that the electric field in the negative glow is very high. The very high electric field allows a major part of the potential applied across the gas to be dropped across the negative glow. Since the positive column and the negative glow are electrically "connected" in series, all of the current through the gas discharge passes through both the positive column and the negative glow. To determine the instantaneous power dissipated in a given discharge region, it is necessary to simply multiply the discharge current by the voltage drop across the region.

The positive column and the negative glow have considerably different luminous efficiencies. In general, the positive column is very efficient and the negative glow is inefficient. A fundamental reason for this difference is that most of the current flow in the positive column is due to electrons and most of the current flow in the negative glow is due to ions. Energy absorbed by electrons can be used to efficiently excite atoms that ultimately emit light. Alternatively energy absorbed by ions eventually gets transferred to the gas atoms as kinetic energy and simply heats up the gas.

As stated above, the positive column has approximately equal numbers of electrons and ions. Since the electrons have roughly 100 times the mobility of the ions, they will conduct 100 times more of the current than the ions in the positive column. Because most of the current flow in the positive column is in the electrons, virtually all of the power dissipated in the positive column goes into the kinetic energy of the electrons. This kinetic energy can be transferred to the excitation of atoms with efficiencies greater than 80% if the electric field is of the correct low value. Virtually all of the excited atoms generate ultraviolet photons which can further excite the phosphors to emit the desired visible light.

The negative glow has a high number of ions and a much smaller number of electrons. Even though the electrons have two orders of magnitude greater mobility than the ions, the ions are of such a large density that much of the power dissipated in the negative glow goes to the kinetic energy of the ions. However, the electric field in the negative glow is very high and therefore the electrons gain much higher kinetic energies than in the lower field of the positive column. The higher electron kinetic energies mean that the electrons can both excite and ionize the atoms. Electron energy used to ionize the atoms creates ions that flow to the cathode and are ultimately neutralized at the cathode surface.

While electron impact ionization of atoms is the source of ions and electrons that are needed to make the gas discharge conductive, it does not create any ultraviolet photons. Therefore the high electric fields in the negative glow allow a large amount of impact ionization which results in a much lower conversion efficiency of electron kinetic energy to ultraviolet photons. This UV conversion efficiency may be typically only 30% compared to 80% in the positive column.

It is known that the positive column exhibits an 80% total efficiency and that the negative glow exhibits an efficiency of 15%. This difference in efficiencies indicates why it is much more desirable to dissipate energy in the positive column than in the negative glow and is the fundamental reason that fluorescent lamps are designed to use the positive column and why they achieve a high luminous efficiency of 80 lumens per watt. To achieve this result, the fluorescent lamp design maximizes the power dissipation in the highly efficient positive column and minimizes it in the low efficiency negative glow.

One way that most fluorescent lamps reduce dissipation in the negative glow is to use a heated cathode that emits large numbers of electrons that serve to drive the gas discharge. This source of electrons reduces the voltage drop across the negative glow by an order of magnitude which, for equal currents, reduces the power dissipation in the negative glow by an order of magnitude. Such a reduction allows for more dissipation in the much more efficient positive column. The use of this same idea for PDPs would require a heated cathode for each of the hundreds of thousands of subpixels in the display. Because such an arrangement is impractical, it is difficult to reduce the power dissipation in the negative glow of a plasma display.

A second strategy for increasing the efficiency of the fluorescent lamp is to increase the length of the positive column. This is the reason that the common fluorescent lamp is a long tube. The positive column can be modeled as a resistor. Therefore the longer the positive column, the greater its resistance and the greater its power dissipation. The properties of the positive column allow it to be easily extended in length as long as there is sufficient voltage to establish the desired current across its resistance. This means that for a constant current, as the positive column is made longer, the voltage across the positive column needs to increase proportionally. Further, the longer the positive column, the more favorable is the ratio between the power dissipated in the positive column and that dissipated in the negative glow.

While the principle of making a gas discharge more efficient by using a long positive column is well known, it has not been successfully applied to PDPs. One reason is that it has long been thought that the long nature of the positive column is not practical for the very small subpixels of a plasma display and therefore, observers have stated that most of the light from a PDP comes from the negative glow.

FIG. 1 shows a prior art color AC PDP from U.S. Pat. No. 5,745,086. This structure utilizes ultraviolet light which is generated by a gas discharge to selectively excite red, green and blue phosphors to emit the desired full color visible light. FIGS. 2*a*–2*c* show typical cross sectional views of the subpixels in the AC PDP of FIG. 1. Such an AC PDP operates with AC voltages and provide write voltages which exceed the firing voltage of the ionizable gas at a given discharge site, as defined by selected column and row electrodes. The discharge is continuously "sustained" by applying an alternating sustain signal (which, by itself, is insufficient to initiate a discharge). The technique relies upon wall charges generated on the dielectric layers of the substrates which, in conjunction with the sustain signal, operate to maintain continuing discharges.

In order for an AC plasma panel to exhibit reliable operation, its wall charge states must be repeatable and standardized. More specifically, the wall charge states must exhibit repeatable values irrespective of a previous data storage state, so that succeeding address and sustain signals reliably cooperate to assure repeatable pixel site operation.

In FIGS. 1 and 2*a*–2*c*, PDP 10 includes a back substrate 12 upon which plural column address electrodes 14 are supported. Column address electrodes 14 are separated by barrier ribs 16 and are covered by red, green and blue phosphors 18, 20 and 22, respectively. A front transparent substrate 24 includes a pair of sustain electrodes 26 and 28 for each row of pixel sites. A dielectric layer 30 is emplaced on front substrate 24 and a magnesium oxide or similar high gamma material overcoat layer 32 covers the entire lower surface thereof, including all of sustain electrodes 26 and 28.

The structure of FIG. 1 is sometimes called a single substrate AC PDP since both sustain electrodes 26 and 28, for each row, are on a single substrate of the panel. An inert gas mixture is positioned between substrates 12 and 24 and is excited to a discharge state by a sustain signal applied by sustain electrodes 26 and 28. The discharging inert gas produces ultra-violet light that excites the red, green and blue phosphor layers 18, 20 and 22, respectively to emit visible light. If the driving voltages applied to column address electrodes 14 and sustain electrodes 26, 28 are appropriately controlled, a full color image is visible through front substrate 24.

The table shown in FIG. 2*d* provides typical dimensions of prior art PDPs (in micrometers) for various designs. Designs F, N, M and P are designs used in practical displays by various manufacturers. Note that for these designs, the gap distance between the front substrate sustain electrodes, called the sustain gap (SusG) is usually approximately equal to the gap distance between the front substrate and the rear substrate, referred to as the substrate gap (SubG). This is illustrated by the ratio SusG/SubG which ranges between 0.84 and 1.23 for the four prior art designs.

While many different dimensions have been successfully used, the approximate equality between these two gaps has been maintained. Note also that the sustain gap is always less than the distance between the sustain electrode of one subpixel and the sustain electrode of a neighboring subpixel which is referred to as the inter pixel gap (IPG). This is illustrated by the ratio SusG/IPG which ranges between 0.29 and 0.37 for the four prior art designs.

If the IPG is not considerably larger than the SusG, there will be strong interaction between subpixels that will cause operational failures. More specifically, if the IPG is smaller than the SusG, then when the sustain signal is applied, the electric field across the IPG will be larger than the electric field across the SusG. This will allow a discharge to occur along the IPG which would modify the charge on the sustain dielectric layers and substantially modify the operation of the discharge along the sustain gap.

It is therefore an object of this invention to provide a full color PDP which exhibits improved image brightness and luminous efficiency when compared to prior art PDPs.

It is a further object of this invention to provide a full color PDP wherein subpixel sites utilize positive column discharges to achieve improved luminous efficiencies and high levels of light emission.

SUMMARY OF THE INVENTION

An AC PDP has a plurality of addressable subpixel sites, each subpixel site including an address electrode positioned on one substrate and first and second sustain electrodes positioned on an opposed substrate. An intersection between the address electrode and the first sustain electrode defines a first discharge site and an intersection between the address electrode and the second electrode defines a second discharge site. A scan driver is active during an address phase, and applies a negative going signal to the first sustain electrode. An address driver applies an address signal to the address electrode which creates a discharge at the first discharge site. As a result, a positive column moves along the address electrode to the second discharge site and causes a discharge thereat which induces a wall voltage at the second discharge site in accordance with a determined subpixel value. A sustain driver applies a sustain signal to both the first sustain electrode and the second sustain electrode and creates a "ping pong" action of the wall charge states at the discharge sites and enables the use of positive column light emission in the PDP.

BRIEF DESCRIPTION OF THE DRAWINGS

FIG. 2*d* is a Table which provides measurements of both prior art PDPs and a PDP incorporating the invention.

DETAILED DESCRIPTION OF THE INVENTION

Initially, a high level description of the invention will be presented, followed by a detailed discussion of the theory of operation and a consideration of a number of design considerations that are important to creating a high brightness PDP employing the invention hereof.

Figure 3:
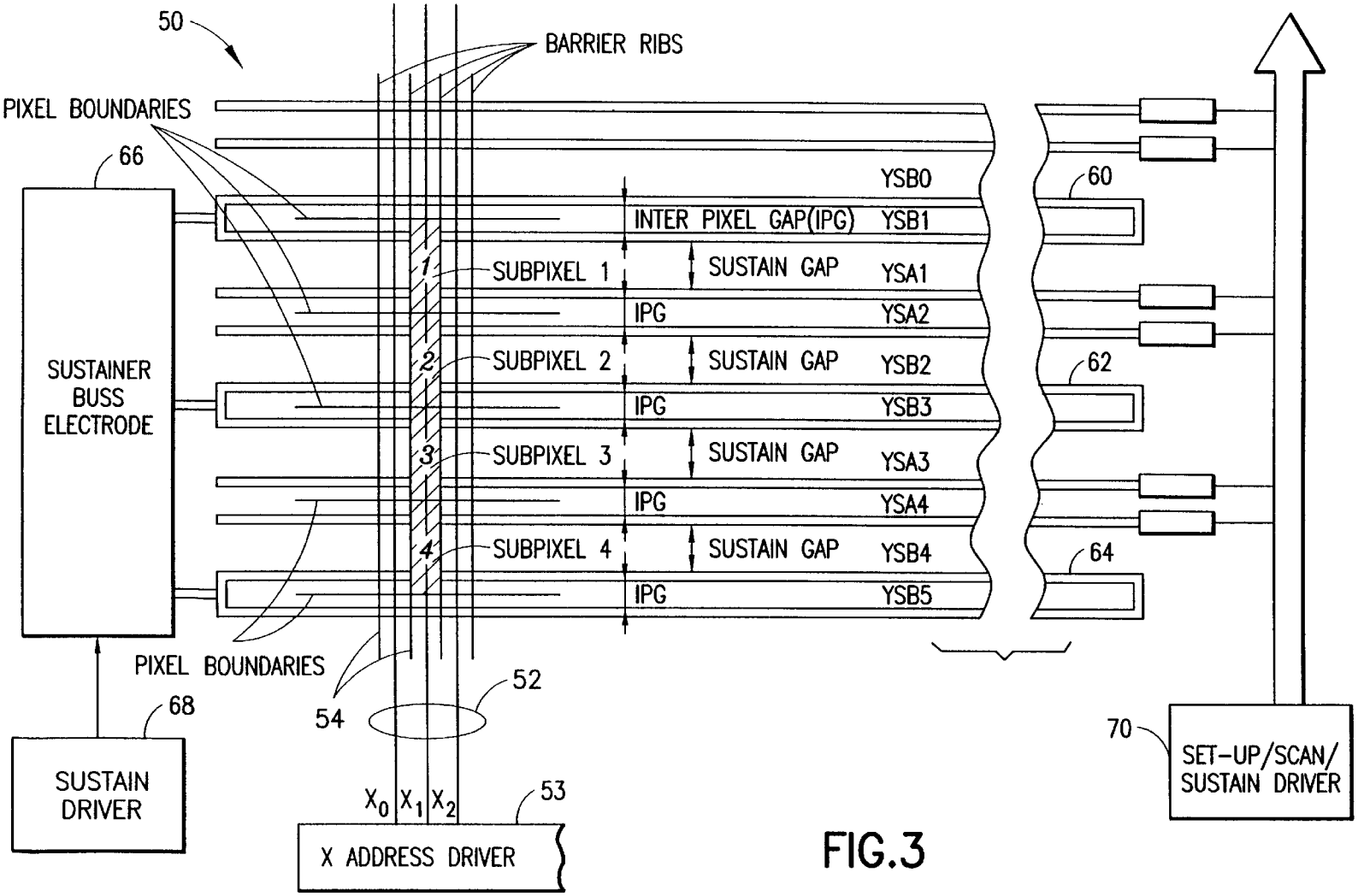
FIG. 3 is a schematic which illustrates the electrode arrangements of a PDP incorporating the invention.
Figure 4:
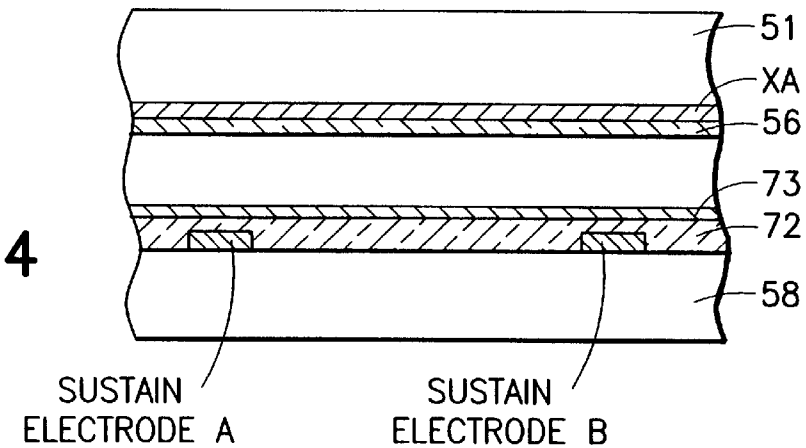
FIG. 4 is a sectional view of a subpixel in the PDP of FIG. 3.

In FIG. 3, a schematic electrode layout is shown of a PDP 50 incorporating the invention. FIG. 4 is a sectional view across subpixel 1 in FIG. 3. On an upper substrate 51, a plurality of single trace address electrodes 52 (X0–Xn−1) are positioned and are driven, selectively, by an X address driver 53 during an address phase of operation. Address electrodes X0–Xn−1 are separated by barrier ribs 54. Each address electrode is covered by a dielectric/phosphor coating 56. On lower substrate 58 are positioned a plurality of sustain loops 60, 62, 64, etc., each of which comprises a pair of parallel trace electrodes, e.g., YSB0 and YSB1. All of sustain loops 60, 62, 64, etc. are driven in common from sustain bus electrode 66, which is, in turn, connected to a sustain driver 68.

Interleaved between the sustain loops are pairs of single trace scan electrodes, e.g., YSA1, YSA2, etc. which are individually driven by a scan/sustain driver 70. Scan/sustain driver 70, during a sustain phase, applies sustain signals to each of scan electrodes YSA1, YSA2, . . . , which act as sustain electrodes during the sustain phase. Scan/sustain driver 70, during an address phase, sequentially applies scan voltages to the scan electrodes in a raster scan manner. Each of the scan electrodes and sustain loop electrodes is covered by a dielectric coating 72 (FIG. 4) and, for example, an MgO overcoat 73. A dischargeable gas is maintained between upper substrate 51 and lower substrate 58.

When appropriate sustain signals are applied to PDP 50, subpixel illumination selectively occurs between adjoining scan and sustain electrodes (along intersecting address electrodes) by virtue of positive column discharges. The discharges at an ON subpixel "ping pong" between one discharge cell which exists at the intersection of a sustain electrode and an address electrode, and a second discharge cell which exists at a scan electrode and the address electrode.

A fundamental principle of operation of PDP 50 that makes the light from the positive column dominant over the negative glow light, is that the distance between each scan electrode and adjoining sustain electrode (sustain gap) is made as long as possible in order to make the positive column as long as possible. This has the effect of increasing the power dissipated in the positive column relative to the power dissipated in the negative glow and thereby increases the relative light emitted by the positive column. The techniques used to operate the invention enable the sustain gap to be much greater than the substrate gap SubG. In addition the techniques allow the SusG to be larger than the inter pixel gap (IPG) without an exchange of the roles of these two gaps.

An electrode dimension design, while not necessarily optimum, has been found to operate according to the invention with a highly luminous positive column along the sustain gap in a practical AC PDP having a gas mixture of 10% xenon and 90% neon with a gas pressure of 450 Torr and an MgO cathode material 73. The design has a pixel pitch of 1320 um which is appropriate for a 4:3 aspect ratio VGA color PDP having 640 by 480 pixels and a 42 inch diagonal. In this design the sustain electrode width is 100 um, the sustain gap is 700 um and the inter pixel gap is 420 um. The substrate gap is 110 um.

Figure 2A:
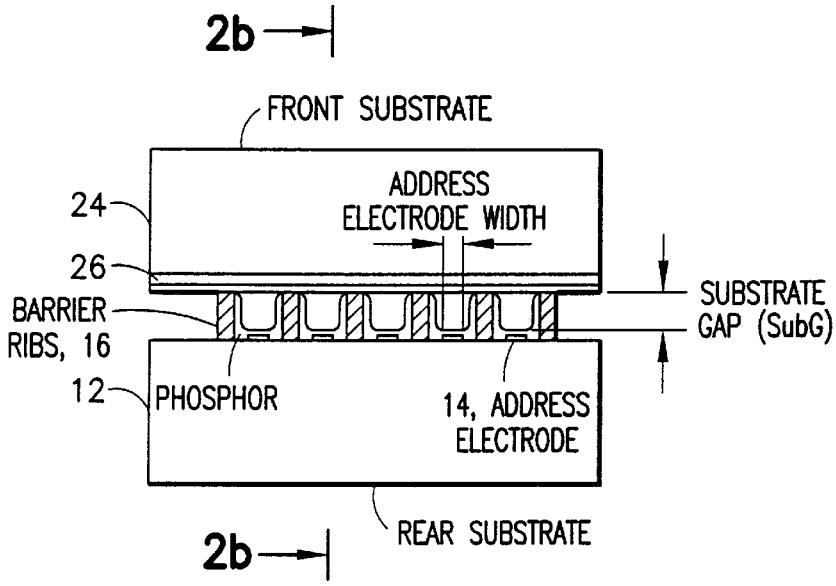
FIG.2a PRIOR ART
FIG. 2*a* shows a first sectional view of the AC PDP of FIG. 1.

It is always true that the sum of the sustain gap, the inter pixel gap and twice the sustain electrode width is equal to the pixel pitch in the dimension perpendicular to the sustain electrodes. The dimensions of the aforesaid embodiment of PDP 50 are shown in Table 1 (FIG. 2*d*) under design INV. Clearly the design violates the conventional prior art design rules since the sustain gap is 6.36 times larger than the substrate gap and in addition the sustain gap is 1.67 times greater than the inter pixel gap. Comparison of the Table 1 ratios SusG/SubG and SusG/IPG shows that the INV design is considerably different than the prior art designs. Under prior art operating conditions, the INV design would not operate properly.

What follows below is a description of how to configure PDP 50 so that it can utilize subpixel dimensions similar to the INV design and still maintain acceptable plasma display sustaining and addressing operations and, in addition, generate most of the light from the positive column.

First to be described will be how to operate with such a large ratio of 6.36 of the sustain gap to the substrate gap. This initial description will temporarily ignore the issue of interaction between neighboring subpixels, however this issue will be covered in further detail below.

The invention allows two independent sustain discharges to occur along the substrate gap, the first sustain discharge being between the first sustain electrode (i.e., the scan electrode) and the address electrode, and the second sustain discharge being between the second sustain electrode and the address electrode. It is to be noted here that the scan electrodes perform a scan function during the address phase and perform a sustain function during a sustain phase. During the address phase, the scan driver applies sequential scan voltages to the scan electrodes, whereas during the sustain phase, a sustain signal is applied, in common, to all of the scan electrodes, which accordingly operate as sustain electrodes.

The 700 um sustain gap is so large relative to the 110 um substrate gap that it is difficult to strike a discharge between the two sustain electrodes at a reasonably low voltage. However the substrate gap is only 110 um and therefore it is easy to strike a discharge at a reasonably low voltage between an address electrode and a sustain electrode. The problem is that the sustain gap is so great that it initially appears difficult to set up a discharge along the sustain gap even though there are discharges between the sustain electrodes and the address electrode along the substrate gap.

The sustain operation results in each subpixel being divided into two seemingly independent cells, one cell defined by the intersection of a first sustain electrode and the address electrode and the second cell defined by the intersection of the second sustain electrode and the address electrode. It is a fundamental teaching of this invention of a technique that allows strong conductivity between these two seemingly independent plasma display cells.

To discuss this sustain technique further, it is desirable to re-name the two cells discussed above. Hereafter, the cell that initiates the discharge will be named the trigger cell and the cell to which (i) the positive column extends and (ii) stores the pixel state, will be named the state cell. Hereafter the term scan electrode will only be used during an address phase of operation of the invention.

The fundamental principle is to operate the trigger cell in such a manner that when an appropriate discharge is initiated therein, a highly ionized positive column will emanate out therefrom and will move along the sustain gap (and the spanning address electrode) until it intersects with the state cell. This highly ionized positive column then forms a conductive channel between the trigger cell and the state cell which acts to discharge the wall charges on both the trigger cell and the state cell.

When the highly conductive channel forms and discharges the wall voltages on the dielectrics at the trigger and state cells, a highly luminous positive column discharge is formed that has greater luminance than the negative glow. The details of how this is accomplished will be discussed below.

FIGS. 5*a*–5*f* are a time sequence illustrating the above described operation. To examine the trigger cell discharge, assume a negative going pulse is applied to the trigger cell sustain electrode A so that it initiates a trigger cell discharge across the substrate gap, while the sustain electrode A acts as the cathode with respect to address electrode XA. Further assume that the initial voltage across the trigger cell substrate gap is at least 250 volts. Under such conditions, a highly conductive positive column can occur that emanates from the trigger cell to the state cell.

At time t0 (FIG. 5*a*), the voltage across the substrate gap is high and the discharge is growing in intensity, but has not yet reached a level of intensity that results in any significant field distortion and it has not significantly altered the initial wall charge distribution on any of the dielectric surfaces. At time t1 (FIG. 5*b*), the discharge has reached a level of intensity that field distortion has created a highly conductive plasma region near the trigger cell address electrode XA (acting as the anode). This plasma region is the positive column. Near the trigger cell sustain electrode (acting as the cathode) is the negative glow region that has a high electric field and a very high ion density but a relatively low electron density. This highly conductive discharge and field distortion discharges the dielectric capacitors over both sustain electrode A and address electrode XA of the trigger cell.

In most color plasma displays the dielectric covering the address electrode comprises a phosphor layer that is usually a powder with a low density. Such a low density powder usually has a low relative dielectric constant, causing the capacitance of the dielectric layer covering the address electrode to be considerably less than the capacitance of the dielectric layer covering the sustain electrode. Because of these differences in capacitances, when a discharge current flows through the two capacitors, the voltage across the address electrode dielectric 56 will change much more quickly than that across sustain dielectric 72 (including MgO layer 73).

Figure 5A:
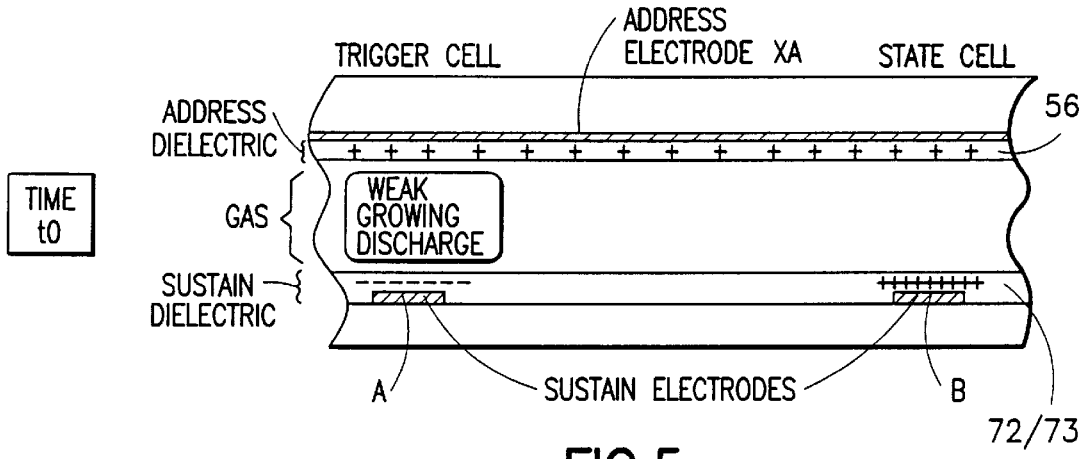
FIGS. 5*a*–5*f* illustrate the operation of the subpixel of FIG. 4.
Figure 5B:
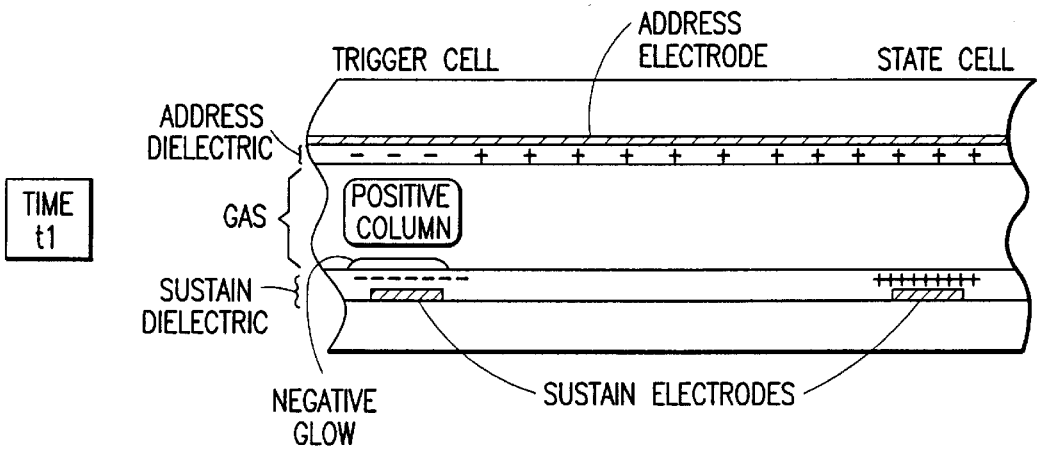

As the current from the trigger cell discharge flows onto address dielectric 56, the dielectric surface becomes more and more negative. This is shown as negative charges on the trigger cell address dielectric 56 at time t1 (FIG. 5*b*). Note that the trigger cell address electrode dielectric 56 charge distribution changes considerably between times t0 and t1, whereas the charge distribution for the trigger cell sustain dielectric 72 has not changed at all between these times. This signifies that, even though the same amount of charge has flowed through these two dielectrics, the voltage of address electrode dielectric 56 has changed much more because it has a much lower capacitance than the sustain electrode dielectric 72.

At some point during the trigger cell discharge the voltage on the address electrode dielectric 56 becomes so negative that the regions of dielectric 56 along address electrode XA further away from the center of the trigger cell will have a more positive potential than the regions in the center of the trigger cell. Electrons from the highly conductive plasma very quickly move to these regions of more positive potential and effectively couple the energy stored in the capacitance of the extended dielectric 56 into the discharge.

Figure 5C:
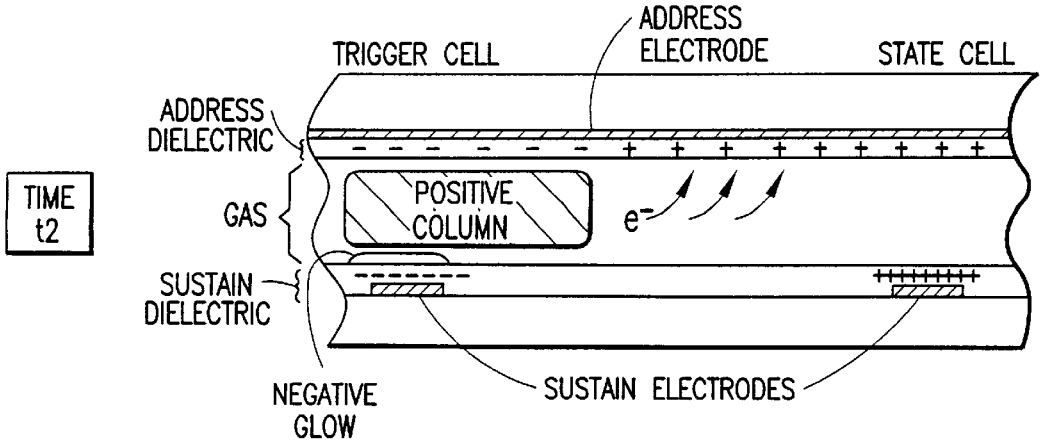
Figure 5D:
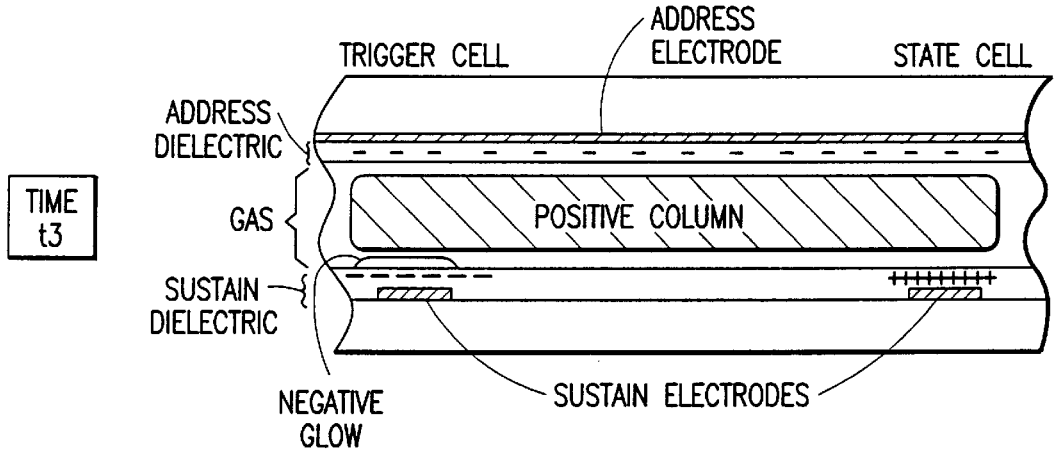

FIG. 5*c* (time t2) shows how the positive column has extended itself away from the center of the trigger cell and is discharging this extended region further. Note that as the positive column extends from the center of the trigger cell, the regions of address electrode dielectric 56 in contact with the positive column become negatively charged whereas those regions not yet contacted by the positive column remain positively charged.

At time t3 (FIG. 5*d*), the positive column from the trigger cell discharge has reached the state cell and the electrons from the positive column flow to the positive potential of dielectric 72 covering the state cell sustain electrode B. Dielectric 72 has a dielectric constant considerably higher than the dielectric constant of address electrode dielectric 56, allowing considerably more charge to flow into the state cell sustain dielectric 72 before its potential changes significantly.

Figure 5E:
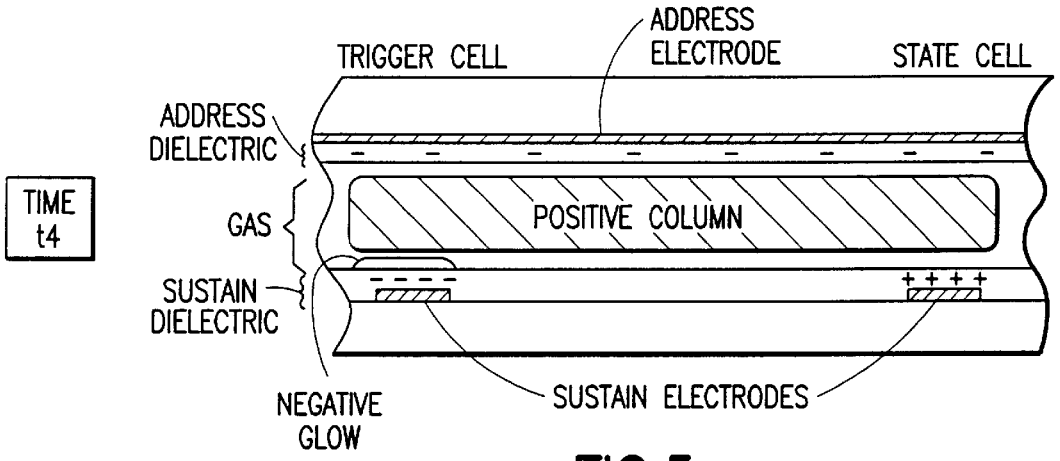

With the highly conductive positive column bridging the sustain gap at time t3, the current between sustain electrodes A and B begins to rise to very high levels and most of the energy stored in the sustain electrode dielectric capacitance of both the state cell and the trigger cell is deposited into the electron energy of the positive column. The positive column forms a highly luminous filament that bridges the sustain gap. This filament grows in intensity until it reaches a peak at time t4 (FIG. 5*e*).

At this point the charge deposited by the discharge on dielectric 72 covering sustain electrode B has risen to a sufficiently large level that the voltage across the positive column is reduced to a low level and to a point where the light generation rate peaks and then begins to decrease. Compare the trigger cell and state cell dielectric wall charge distributions for times t3 and t4 (FIG. 5*e*) and note that the state cell sustain dielectric 72 has less positive charge at time t4 and also note that the trigger cell sustain dielectric 72 has less negative charge at time t4. Also note that address electrode dielectric 56 has less negative charge at time t4 compared to t3.

After the peak at time t4, the discharge continues to decay in intensity until at time t5 (FIG. 5*f*), the discharge current no longer flows. At this point the space charges created in the gas volume have flowed to all of the dielectric surfaces. If the initial voltage across the gas volume is high enough so that a sufficiently strong discharge occurs, then there is sufficient available space charge to substantially reduce the voltage across the gas to zero volts for nearly all regions of the subpixel. This means that nearly all dielectric surfaces at time t5 will be at one potential.

That fact is important for analysis of the subsequent discharges. The single potential of all dielectric surfaces at time t5 is signified in FIG. 5*f* by the equal density of positive charges on all dielectric surfaces.

Isolation Bars

Figure 3A:
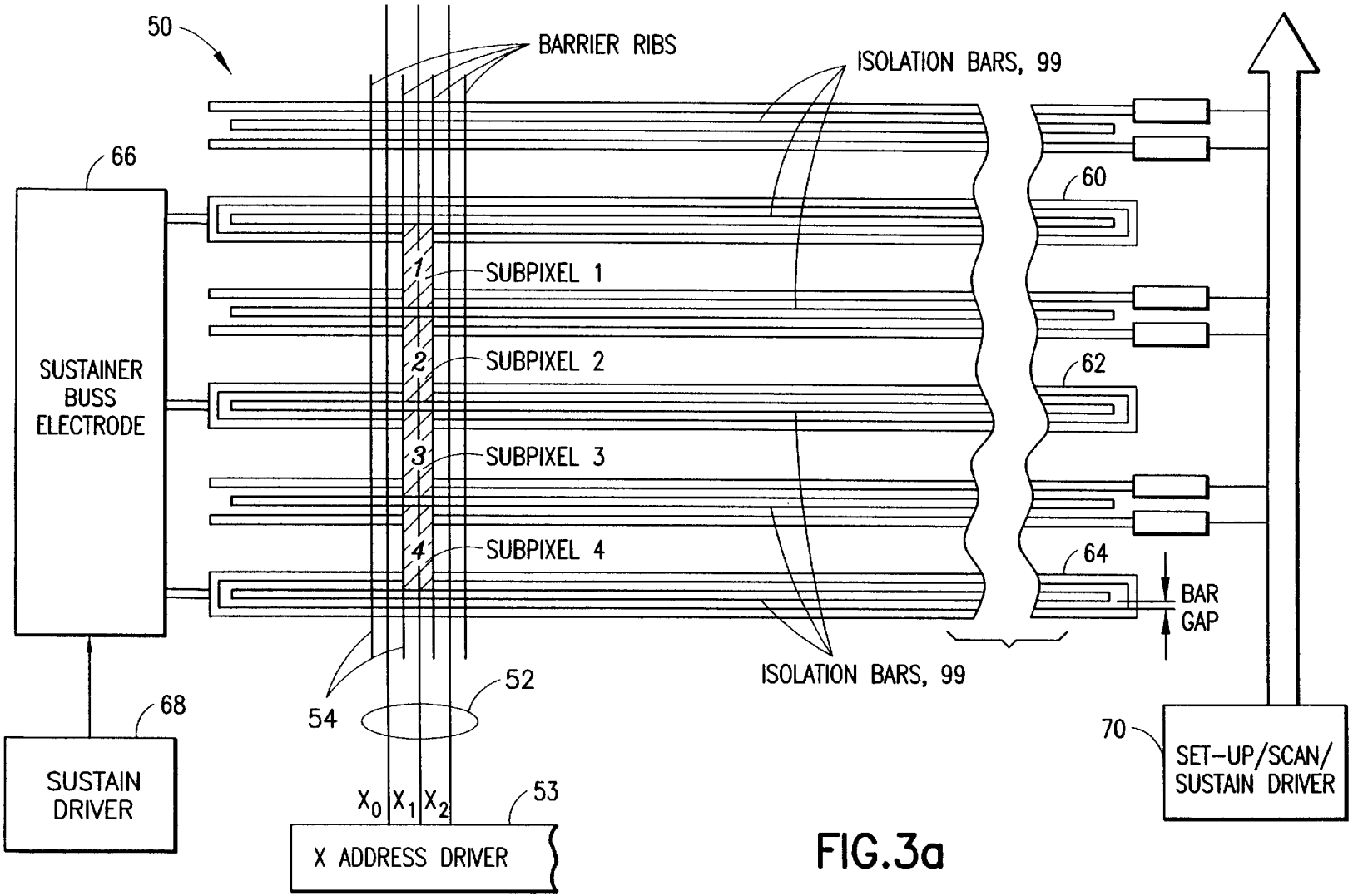
FIG. 3*a* illustrates an electrode arrangement of FIG. 3, which further incorporates electrode isolation bars.

FIG. 3*a* shows a second embodiment of the electrode layout of FIG. 3 wherein conductive isolation bars 99 have been placed within each inter pixel gap IPG. Since the electrode topology of FIG. 3 has a larger sustain gap than inter pixel gap, it is desirable to provide an isolation means which restricts the spreading of positive column discharges across inter pixel gaps. Such a means is provided by conductive isolation bars 99.

FIGS. 5*a*–5*f* show how the positive column moves along the sustain gap between the trigger cell and the state cell. In this figure the positive column moves from left to right. It is important to consider why the positive column moves to the right in this case and why it does not move to the left. If it were to move to the left then it could move across the inter-pixel gap which could cause an undesirable interaction with a neighboring pixel which could errantly change the state of the neighboring pixel. Another important consideration is why does the positive column stop once it has reached the state cell or in other words, why does the positive column not continue its spread past the state cell across the inter pixel gap and on to the large positive charge of the neighboring state cell. An additional problem with the positive column extending across either the left or the right inter pixel gap is the large amount of undesirable light generated between the pixels.

Figure 3B:
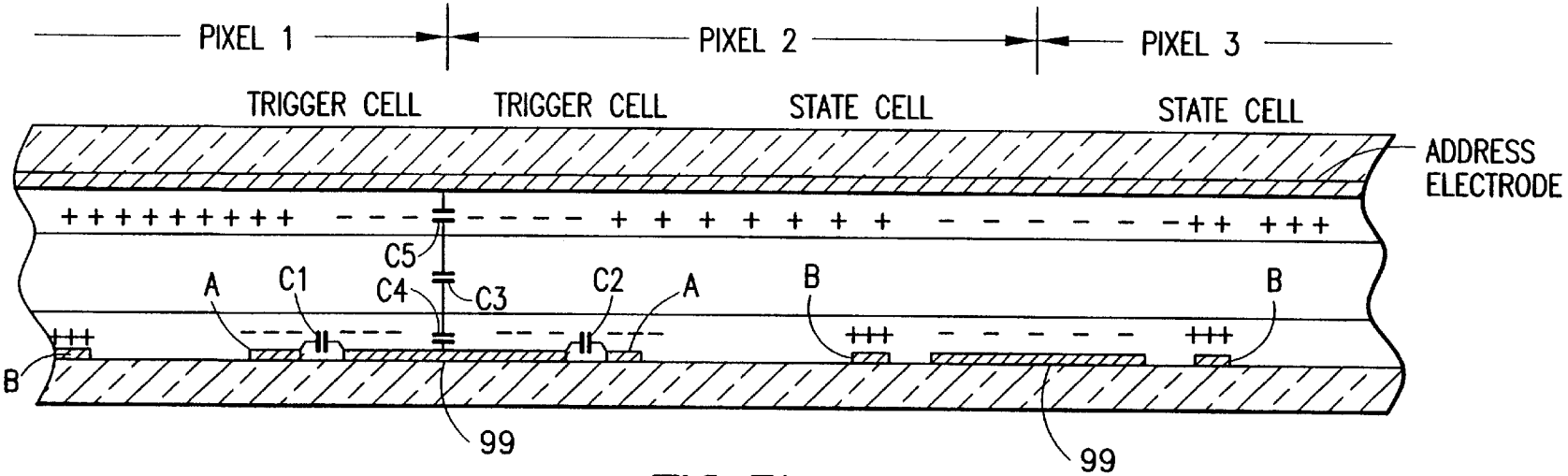
FIG. 3*b* is a sectional view of a part of the electrode arrangement of FIG. 3*a*, helpful in enabling an understanding of the operation of the electrode isolation bars.

FIG. 3*b* shows a cross section of three pixels of the plasma panel with the electrodes of FIG. 3*a*. FIG. 3*b* also shows the initial charge distribution on the dielectric layers at the time t0 which is the same time as shown in FIG. 5*a*. In pixel 2 of FIG. 3*b* the positive column moves from the trigger cell to the state cell in the exact way shown in FIG. 5. This movement occurs because the electrons from the leading edge of the positive column are attracted to the positive charge along the dielectric covering the address electrode as shown in FIG. 5*c*. Since the address electrode dielectric to the right of the FIG. 3*b*, pixel 2 trigger cell is positive, the pixel 2 positive column will move to the right. Note that the address electrode dielectric to the left of the pixel 2 trigger cell is negative. This will repel the positive column electrons and therefore inhibit the growth of the positive column to the left of the pixel 2 trigger cell.

Once the pixel 2 positive column reaches the state cell, it does not continue to move to the right to the positive charge of the pixel 3 state cell because of the negative charge on the dielectric covering the address electrode in the inter pixel gap between the pixel 2 state cell and the pixel 3 state cell.

It is therefore the presence of the negative charge along the dielectric in the inter pixel gap that inhibits the positive column from moving across the inter pixel gap and causing errant neighboring addressing and discharge light. It is important to take measures to insure that this negative charge exists.

Dielectric surfaces that are near gas discharges have a well known characteristic that the dielectric regions farther from the main discharge activity charge up more negatively than those regions in close contact with the discharge. This phenomenon is fundamentally caused by the different velocities of the electrons and the ions in the gas. Because of the relative masses of these charged particles the electrons have approximately 100 times the velocity of the ions in a gas discharge. This means that electrons will fly out of the discharge 100 times faster than the ions. When the initial electrons fly out they will charge the dielectric surface negatively and set up a negative potential that will repel the electrons. This negative potential will attract the positive ions.

As the sustain discharges continue, this negative potential continues to grow until an equilibrium potential is reached. The equilibrium potential is determined by the condition that an equal number of ions and electrons flow to the surface. This equilibrium potential will repel the high velocity electrons and attract the low velocity positive ions so that the ion currents and the electron currents are equal. This equal ion and electron current condition will result in a zero sum of these opposite polarity currents. If the sum of the currents is zero, then there is no net charge flowing to the dielectric surface and the potential will stop changing. This stable potential is defined as the equilibrium potential.

The condition for establishing the negative charge in the inter pixel gap is that there be no significant discharge activity in the inter pixel gap. The sustain discharges will then establish the negative charges in the inter pixel gaps as shown in FIG. 3*b* by the mechanism discussed in the previous paragraph.

The purpose of the isolation bar 99 is to insure that there is no significant discharge activity in the inter pixel gap so that the negative charge can accumulate there. It is convenient to make the isolation bar with the same material and process as the front plate sustain electrodes. In this way the isolation bar is simply defined by a simple front plate electrode mask change. FIG. 3*a* shows that the isolation bars 99 are not directly electrically connected to any other electrodes, but are left floating. This means that the potential on the shorting bars will be determined by the capacitive coupling between the isolation bars and the other electrodes in the plasma panel. FIG. 3*b* shows the coupling capacitors, C1 through C5, for the isolation bar between pixels 1 and 2. If a pulse is applied to the electrodes A in FIG. 3*b*, a fixed percentage of that pulse will also appear on isolation bar 99. The value of this fixed percentage is determined by the pixel geometry's and materials dielectric properties.

The exact value of this percentage is determined by the capacitive divider comprised of the parallel combination of C1 and C2 with the series combination of C3, C4 and C5 shown in FIG. 3*b*. The magnitudes of capacitors C1 and C2 will be relatively large because they are formed in the glass layers of the front substrate glass and the dielectric glass which have high relative dielectric constants. The magnitude of the series combination of C3, C4 and C5 will be relatively low since series combinations of capacitors are always smaller than the smallest capacitor which in this case is C3. Since C3 is across the gas which has the lowest possible relative dielectric constant of 1, C3 will have a relatively low value compared to C1 and C2 which have the much higher glass relative dielectric constants which typically range from 7 to 15. This means that the fixed percentage of the pulse amplitude applied to the A sustain electrode that appears on isolation bar 99 is considerably greater than 50% but less than 100%. The exact value of this fixed percentage depends on the exact pixel geometry and materials relative dielectric constants.

While the above analysis was made for sustain pulses applied to the A sustain electrodes, the exact same results also occur if the sustain pulse is applied to the B sustain electrodes of FIG. 3*b*. This is because of the symetry of the A and B sustain electrodes shown in FIG. 3*b*.

The value of this fixed percentage is important for the proper operation of the isolation bar. As stated above it is necessary for there to be no significant discharge activity in the inter pixel gap. Since the isolation bar is very similar to the sustain electrodes, if the voltage pulses on the isolation bars are too high then an undesirable sustain discharge could occur to the isolation bar. It is therefore necessary to design the plasma display materials, electrode geometry's and sustain pulse amplitudes in such a way that when the sustain pulses are applied to the normal sustain electrodes that the fixed percentage discussed above is sufficiently low so that the pulsed potential that results on the isolation bar is below the voltage at which the sustain discharges can occur on the isolation bar. This minimum sustain voltage measured on the isolation bar is designated Vsminib.

As long as the pulsed voltage on the isolation bar is below Vsminib, there will be no significant discharge activity along the isolation bar and therefore there will be no significant discharge activity in the inter pixel gaps. This will allow the negative charge to build up in the inter-pixel gap which will repel the movement of the positive column across the inter pixel gap. This will eliminate the undesirable errant discharges to neighboring pixels or undesirable inter-pixel light.

When the isolation bar pulsed potential remains below Vsminib, the isolation bar has the desired effect of acting like a shield for the electric fields from the sustain electrodes that extend into the inter pixel gap. It acts like this shield primarily because of the negative charge on the dielectric layers shown in the inter pixel gap of FIG. 3*b* that accumulates due to lack of discharge activity.

U.S. Pat. No. 3,666,981 to Lay documents the usage of electrostatic isolation bars to prevent discharges from spreading out to neighboring cells on dual substrate monochrome PDPs. In the Lay electrode topology, the isolation bars are placed between every sustain electrode on both the front and the back substrates. In the invention presented here, the isolation bars are placed on only one substrate and only between every other sustain electrode. More specifically, this invention requires that the isolation bars be placed between only the sustain electrodes that are at the same potential during the sustain operation. This is shown in FIGS. 3*a* and 3*b*. Note in FIG. 3*b* that one isolation bar is between the two A sustain electrodes and another isolation bar is between the two B sustain electrodes. At any given time in the sustain period, both A sustain electrodes are at the same potential and both B sustain electrodes are at the same sustain potential. The potential on the A electrodes is frequently different than the potential on the B electrodes.

This invention would not work properly if the isolation bars were placed between sustain electrodes that are at a different potential during the sustain period. For instance if isolation bars were placed between the A and B electrodes of FIG. 3*b* there would be very significant problems. First of all the region between the sustain electrodes A and B is across the sustain gap which is where the main discharge of the panel occurs. Isolation bars in the region of the sustain gap will of course have the undesirable property of blocking the most significant light emission of the panel. In addition the placement of the isolation bars in the sustain gap would interfere with the electric field in the sustain gap and would also possibly interfere with the movement of the positive column from the trigger cell to the state cell.

In addition the pulsed potential that appears on an isolation bar placed between the A and B electrodes will be much different compared to the pulsed potential of isolation bars placed between two sustain electrodes that are always at the same potential during the sustain period. Since the A and B sustain electrodes are frequently at different potentials during the sustain waveform the isolation bar between the A and B electrodes would float to a lower potential when a sustain pulse is applied to either sustain electrode than the potential of an isolation bar placed between pulsed equipotential sustain electrodes. The reason for this is a differing capacitive divider ratio for the two different cases. For the case of the isolation bar between the A and B electrodes, the isolation bar will be pulsed to less than 50% of the amplitude of the pulse applied to either sustain electrode. For the geometry required by this invention where the isolation bar is between sustain electrodes of equal potential, the isolation bar will be pulsed to significantly greater than 50% of the pulse amplitude applied to the sustain electrodes.

Another problem with placing the isolation bars between the A and B sustain electrodes is the significant increase in capacitance between the A and B sustain electrodes. When the isolation bars are placed between the sustain electrodes of equal potential according to the principles of this invention, there is a minimal increase in the capacitance between the A and B sustain electrodes. This significantly reduced capacitance will significantly reduce the power dissipated in the circuits that must drive the panel capacitance.

Using the electrode topology shown in FIG. 3*a*, a PDP has been successfully operated where the inter pixel gap was set to be approximately equal to the sustain gap, isolation bars 99 were centered in the inter pixel gaps and the width of each isolation bar 99 was approximately 50% to 80% of the inter pixel gap.

Sustain Waveform Considerations

Applying a sufficiently large negative going sustain pulse to the trigger cell sustain electrode allows a strong discharge to occur between the trigger cell sustain electrode and the state cell sustain electrode, even though these electrodes have a sustain gap of 700 um and a substrate gap of only 110 um. The extension of the positive column along the address electrode serves as an effective means of coupling the seemingly distant trigger cell and state cell.

Figure 6A:
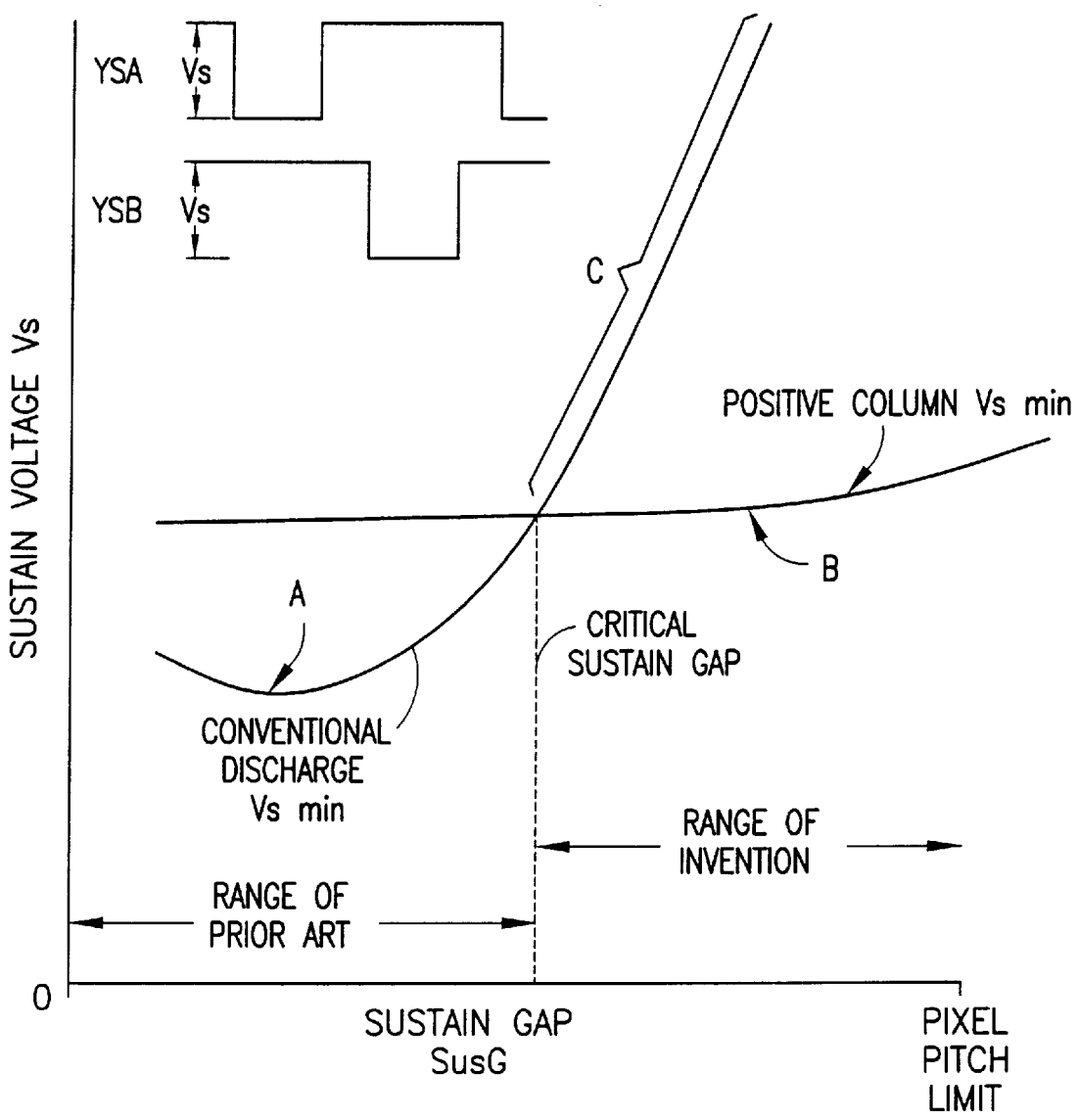
FIG. 6*a* is a plot of sustain voltage versus sustain gap illustrating the relationship between minimum sustain voltages required to establish a discharge for conventional design PDPs having relatively small sustain gaps and for PDPs constructed in accordance with the invention and exhibiting relatively large sustain gaps.

Referring to FIG. 6*a*, it will be understood that, due to the large sustain gap used by the invention, the invention departs from a common relationship of voltages used in the prior art. Curve A is similar to the classic U shaped gas discharge Paschen curve and defines how the minimum sustain voltage required by the prior art to just sustain a cell discharge between the two sustain electrodes (i.e., Vsmin) behaves as the sustain gap is varied.

For operation on the right side of the U, as the sustain gap increases, the Vsmin voltage increases because the electric field decreases due to the larger sustain gap distance which causes fewer ionizations per volt. For operation on the left side of the U, as the sustain gap is reduced, the Vsmin voltage increases because there are fewer electron collisions with gas atoms which causes fewer ionizations per volt.

In prior art AC PDPs, due to their small sustain gaps, Vsmin was relatively low and sustain voltages were employed that substantially exceeded Vsmin. By contrast, due to the large sustain gap of the invention, operation on the far right side of curve A applies and so Vsmin is substantially larger. This allows a practical sustain operation with another discharge mode that is illustrated by curve B. Curve B is defined as the minimum sustain voltage required to achieve a sufficiently strong discharge at a trigger cell, initially having an ON state wall voltage, which creates a positive column that travels to an adjacent state cell so as to successfully establish the state cell wall voltage to the ON state.

Note that curve B is much more weakly dependent on the sustain gap than is curve A. This is primarily because the initiation voltage of the curve B trigger cell discharge should be independent of the sustain gap since the trigger cell discharge initially occurs across the substrate gap and not the sustain gap, as does the curve A discharge. The curve B voltage increases only slightly with sustain gap because the trigger cell discharge must increase in strength slightly for the positive column to extend to the state cell for the longer sustain gaps.

The distinctly different shapes of curves A and B allow sustain operation according to the invention for sustain gaps larger than the intersection point of the two curves (i.e., the critical sustain gap). Use of the larger gaps allows operation below the Vsmin of curve A (i.e.,portion C of curve A), yet at a sustain voltage above curve B so that the invention discharge mode will successfully sustain the sub-pixels.

For sustain gaps larger than the intersection point, the prior art discharge between the two sustain electrodes, as defined by portion C of curve A, will not occur because the curve B discharge of the invention will occur at a lower sustain voltage and therefore will discharge to change the wall voltage before the higher voltage prior art discharge has time to form.

Electrode waveforms will hereafter be described that allow a stable sequence of plasma display subpixel discharges and allow a subpixel to be in either the ON state or the OFF state. These waveforms and conditions are necessary in order to achieve inherent memory in the AC PDP display subpixels.

Figure 6B:
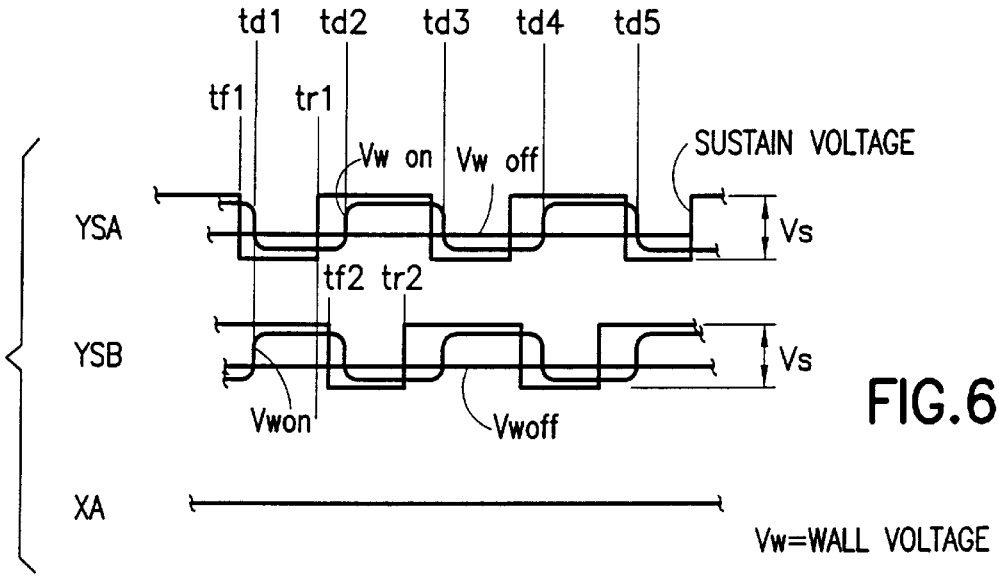
FIG. 6*b* illustrates a set of sustain waveforms used with the invention.

FIG. 6*b* shows one set of sustain waveforms that has been found to work well and that allow the subpixels to be in either the on state or the off state. Also shown in FIG. 6*b* are the wall voltage levels for both the on state and the off state. The wall voltage drawn for a given sustain electrode occurs due to charge on the dielectric covering the given sustain electrode and the charge on the address electrode dielectric that intersects the given sustain electrode. All wall voltages are drawn with a polarity such that the voltage across the substrate gap can be determined by subtracting the wall voltage from the sustain voltage. The two sustain electrodes in a subpixel are designated to be either YSA (the scan electrode during the address phase) or YSB and the address electrode is designated XA. FIG. 6*b* shows five sustain discharges which are labeled td1 through td5. Sustain pulses with amplitudes Vs are sequentially applied as shown in FIG. 6*b*.

Referring to the cell structures of FIG. 3, FIG. 5 and the waveforms of FIG. 6*b*, at tf1 the YSA sustain electrode falls and creates a discharge at td1 between the YSA sustain electrode and the address electrode XA. At time td1, all of the YSA sustain electrodes intersect trigger cells and initiate a trigger discharge with the address electrode similar to that shown in FIG. 5. Each trigger discharge initiated in a trigger cell generates a positive column that moves from the trigger cell along the address electrode to the state cell.

At time td1 all of the YSB sustain electrodes intersect state cells. Note, that at time td1 the wall voltage of the YSB electrodes rises even though there is no sustain pulse applied to the YSB sustain electrode. This is the action of the positive column extending from the trigger cell to the state cell that intersects with the YSB sustain electrode. The positive column discharge causes a change of the wall voltage of both the state cell and the trigger cell.

At time td2 there is another discharge that is initiated by the fall of sustain electrode YSB at time tf2. At this time all of the trigger cells intersect sustain electrode YSB and the resulting trigger discharge causes the positive column to extend to the state cell that intersects the electrode YSA. Note that the wall voltage on the state cell at electrode YSA rises at time td2 even though there is no sustain pulse at YSA during this time. This is the action of the positive column from the trigger cell causing a discharge with the state cell.

It is important to realize that a given physical cell has a designation of state cell or trigger cell that is different at times td1 and td2. Note that at time td1 the trigger cells are positioned between the address electrode and sustain electrode YSA, whereas at time td2 the trigger cells are positioned between the address electrode and sustain electrode YSB. Similarly at time td1, the state cells are positioned at sustain electrode YSB whereas, at time td2 the state cells are positioned at sustain electrode YSA. This alternation of the roles of the cells between state and trigger status occurs every half cycle of the sustain waveform. This alteration is a necessary condition for the successful sustaining of these subpixels.

The discharges at times td3, td4 and td5 operate in a way very similar to those described above for times td1 and td2.

Figure 5F:
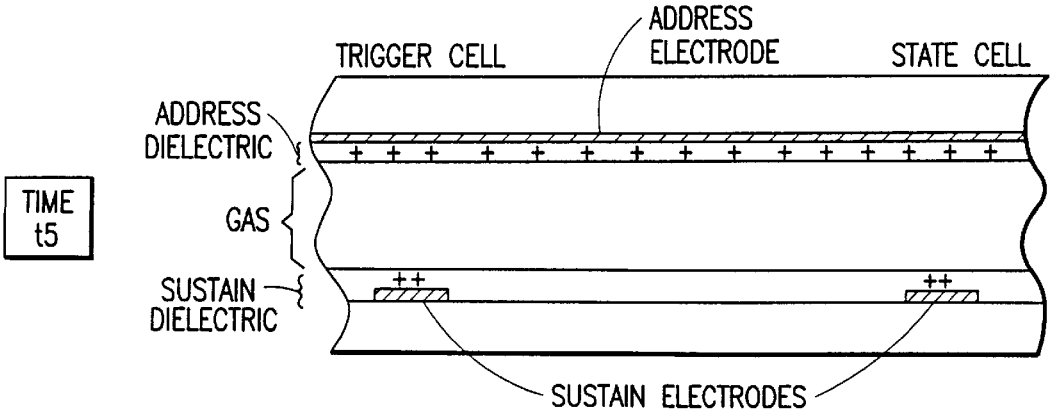

The showing in FIG. 5*f* of wall charge distribution at time t5 shows that at the end of the discharge, all of the dielectric surfaces are at the same potential due to the large number of charged particles generated during the discharge. After each discharge, the wall voltage adjusts to a level very close to the sustain voltage level. This of course means that the voltage across the substrate gap is near zero.

The important point is that after the ON state discharge, the voltages across the substrate gap at both the trigger cell and the state cell are nearly zero. Further, after an ON state discharge, all dielectric surfaces are at the same potential as shown in FIG. 5*f*.

Understanding the ON state wall charge distribution of the dielectric surfaces after the discharge is important because it forms the initial condition for the next discharge. Since the voltage across the substrate gap after the discharge is nearly zero, it is a good approximation to assume that any subsequent increase or decrease in applied sustain voltage will cause the amplitude of the sustain voltage change to be applied across the trigger cell or state cell substrate gap.

There are further aspects to be considered regarding the waveforms of FIG. 6*b*. Note that these waveforms are designed so that the trigger cell discharges are always initiated by a negative-going sustain voltage transition. This is important because it means that the cathode of the trigger cell discharge is always the dielectric surface that covers the sustain electrode and not the dielectric surface that covers the address electrode. These two surfaces usually have considerably different properties when used as cathodes.

For instance, in experimental subpixels that were measured, the initial discharge breakdown voltage, Vb−, when the trigger cell sustain voltage was the cathode, was measured to be approximately 200 volts, but the same cell breakdown voltage, Vb+, was measured to be approximately 300 volts when the address electrode was the cathode. This is because the sustain dielectric is usually coated with a high secondary emission material such as MgO and the address dielectric is coated with or is made entirely of some suitable phosphor material. The high secondary emission material such as MgO has a high gamma coefficient which means that it emits a high number of secondary electrons when it is bombarded with positive ions from a gas discharge. This gives the discharge a relatively low voltage characteristic which is desirable to reduce circuit costs and power dissipation in the negative glow region of the discharge.

The phosphor material that covers the address electrode is designed to efficiently convert ultraviolet light to visible light. The phosphor generally does not have a high secondary emission material, such as MgO, because such materials usually absorb the ultraviolet light generated by the gas discharge which would give the display poor luminous efficiency. It is important that the cathode of the trigger cell sustain discharge be the dielectric surface that covers the sustain electrodes and not the dielectric that covers the address electrodes. This is achieved by initiating the trigger cell discharge with the negative-going edge of the sustain pulses, as shown for all of the discharges in FIG. 6*b*.

Address Waveforms

Figure 9A:
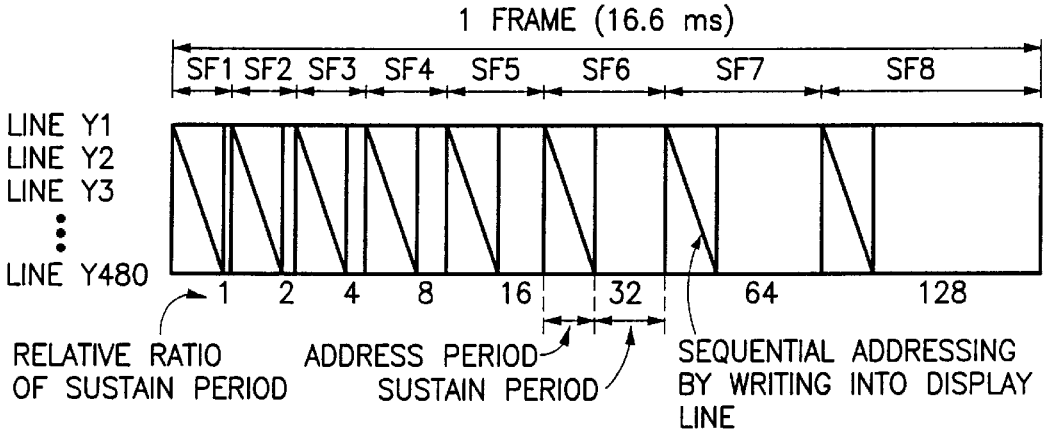
FIG.9a PRIOR ART
FIGS. 9*a* and 9*b* show prior art addressing and sustain waveforms.
Figure 9B:
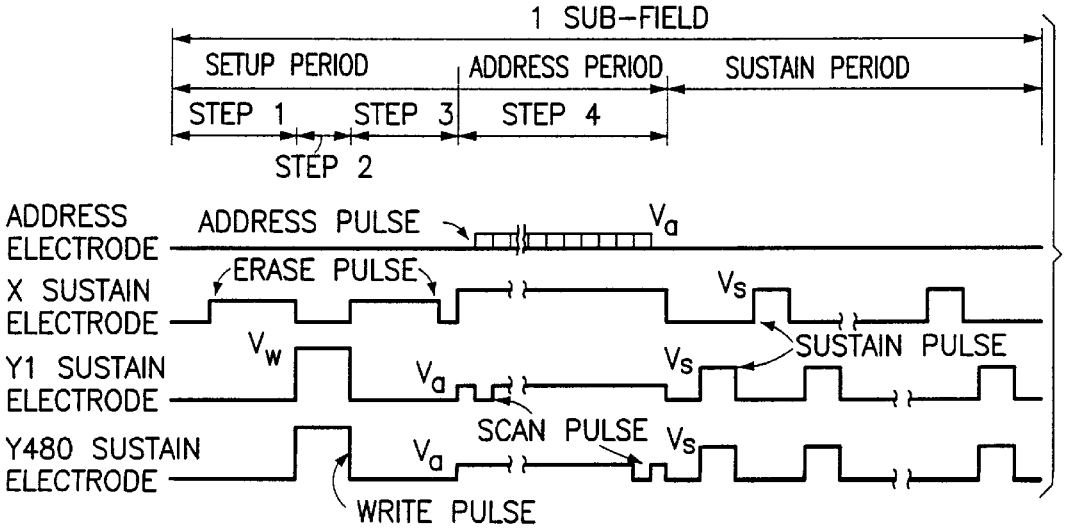
FIG.9b PRIOR ART

FIGS. 9*a* and 9*b* show prior art addressing and sustain waveforms from U.S. Pat. No. 5,746,086. In order to achieve gray scale in AC plasma displays that have inherent memory, the prior art breaks a frame time into multiple subfields, as shown in FIG. 9*a*. FIG. 9*b* shows that each subfield is broken into various periods. For the purpose of this discussion the FIG. 9*b* prior art steps 1, 2 and 3 will be called the setup period and the prior art step 4 will be called the address period. The last period will be called the sustain period. While this invention,in a preferred embodiment, employs such an addressing/sustain operation, the waveforms and their points of application differ markedly.

The setup period has the purpose of placing all of the subpixels in the panel in a well established wall voltage state that is appropriate for the proper operation of the address period. The setup period also serves to prime the subpixels in the OFF state so that the address period discharge will be well primed and will therefore occur properly. The address period has the purpose of changing the state of a subpixel if there are coincident address pulses on both the YSA electrode and the XA electrode that define the subpixel. The sustain period has the purpose of generating light from the subpixels that are in the ON state and not generating light from subpixels that are in the OFF state.

Figure 10:
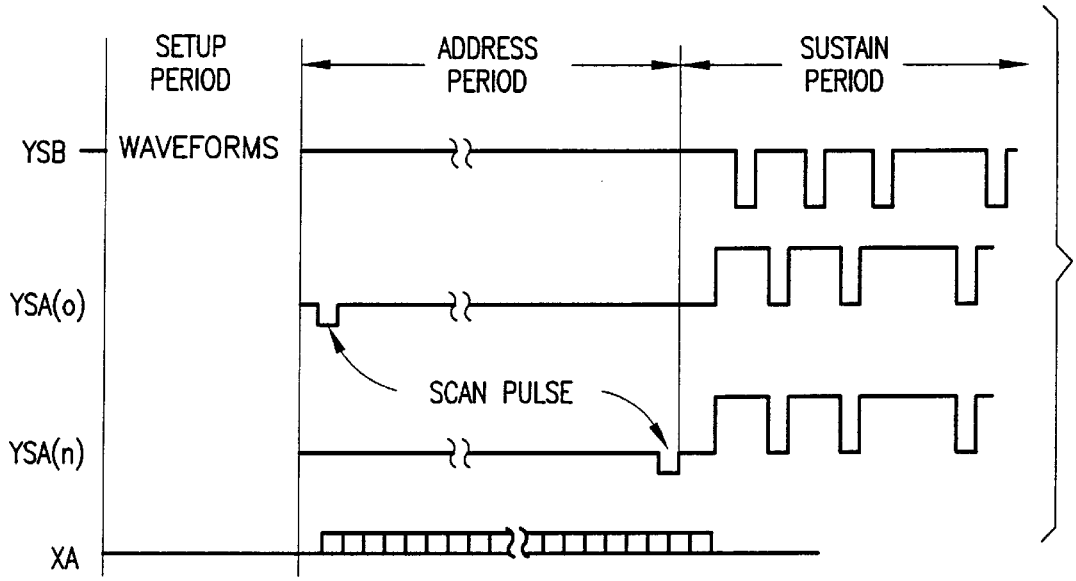
FIG. 10 shows a set of waveforms that have been found to be successful for addressing the subpixels using the principles of the invention.

FIG. 10 shows a set of waveforms that have been found to be successful for addressing the subpixels using the principles of the invention. These waveforms are designed to prime and then set all of the subpixels in the PDP to the OFF state during the setup period and to turn the selected subpixels to the ON state during the address period. A similar set of waveforms, not shown here, could be designed utilizing the principles taught in this invention that sets all of the subpixels in the panel to the ON state during the setup period and then turns the selected subpixels to the OFF state during the address period.

Details of the sustain period operation have been covered extensively above and are the same as presented in FIG. 6*b*. It is next appropriate to discuss the setup period. There are two types of waveforms that are used during the setup period and they are called the pulse setup waveforms and the ramp setup waveforms. The pulse setup waveforms will be presented first.

Pulse Type Setup Waveforms

Figure 11:
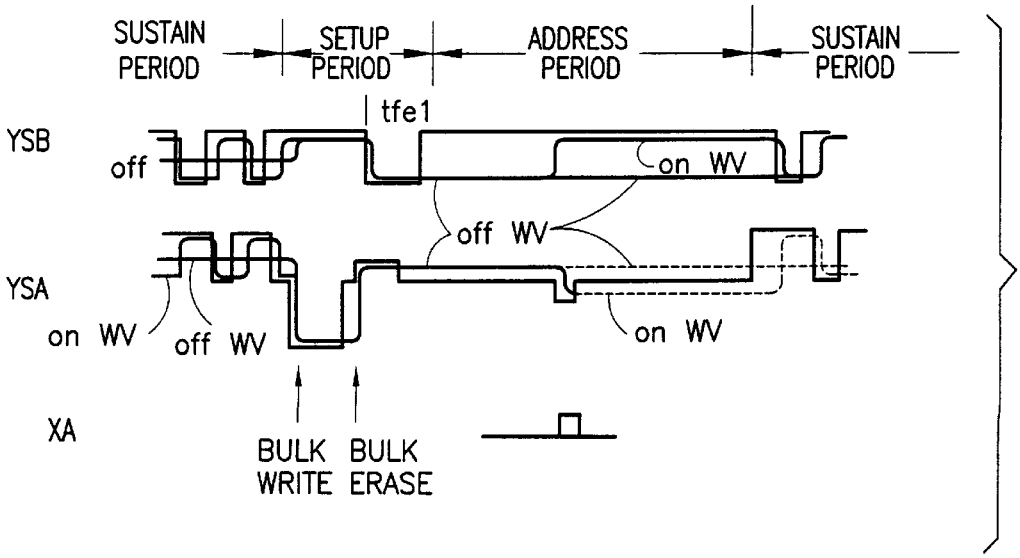
FIG. 11 shows details of pulse setup waveforms used with the invention.

FIG. 11 shows details of the pulse setup waveforms. These waveforms are divided into a bulk write and a bulk erase. The bulk write has the function of placing both the OFF cells and the ON cells into the ON state. After the bulk write pulse, all of the subpixels in the panel have one ON state set of wall voltages. All trigger cells in the panel have one well defined wall voltage and all state cells in the panel have another well defined wall voltage.

During the bulk erase waveform, all of the subpixels are placed in the OFF state so that there will be no discharge during the sustain period that follows the setup period, unless a selective write occurs during the address period. The bulk write is accomplished by placing such a large negative pulse on the YSA sustain electrodes that all of the trigger cells discharge regardless of whether the subpixel is initially either in the ON state or the OFF state. This large negative bulk write pulse causes the positive column to spread from each trigger cell to an adjoining state cell so that the voltage across the substrate gap of the state cell is reduced to zero and all of the state cells in the PDP are placed into the ON state.

Figure 12:
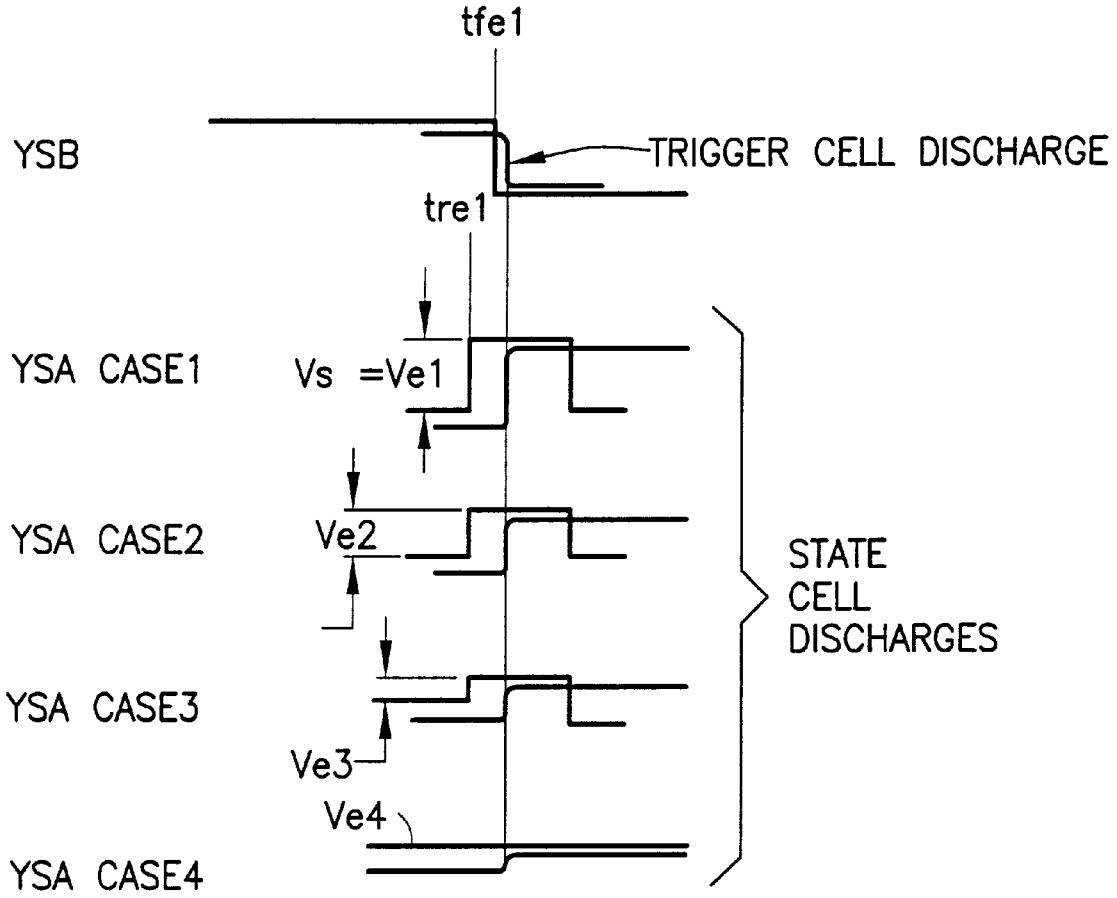
FIG. 12 shows a single erase pulse of possible amplitudes Ve1, Ve2, Ve3 or Ve4 that may be applied to the YSA sustain electrodes.

The bulk erase pulse is designed to place the bulk erase state cell at exactly the desired wall voltage level needed for proper selective addressing. FIG. 12 shows how this operates. At time tre1, a single erase pulse, of possible amplitudes Ve1, Ve2, Ve3 or Ve4, is applied to the YSA sustain electrodes. Note that FIG. 12 shows four different waveform rows, each having a different possible value of Ve.

At time tfe1, the YSB sustain voltage falls and causes a trigger discharge in the trigger cells. This happens in all of the trigger cells in the PDP since it is assumed that a bulk write placed all of the subpixels in the ON state just prior to time tre1. The positive column from all of the trigger cell discharges spread to all of the state cells and reduces the voltage across all of the state cell substrate gaps to zero. Because of this, each state cell wall voltage moves to a value nearly equal to the applied erase pulse amplitude of Ve1, Ve2, Ve3 or Ve4, as shown for each of the four cases in FIG. 12.

This novel property of the invention allows the wall voltage of a state cell to be conveniently set to any desired level in accord with the potential applied thereto, and is used in the addressing operation.

Note that Ve1 is the same pulse amplitude as a high level of the YSA sustain pulse which is at Vs volts. Setting the state cell wall voltage to Ve1 sets all of the state cells to the ON state. Note also that Ve4 is the same as the low level of the YSA sustain pulse. Setting the erase pulse to Ve4 sets all of the state cells to the OFF state. The Ve4 case of FIG. 12 initiates a trigger cell discharge when the state cell sustain voltage is at the low level which causes the trigger cell positive column to reduce the voltage across the state cell substrate gap to zero, thereby placing the state cell in the OFF state.

For proper selective addressing during the address period, it is likely that a wall voltage such as that shown for the Ve3 case of FIG. 12 is desired. This is intended to place the OFF state wall voltage somewhere in the allowed OFF state range. It is not important to discuss the exact wall voltage level at this point since Ve can be easily adjusted to any desired level that optimizes the selective addressing.

Note that prior art electrode dimensions do not allow a convenient exact establishment of the wall voltages as shown in FIG. 12. In the prior art, the erase pulse can cause a discharge that will change the wall voltage but the final value of wall voltage depends on the initial wall voltage value across the sustain gap and the intensity of the erase discharge. These two values are not known to any strong degree of certainty so that the prior art wall voltage after the discharge is also somewhat unknown.

However with the FIG. 12 technique, the final wall voltage is very closely equal to the value of Ve which is easily controlled. Note that it is the value of Ve that is applied to the state cell which, in FIG. 12, is at the YSA sustain electrode at time tfe1, and determines the final value of the wall voltage after the bulk erase operation. The exact value of the initial voltage across the trigger cell substrate gap does not determine the value of the final wall voltage of the state cell as long as the trigger cell substrate gap has enough initial voltage to initiate a proper trigger cell discharge that will extend its positive column to the state cell. The prior art erase discharge does not have this same independence.

Ramp Type Setup Waveforms

Figure 13:
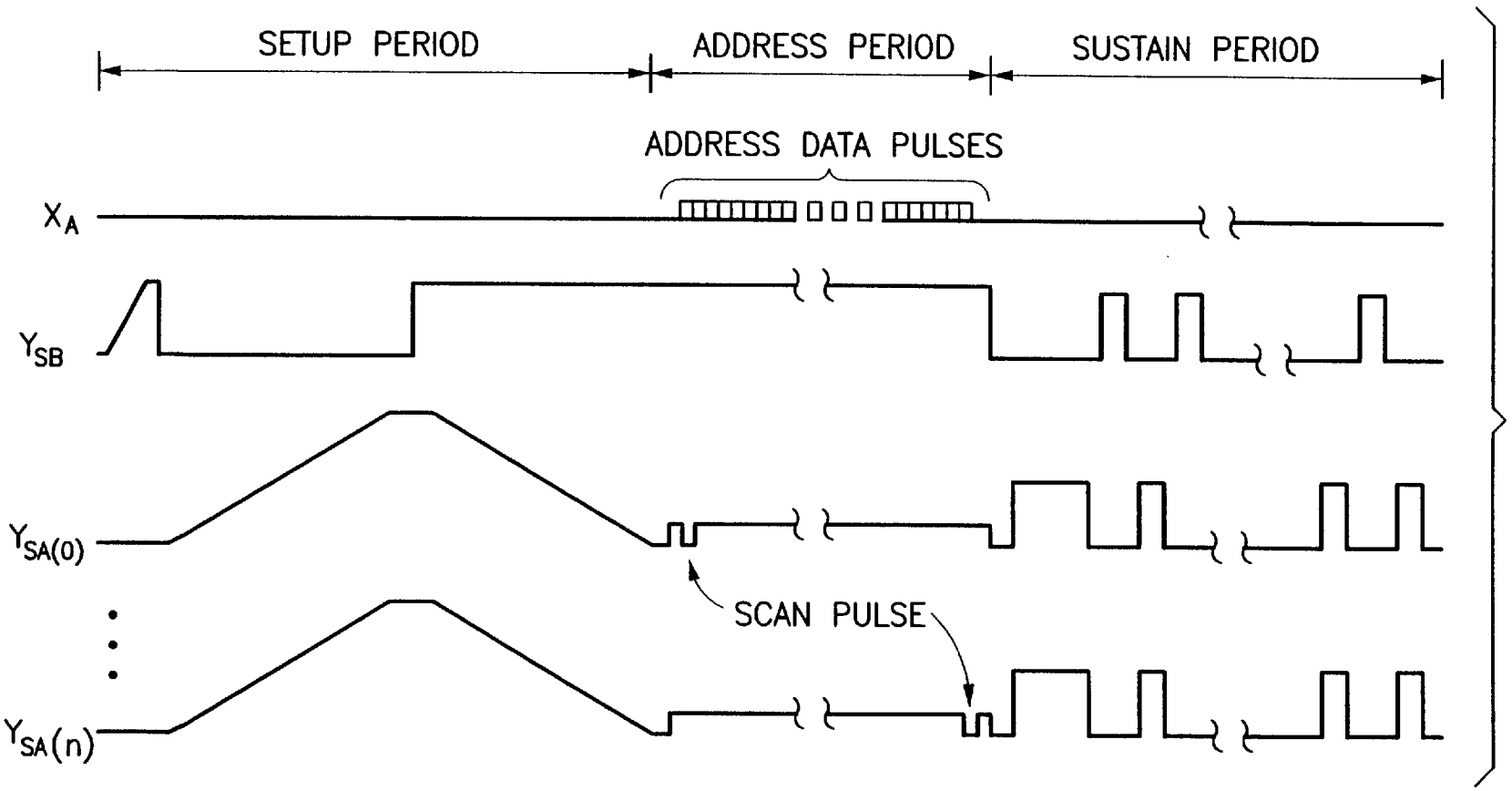
FIG. 13 illustrates prior art ramp setup waveforms.

Prior art ramp setup waveforms are shown in FIG. 13 (as taught in U.S. Pat. No. 5,745,086). In these waveforms, a slowly rising or falling ramp is used to cause a weak discharge in a gas that has a positive resistance characteristic. This allows the wall voltage to slowly follow the ramp and maintains the voltage across the gas very close to the breakdown voltage of the gas. The rising ramp of FIG. 13 serves the purpose of the bulk write which places both the ON and the OFF subpixels in a single well established wall voltage state.

The falling ramp of FIG. 13 serves the purpose of the bulk erase which places all of the subpixels in an off state with a well established wall voltage level. The advantage of the ramp setup waveforms of FIG. 13 over the pulse setup waveforms of FIGS. 11 and 12 is the significantly lower amount of light that the ramp setup waveforms generate compared to the pulse waveforms which allows the ramp waveforms to have a display with a significantly enhanced contrast, as described in the '086 patent. The advantage of the pulse setup waveforms of FIGS. 11 and 12 over the ramp waveforms of FIG. 13 is the reduced amount of time that the pulse setup waveforms take, compared to the ramp waveforms.

The prior art ramp waveform shown in FIG. 13 utilizes a positive resistance discharge between the YSA and the YSB sustain electrodes. During the rising ramp, the YSB sustain dielectric is the cathode, and during the falling ramp the YSA sustain dielectric is the cathode. These prior art waveforms will not work with the invention presented here. The positive resistance discharge utilized in the ramp waveforms requires that there be negligible electric field distortion in the discharge gap. If there is significant field distortion, then the familiar negative resistance characteristic discharge occurs and the ramp waveform causes an unstable sequence of discharges. Since the existence of a positive column represents a state of a very high level of field distortion, there can be no positive column discharge during the ramp, as a positive resistance discharge is required. Therefore, it is not possible to utilize the positive resistance ramp discharge with the fundamental discharge technique of this new invention, i.e., to initiate a discharge in a trigger cell that causes its positive column to extend to the state cell which changes the wall voltage of the state cell, and still achieve a positive resistance discharge on a ramp.

Since the positive resistance discharge of the ramp will not create any highly conductive positive column between the trigger cell and the state cell, it is reasonable to assume that the trigger cell and state cell discharges will be independent during the ramp.

It is necessary for the setup period waveforms to establish the wall voltages of both the trigger cell and the state cell to the OFF state range or else the subpixel can errantly turn ON during the sustain period, even without a selective address pulse during the address period. Because of the independence of the discharges during the ramp, it is sometimes desirable to apply the ramp waveforms to both the YSA and the YSB electrodes, as shown in the invention waveforms shown in FIG. 14.

Figure 14:
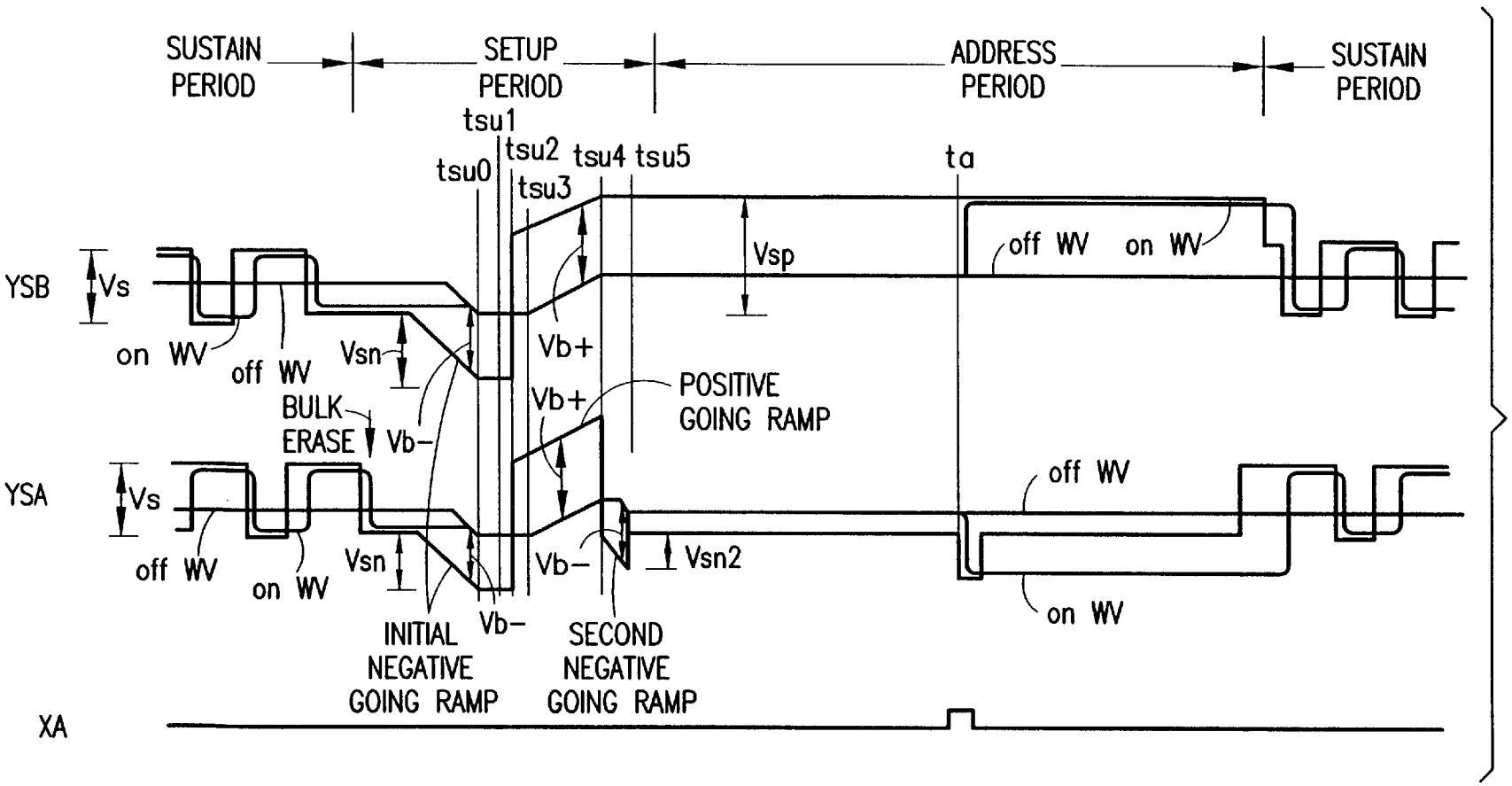
FIG. 14 illustrates a set of waveforms for operating the invention.

The first operation of the FIG. 14 setup period is the bulk erase which places all of the ON subpixels to the OFF state. This is accomplished with the same technique shown in FIG. 12 (case 4) whereby the positive column from the YSA trigger cell goes to the state cell while the YSB voltage is low. This places the wall voltages of both the trigger cells and the state cells to the level of the low sustain voltage. This bulk erase only causes a discharge in subpixels that were in the ON state during the sustain period. The subpixels that are OFF during the sustain period will have some unknown wall voltage.

For consistent addressing operation during the address period, it is desirable for the setup waveforms to place all cells at a fixed, well established OFF state wall voltage. The ramp waveforms of FIG. 14 accomplish this.

Note that the ramp waveforms shown in FIG. 14 are considerably different than those shown in FIG. 13. One major difference is that the initial ramp of FIG. 13 is positive-going and the initial ramp of FIG. 14 is negative-going. It is important for the initial ramp of this invention to be negative-going in order to achieve stable operation. This insures that the initial falling ramp discharge has the sustain electrode dielectric as the cathode and is necessary so that the high secondary emission surface (such as MgO) can create a stable discharge.

In order to understand why the MgO cathode has a more stable ramp discharge than the phosphor layer, it is necessary to discuss some details of the ramp discharge. In many respects the positive resistance discharge that occurs due to the ramp is similar to a constant current DC discharge. The constant current that passes through this positive resistance discharge is proportional to the ramp rate in volts per microsecond of the applied ramp. The discharge in the positive resistance mode adjusts itself so that the voltage across the substrate gap is exactly at the breakdown voltage of the discharge.

Recall that for the MgO cathode of the measured devices, this is approximately 200 volts and that for the measured phosphor cathodes, approximately 300 volts. If the substrate gap voltage is above the breakdown voltage, the discharge current will increase until enough charge builds up on the dielectric layers to reduce the voltage across the substrate gap back down to the breakdown voltage. If the substrate gap voltage is below the breakdown voltage, the discharge current decreases to a point where it does not discharge the capacitance of the dielectric layers at such a high rate and the changing ramp voltage placed on the external electrode causes the magnitude of the voltage across the substrate gap to increase until it reaches the breakdown voltage. Once the breakdown voltage is reached, the discharge attains a constant stable level with time, where the rate of increase of the ramp voltage is exactly balanced by the rate of increase of voltage across the dielectric layers.

Unfortunately, the above mentioned stable positive resistance discharge may not occur if there is insufficient priming of the discharge. With insufficient priming, the increasing ramp voltage may cause the voltage across the substrate gap to increase to considerably above the breakdown voltage before any discharge occurs. If this gap voltage rises to too a high of a level above the breakdown voltage, then when the low level of priming finally does allow the discharge to initiate, the current growth rate will be so high that significant space charge field distortion will occur so that a negative resistance discharge will occur. This will cause a very strong discharge that will reduce the substrate gap voltage to well below the breakdown voltage and will cause the discharge current to rapidly decay to a very low level. This pulsed type of discharge, caused by low priming, is not desirable for setup waveforms because it generates a high level of discharge light and it does not place the wall voltage at a well established constant level.

The final level of the wall voltage after a discharge in this low priming case is determined by many factors. It is somewhat random in nature since the strength of the discharge is determined by how high the continually increasing voltage across the substrate gap is above the breakdown voltage at the instant when the randomly accruing priming particles initiate the discharge.

A sufficiently high level of priming allows the discharge to initiate when the continually increasing applied ramp voltage places the substrate gap voltage just slightly above the breakdown voltage. Because the gap voltage is only slightly above the breakdown voltage, the rate of current rise does not cause space charge field distortion to set in before the charge builds up on the dielectric to reduce the substrate gap voltage back down to the breakdown voltage. This sufficiently high level of priming allows a stable positive resistance discharge to occur that is very suitable for the setup operation because it produces a low level of light and it places the wall voltage at a well established constant level.

Because of the importance of priming to the stability of the ramp discharge, it is necessary to discuss the mechanisms of priming. There are basically two sources of priming. The first one is active particles in the gas such as electrons, ions and metastable atoms that exist for some period after a gas discharge. The second priming source is the cathode surfaces which may emit electrons for some significant period after the discharge. Both of these priming sources start the discharge by generating free electrons in the gas that can be accelerated by the electric field to create ionizing avalanches. It is frequently only necessary to generate one free electron to initiate a discharge.

The two sources of priming have considerably different intensities and production rates. The first source has generally higher priming intensity, but it generally lasts for a shorter period than the second source. The decay of the first source occurs because the electric field in the gas causes the free electrons and ions in the gas to drift to the walls where the electrons are captured and the ions are neutralized to become simple gas atoms. The metastable atoms slowly diffuse to the walls where they are de-excited to become simple gas atoms.

The rate of priming decay for these processes depends on many factors, such as gas type, gas mixture, gas pressure, discharge cell dimensions and applied voltage. For measured discharge conditions, all of the first source particles were generally observed to decay within 25 to 50 microseconds.

The second priming source can decay much more slowly. The physical mechanism whereby electrons are emitted from solid surfaces for some period after some exciting radiation event, such as a gas discharge, is called exoemission. The mechanism for exoemission is complicated and is not well understood. However it has been shown to be very strongly dependent on the cathode material. MgO has been found to have good exoemission and can emit electrons for many milliseconds after a gas discharge. Alternatively, the phosphor layer that covers the address electrodes has been found to have very poor exoemission.

The FIG. 14 waveforms for the setup period have an initial negative-going ramp which is of different polarity than the positive-going ramp of FIG. 13. This negative-going ramp is necessary to insure that the MgO surface of the sustain electrode is the cathode which allows the good exoemission to properly prime the negative-going ramp discharge and insure a stable positive resistance discharge. (If the setup period was to initially use a positively going ramp then the phosphor surface that covers the address electrode will be the cathode which because of its poor exoemission will not properly prime the positive going ramp discharge and therefore allow a highly unstable negative resistance type of discharge to occur during the ramp).

Because there are two rather different priming sources, positive or negative-going ramps may have stable discharges as long as at least one of the priming sources provides sufficient priming. For instance a positively or negatively going ramp will provide a stable positive resistance discharge if a discharge has occurred shortly before the ramp so that the first priming source due to priming particles in the gas can cause sufficient priming.

In the experimental devices measured, both positive and negative-going ramps gave a stable positive resistance discharge by means of the first priming source, as long as the ramp discharge was initiated within approximately 25 to 50 microseconds of a normal sustain discharge. However for times considerably longer than 50 microseconds, only the second priming mechanism was present and so only the negative going ramp which utilizes the exoemission from the MgO, yielded a stable positive resistance discharge.

It is straightforward to design waveforms that utilize the first priming source to stabilize the ramp discharge when the subpixels are initially in the ON state. This is because the ramp can be designed to occur very shortly after the last ON state sustain discharge so that there will be less than 25 to 50 microseconds between the positive resistance discharge and the last on state sustain discharge. However, it is much more difficult to use the first priming source to stabilize the ramp discharge for a subpixel that is initially in the OFF state. This is because for the subfield addressing technique shown in FIGS. 9*a* and 9*b*, the OFF subpixels will not have discharged since the setup period of the previous subfield. Since a subfield is typically one to two milliseconds long, the first priming source particles will have fully decayed and will not be available as a priming source.

Figure 1:
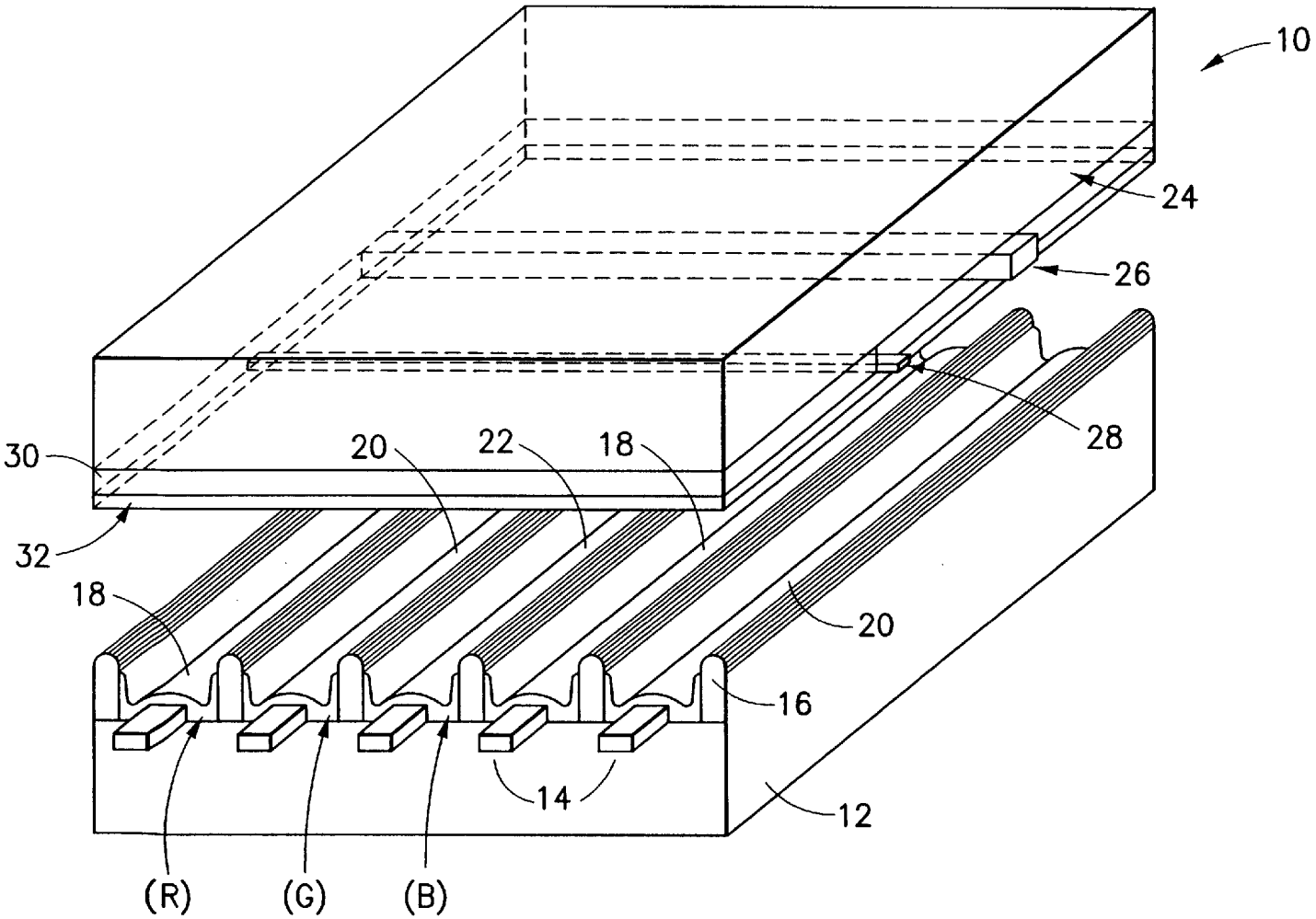
FIG. 1 PRIOR ART
FIG. 1 shows a prior art color AC PDP.
Figure 2B:
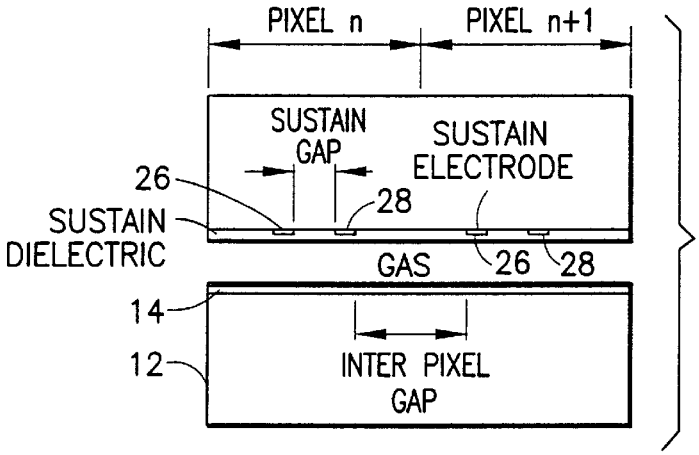
FIG.2b PRIOR ART
FIG. 2*b* shows a second sectional view of the AC PDP of FIG. 1.
Figure 2C:
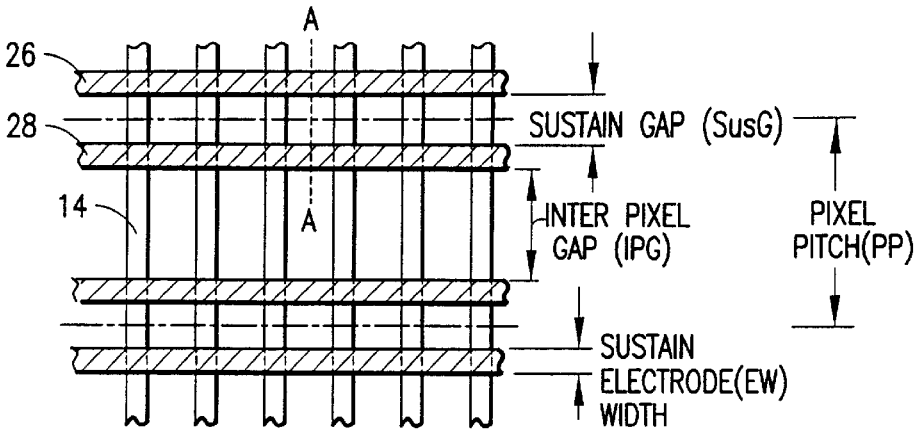
FIG.2c PRIOR ART
FIG. 2*c* shows a schematic plan view of the AC PDP of FIG. 1.

This leaves only the second priming source of exoemission from the cathode surfaces as a candidate for priming subpixels that are initially in the OFF state. Since the ramp discharges of the setup period must work for both subpixels in the ON state and the OFF state, only the exoemission priming source can reliably be used for the first ramp type setup waveform pulse. Also since for the plasma panel structures used in FIGS. 1 and 2, the phosphor layer coats the address electrode and the MgO surface covers the dielectric of the sustain electrodes, an initially negatively going setup period ramp is necessary to utilize the high exoemission of the MgO surface to prime and to achieve a stable positive resistance discharge for both subpixels initially in the ON and the OFF states.

The requirement that the initial ramp of the setup period be negative going is necessary for the invention disclosed here, but is not always necessary for prior art designs. The reason is that for most prior art designs the application of the ramp causes a discharge across the sustain gap, whereas for the invention, the application of the ramp causes a discharge across the substrate gap. Since both of the electrodes that bound the sustain gap are sustain electrodes, a prior art sustain gap discharge will have MgO as a cathode for both a positive going ramp and a negative going ramp. Thus, the prior art setup discharge can have a positive going or a negative going ramp and still utilize the exoemission priming to cause a stable positive resistance discharge. In this invention, the large size of the sustain gap compared to the substrate gap makes the substrate gap discharge occur first at a considerably lower voltage so that only ramp discharges across the substrate gap are practical.

Since the substrate gap has one cathode of MgO and the other cathode of phosphor material, it is critical for the initial setup discharge of the invention to be negative-going in order to have a stable positive resistance discharge.

Note in FIG. 14 that an initial negative going ramp is applied to both the YSA and the YSB sustain electrodes in order to establish well defined wall voltages for both the trigger cells and the state cells that are initially in either the ON or the OFF states. This initial negative-going ramp needs to go sufficiently negative to cause stable positive resistance discharges that place both the initially ON subpixels and the initially OFF subpixels in the same wall voltage state, at time tsu1 of the setup period, for both the state cells and the trigger cells.

The maximum negative excursion voltage of the ramp, Vsn is adjusted to approximately 200 volts for the INV design of Table 1. This is consistent with the measured 200 volt breakdown voltage Vb− of the substrate gap when the MgO is the cathode. If this Vsn voltage is increased above 200 volts, there is no adverse addressing effect other than an increase of the undesirable background glow of the OFF subpixels. If this Vsn voltage is reduced in magnitude below the 200 volt level, then the wall voltage levels of the ON and OFF states will not be at the same level at time tsu1.

The initial negative going ramp in FIG. 14 causes an appropriate priming discharge that places all of the cells at a well established wall voltage level at time tsu1. However there are some additional requirements for the setup period to function satisfactorily. One of these requirements is that subpixels that remain OFF for multiple successive subfields must always discharge during the setup period or else they will not be properly primed during the address period. Since OFF subpixels do not generally discharge during the address period or the sustain period, it is common that the wall voltage of OFF subpixels at the end of one setup period will be the same wall voltage for the beginning of the next subfield setup period.

The initial negative going ramp of FIG. 14 causes a positive resistance discharge of the OFF subpixels that, in turn, causes their wall voltages to decrease as shown in FIG. 14. It is necessary for there to be a positive going ramp, after the initial negative going ramp, in order to raise the wall voltage back in the positive direction so that the condition stated above of having the OFF subpixel wall voltage at the end of the setup period be the same as that at the beginning of the setup period. If there were no further pulses during the setup period after the initial negative going ramp, the decreased wall voltage level at the end of the setup period would prevent discharges from occurring in following setup periods because the initial negative going pulse would not put a voltage greater than the breakdown voltage across the substrate gaps of the cells. This condition would not provide the necessary setup period priming.

The requirement for a positive going ramp discharge introduces the problem of how to achieve a stable positive resistance discharge during the positive going ramp. As discussed above, positive going ramps applied to the sustain electrodes of the invention cannot rely on exoemission priming from the cathode surfaces because the phosphor surface cathode has negligible exoemission. Fortunately it is possible to use the priming particles in the gas gap that were generated by the discharge from the initial negative going ramp. Because these electrons, ions and metastable atoms decay at a rapid rate it is critical that the positive resistance discharge of the positive-going ramp start at time tsu3, within some minimum time after the end of the initial negative going ramp discharge at time tsu0.

For the experimental INV PDP, this minimum time was found to be approximately 25 to 50 microseconds. If the setup ramps were adjusted to stay within this minimum time then the positive going ramp discharge was found to be very stable and reliable.

At time tsu2 in FIG. 14, there is a large transition from the end of the initial negative going ramp pulse to the start of the positive going ramp. It is desirable that this large tsu2 transition have a change in voltage slightly less than the sum of the breakdown voltage Vb− of the substrate gap when the sustain dielectric is the cathode and the breakdown voltage Vb+ of the substrate gap when the address dielectric is the cathode.

In the INV design, the breakdown voltage Vb− is about 200 volts and the breakdown voltage Vb+ is about 300 volts. Thus the tsu2 transition should be slightly less than 500 volts. An appropriate value for this design is 450 volts. This tsu2 transition voltage is carefully chosen in order to reduce the time difference between the end of the initial negative going ramp discharge at time tsu0 and the start of the positive going ramp discharge at time tsu3. If the voltage across the substrate gap at time tsu1 is Vb− volts, then a transition at time tsu2 of Vb− volts plus Vb+ volts will place a voltage of Vb+ volts across the substrate gap. This will be exactly the voltage necessary to initiate a stable positive resistance discharge for the positive going ramp. If the tsu2 transition voltage is less than Vb− volts plus Vb+ volts, then the positive going ramp voltage will have to increase some amount after time tsu2 before the Vb+ breakdown voltage will be achieved, so that the positive resistance discharge can start at time tsu3. This may be acceptable as long as the time difference between tsu0 and tsu3 is not too long so that the substrate gap priming particles generated during the initial negative going ramp do not decay before time tsu3.

If the tsu2 transition voltage is larger than Vb− volts plus Vb+ volts, then the substrate gap voltage just after time tsu2 will be above the Vb+ breakdown voltage. Thus, the discharge will perhaps be stronger than that desired for a stable positive resistance discharge during the positive going ramp. This may cause an unstable negative resistance discharge which is undesirable for a low luminance stable setup discharge. Because the exact values of the Vb− and the Vb+ voltages may vary from one subpixel to the next for the many subpixels in a PDP, it is desirable to appropriately reduce the tsu2 transition voltage so that it is always less than the lowest value of the sum Vb− plus Vb+ that may occur for any substrate gap cells in the panel. This is why 450 volts was chosen for the experimental INV design.

The FIG. 14 setup waveforms are very similar for both the YSA and the YSB sustain electrodes during the initial negative going ramp and the sustain transition at time tsu2. However for the remainder of the setup period after time tsu2, the two sustain electrode waveforms are different because of differing requirements of the trigger and state cells. During the address period, the cell between the address electrode and the YSA sustain electrode is the trigger cell and the cell between the address electrode and the YSB sustain electrode is the state cell. Therefore the setup period YSA waveform sets up the trigger cell and the setup period YSB waveform sets up the state cell.

The setup period waveforms need to set the trigger cell wall voltages to a stable, well established level so that during the address period, a low voltage level on the XA electrode that intersects a YSA address pulse-selected subpixel will leave that subpixel in the OFF state and a high voltage level on the XA electrode will cause the selected subpixel to switch to the ON state. The requirement to remain in the OFF state is met by placing the YSA wall voltage, at time tsu5, at a level within the range of OFF state wall voltages. This is accomplished by adjusting the peak level of the positive going ramp at time tsu4 and the second negative going ramp at time tsu5.

The second negative going ramp performs the same fundamental function as the negative going ramp shown in FIG. 13. The second negative going ramp causes a stable positive resistance discharge at the Vb− breakdown voltage of the trigger cell substrate gap so that the peak negative excursion voltage Vsn2 of the second negative-going ramp plus the Vb− breakdown determines the OFF state wall voltage at time tsu5. If there is no discharge activity during the address period or the sustain period, then the OFF state wall voltage level established at time tsu5 remains during the address period and the sustain period.

The state cell wall voltage has differing requirements from the trigger cell. Note that there is no second negative-going ramp for the YSB sustain waveform which intersects with the state cell during the ramp parts of the setup period. Instead the YSB positive-going ramp simply rises from the transition at time tsu2 to the voltage level Vsp at time tsu4. YSB remains at voltage level Vsp after time tsu4 and also for the entire address period.

One effect of this YSB positive going ramp waveform is to place the Vb+ breakdown voltage across the substrate gap of the state cell. The amplitude of Vsp is adjusted to place the wall voltage at time tsu4 at a level within the range of OFF state wall voltages. This is because the state cell wall voltage at time tsu4 is equal to Vsp minus Vb+. The state cell positive-going ramp applied to the YSB waveform gives a stable positive resistance discharge as long as there is sufficient priming from particles in the substrate gap generated from the initial negative going ramp. This works properly, as discussed above, if the time difference between tsu3 and tsu0 is less than the priming particle decay time.

There is a further requirement for setting the wall voltage of the state cell at time tsu4. To explain this, details of the address discharge will be described. The address discharge happens for a selected subpixel at time ta in FIG. 14. This occurs when the combination of (i) the OFF state wall voltage of the trigger cell, (ii) the negative going scan pulse applied to the selected YSA sustain electrode and (iii) the high voltage level of the intersecting XA address electrode, initiate a strong discharge in the trigger cell and cause its positive column to extend along the sustain gap to the state cell. There, the positive column reduces the voltage across the substrate gap of the state cell to near zero. This has the effect of placing the state cell in the ON state so that the subpixel will emit light during the sustain period. This means that the address discharge at time ta operates in a similar fashion to the sustain discharge shown in FIG. 5.

For this addressing action to operate properly, it is necessary for the positive column of the trigger cell to extend across the sustain gap (via the address electrode) to the state cell. While this works reliably for the sustain discharges, it does not necessarily always work for the address discharges when ramp-type setup waveforms are used, unless certain conditions are met.

If the wrong wall voltage conditions exist, then the positive column will not extend from the trigger cell to the state cell during address time ta, even though there is a very strong discharge across the trigger cell substrate gap. Without this extension of the positive column from the trigger cell discharge to the state cell during the time ta address discharge, the subpixel will not be in the ON state when the sustain period occurs and so it will errantly not emit the desired light.

To understand how this errant wall voltage condition can exist it is necessary to discuss the possible wall voltage conditions when ramp waveforms are used. A fundamental principle of the positive resistance discharge obtained from the ramp waveforms is that during the stable discharge, the breakdown voltage is maintained across the discharge gap. This places the wall voltage at a well established level that can easily be controlled by the amplitude of the ramp waveform. Since this is necessarily a positive resistance discharge, there can be no significant electric field distortion due to space charge in the discharge gap. This, of course, precludes the presence of a positive column since all positive columns have a very high degree of space charge field distortion.

This means that the ramp-generated positive resistance discharge of the trigger cell operates independently of the ramp generated positive resistance discharge of the state cell, since there can be no positive column to couple the trigger cell and the state cell. Thus, even though the positive resistance discharges of the trigger cell and the state cell place their wall voltages at a well established level across their respective substrate gaps, there is still significant freedom for there to be a large difference in wall voltage between the trigger cell and the state cell.

All of the wall voltages shown in the Figs. illustrate the wall voltage component as would be measured across the substrate gap. The ramp waveform-generated positive resistance discharges can easily control the wall voltage measured across the substrate gap of this invention. However the positive resistance discharges will not necessarily control the wall voltage measured across the sustain gap to a well established level because of the independence of the positive resistance discharges of the trigger cell and the state cell.

The distribution of wall voltage across the sustain gap is important for determining if the trigger cell discharge positive column will emanate from the trigger cell to the state cell during the address discharge of FIG. 14. A reason why the trigger cell positive column of the sustain discharge shown in FIG. 5 moves to the state cell is that the electrons from the leading edge of the expanding positive column (e.g., FIG. 5, times t1 and t2) find a surface along the address electrode which has a positive potential relative to the positive column in a direction away from the trigger cell.

These leading edge positive column electrons rapidly move to this positive potential region and thereby cause a further expansion of the positive column.

If the charge along the address electrode produces a negative potential relative to the positive column, then the leading edge electrons do not move out of the positive column and only the much slower positive ions come out of the leading edge of the positive column. This negative potential condition will inhibit the movement from the trigger cell to the state cell.

Fortunately the sustain discharge sequence does not allow such a negative potential condition to exist along the address electrode. This is because the potential along the address electrode is established at a nearly uniform potential all along the sustain gap (because the voltage across the gas gaps is virtually reduced to zero after the strong sustain discharge). This nearly uniform address electrode wall potential condition at the end of one sustain discharge becomes, of course, the initial address electrode wall potential condition for the next sustain discharge as shown in FIG. 5*a*.

The negative-going trigger cell sustain electrode that initiates the sustain trigger cell discharge, causes the trigger discharge positive column leading edge potential to be negative relative to the nearly uniform address dielectric potential of FIG. 5*a*. Thus, the sustain trigger cell positive column will always find an address dielectric potential region that has a more positive potential in the direction away from the trigger cell. This potential condition will always allow the sustain discharge trigger discharge positive column to readily extend to the state cell.

Examining now the situation for the address operation setup by ramp waveforms, it is necessary to take measures to aid the movement of the positive column from the trigger cell to the state cell during the selective address discharge. This is accomplished, in part, in FIG. 14 by the action of the positive going ramp on the state cell sustain electrode YSB, between the times tsu2 and tsu4. The peak amplitude Vsp of this positive going ramp is adjusted so that the state cell address dielectric has a sufficiently positive potential to attract the positive column from the addressed discharge trigger cell.

In addition, a second negative-going pulse on the YSA electrode between times tsu4 and tsu5 acts to move the trigger cell dielectric potentials sufficiently negative so that during the selective address discharge at time ta, the potential of the leading edge of the positive column is sufficiently negative relative to the state cell dielectric potential that the trigger cell positive column readily moves to the state cell.

It has been found that if the value of Vsp is not sufficiently positive and the value of Vsn2 is not sufficiently negative, then a reliable selective address operation possibly will not occur even though there is a strong trigger cell discharge, because the selective address trigger cell discharge positive column does not reliably move to the state cell.

It has also been found that under some conditions it is possible to achieve reliable addressing at time ta without using the YSB initial negative-going ramp or the YSB positive-going ramp. This is partially because the YSB electrode intersects the state cell during the setup period and the address period. Since there is no requirement for priming of the address period state cell, there is no need for a priming discharge in the cell that intersects the YSB electrode during the setup phase. Thus, the YSB initial negative-going ramp or the YSB positive-going ramp might not be needed in all cases, as long as wall voltage conditions allow the positive column to freely move from the trigger cell to the state cell during the address discharge at time ta.

Address Period Waveforms

The waveforms for the selective address discharge are shown in FIGS. 10, 11 and 14. The fundamental principle of the selective addressing operation is somewhat similar to that used in the sustain operation. Simply stated, a discharge initiated in a trigger cell causes a positive column to move to the state cell and thereby change the state of the subpixel. In this case the trigger cell intersects the YSA sustain electrode and the state cell intersects the YSB sustain electrode. The major difference is that the determination of the occurrence of the discharge of the trigger cell, during selective addressing, does not depend on its initial wall voltage since the properly adjusted setup waveforms will have established all of the trigger cell wall voltages at a fixed level somewhere within the allowed OFF state range. This insures that if there is no address discharge during the address period that the subpixel will be in the OFF state when the sustain period is initiated.

The trigger discharge of the selective address operation is initiated by a coincidence of the negative going scan pulse that is sequentially applied to each YSA electrode (in the normal sequential scan method) and a positive going address pulse on the XA address electrode.

When the scan pulse is applied to a given YSA electrode as a negative-going pulse, a given subpixel will have a trigger cell discharge or not depending on the voltage level of the intersecting XA address electrode. If the XA address electrode pulse is low, there will be no trigger cell discharge and the state of the subpixel will not change during the address period. Accordingly, the subpixel remains in the OFF state and does not discharge during the sustain period.

If the XA address electrode voltage is high during the negative-going YSA pulse, the trigger cell of the selected subpixel discharges. The discharge causes the positive column to extend from the trigger cell to the state cell and thereby places the state cell wall voltage to the ON state as shown in FIG. 10, 11, and 14.

At the initiation of the sustain period, the ON state subpixel discharges and emits the desired amount of light during the sustain period.

The above addressing operation requires the following conditions. First, all the setup period waveforms must set the wall voltages of all of the trigger cells and the state cells to a level somewhere within the OFF cell wall voltage range. This assures that a subpixel that is not selectively written during the address period does not begin to discharge in the ON state during the following sustain period. Second, the OFF state wall voltage of the trigger cell should be placed at a well established level in order to minimize the amplitude of the address pulses applied to the XA and the YSA electrodes.

Matrix addressing requires one address driver circuit for each electrode in a matrix display and usually means thousands of address circuits in a typical television or computer monitor display. In order to reduce the cost of the display system it is desirable to reduce the voltage amplitude of the address pulses. If the trigger cell wall voltage is properly established during the setup period, then minimum level address pulses are possible.

It is most desirable to minimize the voltage on the XA address electrode circuit drivers since these are usually the most numerous. For instance in a 640×480 VGA color display, there are 1920 XA address electrode drivers and only 480 YSA scan electrode address drivers. The voltage on the XA electrodes can be minimized by properly adjusting the trigger cell wall voltage during the setup period and the low voltage level of the negative-going YSA scan pulse.

These adjustments assure that, while the XA pulse is at its low voltage level, the sum of the trigger cell wall voltage and the YSA scan pulse places a voltage across the trigger cell substrate gap that is just below a threshold level that will cause the trigger cell to have a strong enough discharge that a positive column will emanate from the trigger cell and change the wall voltage state of the state cell. If this condition is met then only a relatively low positive going pulse is needed on the XA address electrode in order to increase the voltage across the substrate gap of the trigger cell well above the threshold that will place the selected subpixel in the ON state.

Note that the polarity of the YSA scan pulses and the XA address pulses is such that, during the address period trigger cell discharge, the YSA sustain electrode is the cathode and insures that the high secondary emission surface (such as MgO) will be a cathode that makes the trigger discharge the lowest possible voltage.

The amplitude of the negative-going YSA scan pulse determines the OFF voltage of the trigger discharge. When a trigger cell has the high level voltage of the YSA scan pulse applied, then for proper address operation there should be no significant discharge activity in the trigger cell for both the high and low voltage levels of the XA address pulse. This means that if the minimum level XA address pulses are used, then the magnitude of the YSA scan pulse voltage should be equal to or greater than the XA address pulse amplitude so that half selection errors will not occur. These errors may occur if smaller magnitude YSA pulses are used and so that subpixels with the high level of YSA (nonselected) and the high level of XA (selected) will have a voltage across the trigger cell sustain gap that is above the threshold for changing the state of the subpixel. It is desirable to make the YSA pulse voltage significantly greater than this minimum in order to have an appropriate safety factor for variations in panel manufacturing dimensions.

Electrode Connections

One issue that remains to be discussed is the solution to the problem that arises because the inter-pixel gap of the invention is considerably smaller than the sustain gap, as illustrated by the ratio of 1.67 of SusG/IPG for the INV design of Table 1. As discussed above, such a high SusG/IPG ratio would cause the prior art designs to misfire because the electric field in the inter pixel gap would be greater than the electric field of the sustain gap.

This problem is overcome by the invention by means of the special sustain electrode connection technique shown in FIG. 3. The sustain electrodes of the panel front plate are drawn along the horizontal direction. Note that the sustain gap shown is considerably larger than the inter pixel gap. A key feature of this design is the assignment of the YSA and YSB electrodes. Note that the YSA electrodes are grouped as two adjacent electrodes and that the YSB electrodes are also grouped as two adjacent electrodes. This means that the fundamental repeating sequence of electrodes is two YSA electrodes followed by two YSB electrodes.

This is considerably different from the prior art design wherein the YSA and YSB electrodes were alternated. The fundamental repeating sequence of the prior art designs is one YSA electrode followed by one YSB electrode. In the prior art design, one subpixel had one YSA electrode and one YSB electrode.

FIG. 3 shows four subpixels, i.e., subpixels 1, 2, 3 and 4. The X-dimension boundaries of these subpixels are defined by barrier ribs 54. The Y dimension boundaries are arbitrarily defined as the mid-points of the inter pixel gap. Note that adjacent YSB electrodes are shorted at both sides of the panel and form a continuous loop. Note also that all YSB electrodes are connected directly to YSB bus electrode 66. Since all of the YSB sustain electrodes are connected to common bus electrode 66, the continuous loop has the advantage that if a loop has a manufacturing defect of a single open then it will not cause a perceived open line in the panel since the broken line has a conduction path from both the left and the right end of the open point to connect to the YSB bus electrode. This double conduction path redundancy increases panel yield without any other cost penalties.

The YSA electrodes connect to interconnect pads on the right side of FIG. 3. This allows scan address driver 70 to be connected to the panel. These YSA electrodes cannot be looped, because the addressing operation requires that adjacent YSA electrodes have differing potentials.

The major problem of the prior art that prevents the inter pixel gap from being less than the sustain gap is resolved by the PDP design of FIG. 3 by insuring that during the sustain operation, there is no electric field across the inter pixel gap. Since for a given time during the sustain period, all of the YSA electrodes are at the same potential and all YSB electrodes are at a same potential (that is frequently different than the YSA potential), there is no potential difference across the inter pixel gaps. This is because each such gap is bounded by either a pair of YSA electrodes or a pair of YSB electrodes. Of course, the sustain gaps are all bounded by one YSA electrode and one YSB electrode so that during the sustain operation, the waveforms of FIG. 6*b* can be applied for a successful sustain operation according to the principles of this invention.

If the FIG. 6*b* waveforms are applied to a PDP having the front panel electrodes of FIG. 3, then during the discharge at time td1, the cells that are defined by the YSA electrodes will be trigger cells and those defined by the YSB electrodes will be state cells. This means that in FIG. 3, subpixel 1 will have its lower cell, at YSA1, as the trigger cell and subpixel 1 will have its upper cell, at YSB1, as the state cell. Subpixel 2 has a reverse arrangement at time td1 with its upper cell, at YSA2, being the trigger cell and its lower cell, at YSB2, being the state cell.

Because of this reverse arrangement, during a sustain discharge at time td1, the positive column of subpixel 1 moves from the lower part of the subpixel to the upper part at the same time as the positive column from a discharging subpixel 2 moves from the upper part of the subpixel to the lower part of the subpixel. In fact, at time td1, all odd number subpixels that are in the ON state will have positive columns moving from lower to upper and all even numbered subpixels that are in the ON state will have positive columns moving from upper to lower.

At time td2, when all YSB electrodes define trigger cells and all YSA electrodes define state cells, all the positive column directions are reversed.

The addressing operations also work well with the FIG. 3 PDP arrangement. For instance subpixel 2 is selectively addressed by placing a negative going scan pulse on YSA2 at the same time as the positive going address pulse is applied to the XA address electrode that intersects subpixel 2. This causes the trigger cell, that intersects sustain electrode YSA2, to discharge and send its positive column to the state cell that intersects sustain electrode YSB2. All other subpixels in the panel can be similarly selectively addressed.

Experimental Measurements

Figure 15A:
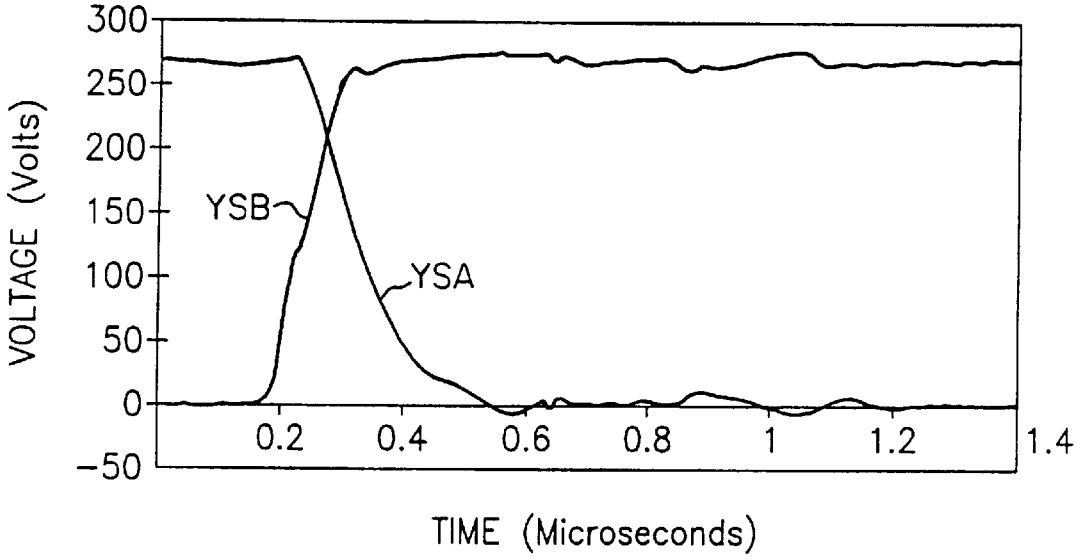
FIGS. 15*a*–15*c* show actual measured sustain voltages and currents for the address electrode, the trigger cell sustain electrode and the state cell sustain electrode in a PDP incorporating the invention hereof.
Figure 15B:
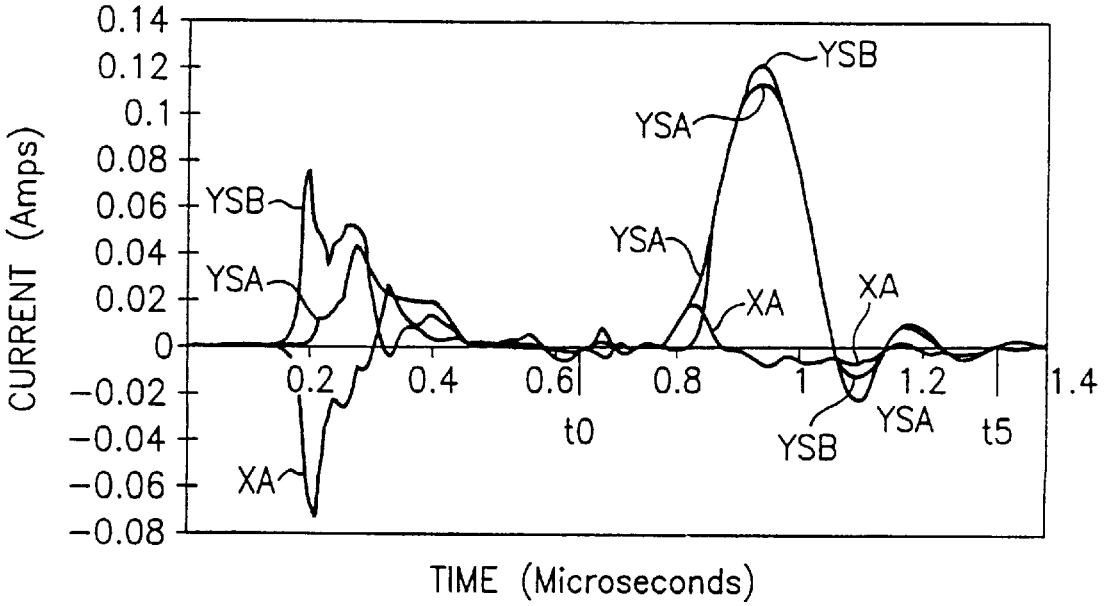
Figure 15C:
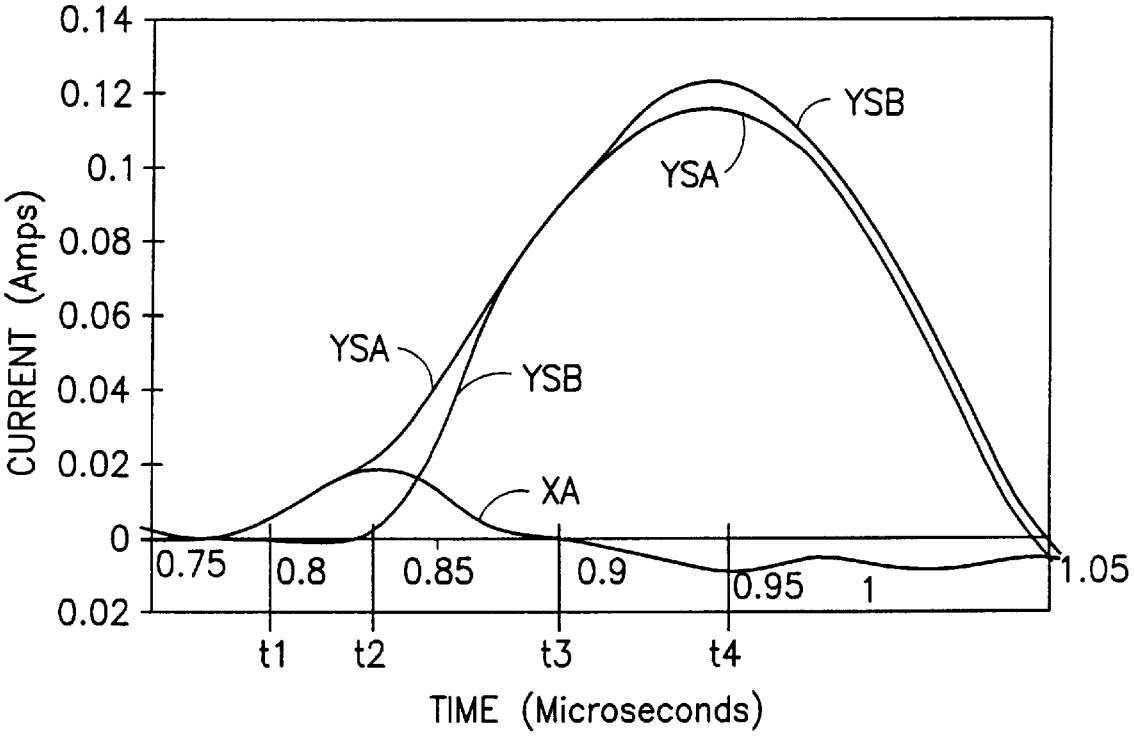

FIGS. 15*a*–15*c* show actual measured sustain voltages and currents for the address electrode, the trigger cell sustain electrode and the state cell sustain electrode in an array of 1920×2 subpixels driven in a 42 inch diagonal AC PDP having the dimensions of the INV design shown in Table 1 and operating according to the invention. FIG. 15*a* shows both the YSA electrode voltage which, in this case is the sustain electrode that defines the trigger cell, and the YSB electrode voltage which, in this case is the sustain electrode that defines the state cell. The XA voltage, which is applied to the address electrode, is not shown in FIG. 15 since it is at a constant 0 volts during the sustain operation.

FIGS. 15*b* and 15*c* show the currents flowing in the YSA, YSB and XA electrodes. FIG. 15*c* shows the same data as FIG. 15*b* but with an expanded time scale. The polarities of the three currents shown in FIGS. 15*b* and 15*c* are arbitrarily chosen so that their values can easily be compared when the discharge currents appear.

Note that for the discharge current polarities shown in FIGS. 15*b* and 15*c*, it is always true that the YSA current equals the sum of the YSB current and the XA current, due to the continuity of current principle and the three terminal nature of the PDP subpixel shown in FIG. 5. The times t0 through t5, which correspond to the time labels of FIG. 5, are labeled on FIGS. 15*b* and 15*c*.

After the displacement currents, due to the time changing YSA and YSB sustain waveforms between 0.15 microseconds and 0.5 microseconds, have subsided FIG. 15*c* shows a small discharge that is initiated in the trigger cell that peaks at time t2. This trigger cell discharge shows up as equal currents in both the trigger cell sustain electrode YSA and the address electrode XA for times before t2. Note that there is negligible current in the state cell sustain electrode YSB at times t1 and t2 because this initial discharge is only at the trigger cell electrodes and the positive column has not yet reached the state cell. As the positive column extends out from the center of the trigger cell, the trigger cell discharge current decreases until the positive column extends to the state cell at time t3. At this point the discharge current between the trigger cell sustain electrode YSA and the state cell sustain electrode YSB are equal because the highly conductive positive column connects the dielectric surfaces of these two sustain electrodes and so the address dielectric does not exert any further significant discharge current or influence on the discharge across the sustain gap. This allows the discharge current to rise significantly to a peak at time t4 which is a much higher amplitude than the initial trigger discharge peak at time t2. Eventually this current decays to the point where there is no longer any apparent discharge activity at time t5.

Figure 16A:
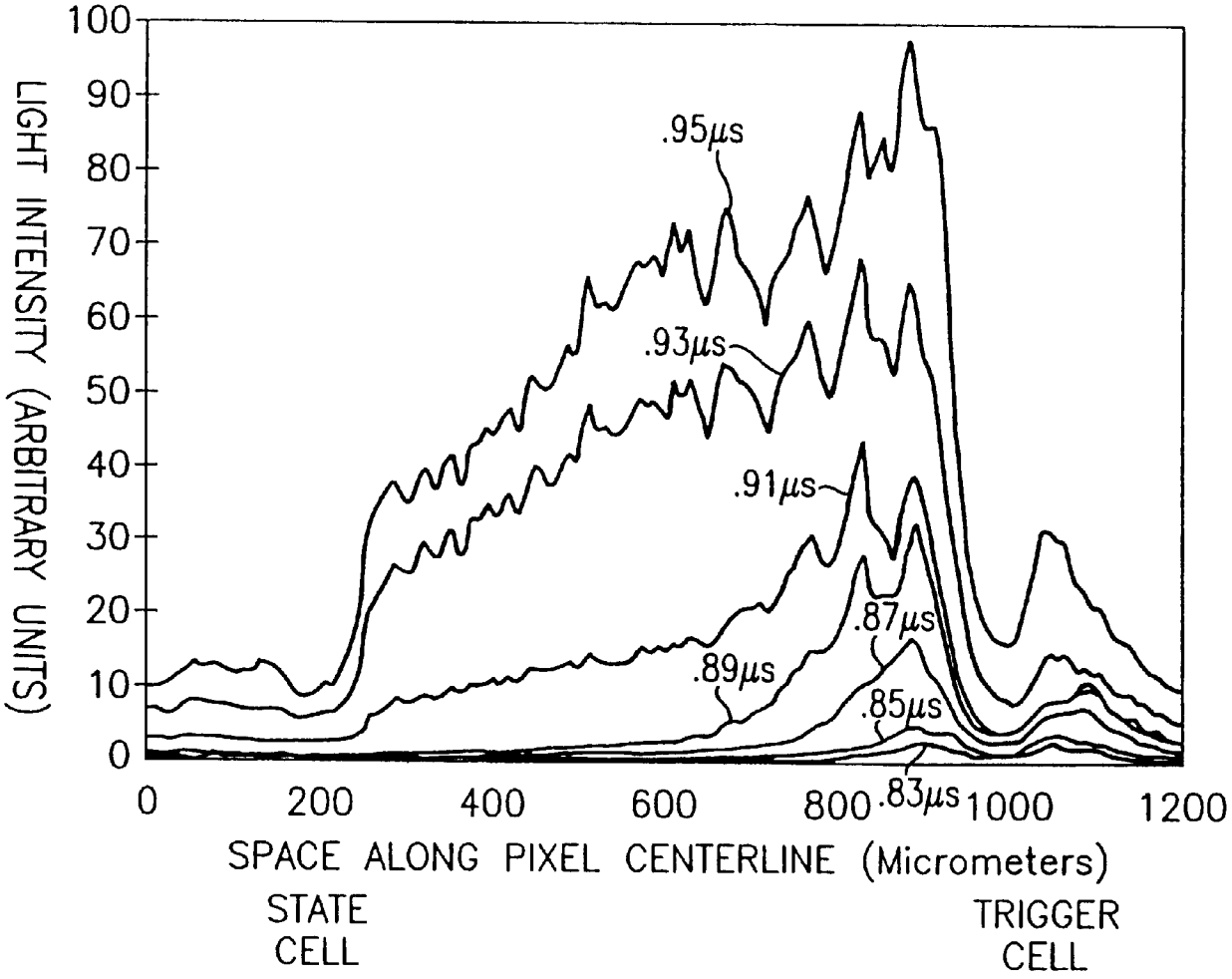
FIGS. 16*a* and 16*b* show measured gas discharge light observed from a subpixel as a function of space and time during the discharge shown in FIG. 15.
Figure 16B:
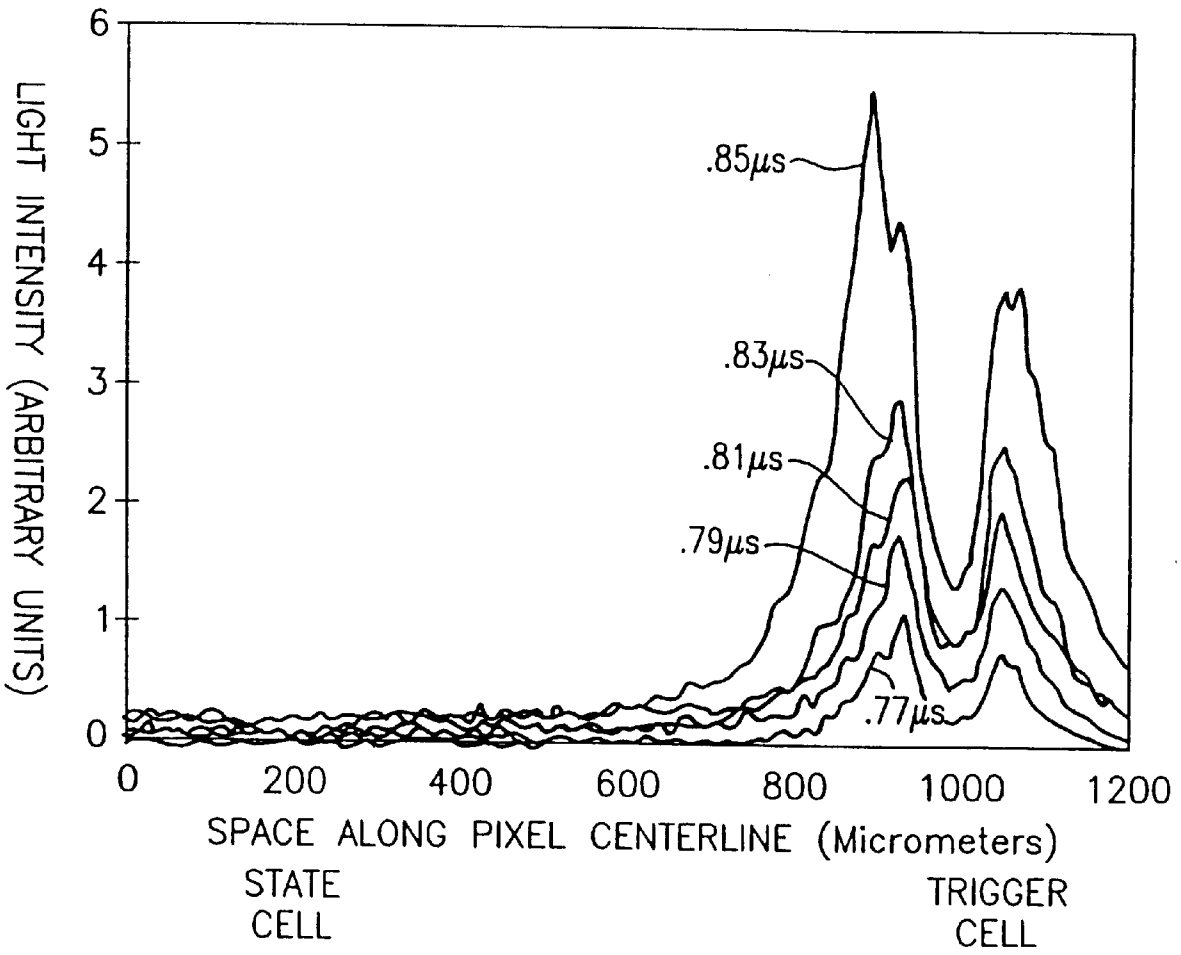

FIGS. 16*a* and 16*b* show the measured gas discharge light observed from a subpixel as a function of space and time during the discharge shown in FIG. 15. The space dimension is along a line which is parallel to the address electrode and drawn down the center of the subpixel between the trigger cell and the state cell. This line is shown as section A—A in FIG. 2*c*. This light is observed at near infrared wavelengths of approximately 828 nanometers and it comes from excited levels of the xenon atoms in the gas discharge. An appropriate optical filter is used to block the visible light from the phosphors which usually has substantial delay and thereby confuses the understanding of the discharge activity.

The infrared light is commonly used to demonstrate areas where there is a significant amount of excitation of the xenon gas atoms and so it also reasonably approximates the regions where the vacuum ultraviolet light from the xenon should be generated. It is of course the vacuum ultraviolet light that is the desired output energy of the gas discharge that is used to excite the phosphors to emit the desired colored visible light from the plasma display.

FIG. 16*b* shows the early discharge activity for the trigger cell. Note that the spatial light distribution is plotted for time increments of 0.02 microseconds and that the labeled times correspond exactly to the time axis of the voltages and currents shown in FIG. 15. FIG. 16*a* shows the later discharge activity when the positive column extends from the trigger cell to the state cell. Note that the vertical axis of FIGS. 16*a* and 16*b* are scaled differently but that the arbitrary light intensity units are the same for both Figs. Note also that the trigger cell sustain electrode is centered at 1000 micrometers and the state cell sustain electrode is centered at 200 micrometers. The sustain electrodes are made of opaque chrome-copper-chrome material and so they block the light for their width of 100 micrometers. They also reflect light that is scattered back from outside of the plasma panel.

FIG. 16*b* shows the first discharge activity at the trigger cell at 0.77 microseconds to be centered about the trigger cell sustain electrode. As time advances this trigger cell discharge activity increases in amplitude and also extends out away from the center of the trigger cell as the positive column advances toward the state cell. At 0.89 microseconds, which corresponds to time t3 in FIGS. 5 and 15*c*, the positive column has just reached the state cell and so the subsequent times shown in FIG. 16*a* show a substantial amount of light all along the sustain gap. At 0.95 microseconds, which corresponds to time t4, the light from the positive column discharge along the sustain gap has reached its peak.

Note that this intense light at 0.95 microseconds does not show the usual prior art strong peak near the cathode, which at this time is the trigger cell sustain electrode, but rather this discharge shows the intense light is all along the sustain gap which is indicative of a positive column discharge. Other evidence of positive column activity not shown in FIG. 16 is the narrow filament nature of the discharge. This discharge that extends across the sustain gap appears as a narrow filament that measures with a half width of approximately 50 micrometers. This is especially narrow considering that the this discharge has the room of more than 300 micrometers in the space between the barrier ribs in which it could move. Again such a narrow filamentary nature is indicative of the positive column and not a negative glow.

Finally this intense filamentary discharge exhibits striations which are shown in FIG. 16*a* as the many undulations of the light along the sustain gap especially evident at 0.95 microseconds in the half of the sustain gap nearest the trigger cell. These undulations in FIG. 16*a* may be confused for noise, however they are not noise but are the actual measured light output. The noise level is much smaller than one arbitrary unit, as is evidenced by the noise observed on the state cell side of FIG. 16*b*. The undulations shown in FIG. 16*a* due to the striations have peak to peak amplitudes greater than 10 arbitrary units. Again striations are indicative of positive columns and are generally not observed in negative glows. It is clear that the discharge measured in FIGS. 15 and 16 has most of its light coming from an intense positive column and only a very small amount from the negative glow.

Dielectric Capacitance Considerations

Note that in FIG. 15*c* the YSA to XA trigger cell substrate discharge that peaks at time t2 has a considerably smaller peak amplitude than the YSA to YSB sustain gap discharge that peaks at time t4. It is also useful to compare the charge transferred for these two discharges. The charge can be found by time integrating the currents shown in FIG. 15*c*. This is the same as taking the area under the curves.

The YSA to YSB sustain gap discharge transferred 1.7× 10-8 Coulombs in the period between t0 and time t5, whereas the YSA to XA trigger cell substrate gap discharge transferred 1.1×10-9 Coulombs in the period between time t0 and time t3. This shows a 15 to 1 ratio of the sustain gap discharge charge to the trigger cell substrate gap charge. This high ratio is important to the successful operation of the PDP.

The basic reason for this high charge ratio is low capacitance of the dielectric layer covering the address electrode when compared to the capacitance of the dielectric covering the sustain electrode. Recall that the address dielectric comprises a powdered phosphor layer that has a low density and therefore a low relative dielectric constant, whereas the sustain dielectric is usually a high density glass layer that has a high relative dielectric constant. These factors along with the relative widths and lengths of these electrodes helps to define the charge ratio.

It is desirable to have a high charge ratio. This is because both the trigger cell discharge across the substrate gap and the main discharge across the sustain gap send charge through the trigger cell sustain electrode capacitor. Because of this, the two discharges compete for the energy stored on the trigger cell sustain electrode capacitor. If the trigger cell substrate gap discharge is too strong then a large amount of positive charge will cause the voltage on the trigger cell sustain electrode dielectric to significantly rise so that when the main discharge across the sustain gap occurs there will be less voltage across the positive column and therefore less discharge energy deposited into the positive column. This implies that a low charge ratio will have a lower luminance because less energy is deposited to the efficient main discharge.

To achieve a high charge ratio and therefore high luminance in the panel, the capacitance of the address electrode dielectric should be considerably smaller than the capacitance of the sustain electrode dielectric. Each of these capacitance's are proportional to the area of the electrode times the relative dielectric constant of the dielectric material. Also these capacitance's are inversely proportional to the thickness of the dielectric. The capacitance of the sustain dielectric is usually adjusted to achieve a given level of luminance from the main discharge. This suggests that the address dielectric capacitance should be adjusted to achieve a high charge ratio. This means that the address dielectric should be made of a thick material with a relatively low relative dielectric constant. In addition the area of the address electrode should be made small.

It does not make sense to try to make the length of the address electrode short since by definition the address electrode runs from one edge of the panel to the other in order to intersect all of the subpixels in a panel column. However it is appropriate and desirable to make the width of the address electrode small in order to achieve a high charge ratio and therefore high luminance.

Discharge Sequence Stability

Figure 17:
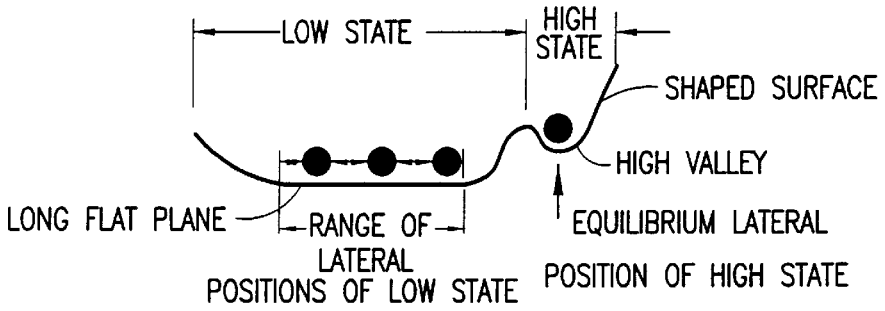
FIG. 17 shows an analogy of the stability of a typical plasma display subpixel.

FIG. 17 shows an analogy of the stability of a typical plasma display subpixel. The analogy is that of a ball which rolls on a shaped surface. This ball can be in two stable states, as shown in FIG. 17. There is a high state where the ball can rest at the bottom of a high valley and there is a low state where the ball can rest anywhere along a long flat plane. Note that the lateral position of the high state is very clearly defined since if the ball is initially positioned within the high valley but not at the bottom of the valley then the forces of gravity will act to roll the ball to the lowest point of the high valley. Alternatively the lateral position of the ball in the low state is very poorly defined.

Since the low state is a long flat plane, if the ball is initially positioned at a flat portion of the plane it will tend to remain at its initial position since the force of gravity will not push it laterally. Since there are many such initial positions the lateral position of the low state is very poorly defined. All that is certain about the equilibrium lateral position of a ball in the low state is that it is somewhere along the long flat plane.

If the ball is positioned along the side walls of the long flat plane then gravity will roll the ball down the side walls until it reaches the long flat plane.

The analogy of the ball on a shaped surface is very similar to the stability situation of plasma display subpixels. The ON state of the plasma display subpixel is analogous to the ball in the high state of FIG. 17 and the OFF state of the plasma display subpixel is analogous to the ball in the low state of FIG. 17. The lateral position of the ball in FIG. 17 is analogous to the wall voltage of the plasma display subpixel at any given period of time between discharges. The plasma display discharge activity is analogous to the force of gravity.

An important thing to learn from this analogy is that during the times between the discharges, a subpixel in the ON state has a wall voltage that is a very well established equilibrium value. If the wall voltage of the ON state deviates one way or the other from this equilibrium value, then the forces from the next and following discharges will move the subpixel wall voltage toward this equilibrium value. Similarly, a plasma display subpixel in the OFF state does not have a well established equilibrium wall voltage value.

There is a wide range of wall voltages that the OFF subpixels can have and still be in the OFF state. Since the equilibrium wall voltage values of the OFF state generally do not have discharges of any significant strength, there is no significant force from discharge activity to change the wall voltage from one sustain pulse to the next. If the OFF state subpixel has a wall voltage analogous to the side walls of the long flat plane, then the sustain pulses will cause a weak discharge or discharges that will force the wall voltage back to the long flat plane where there will be no subsequent discharge activity.

Figure 18:
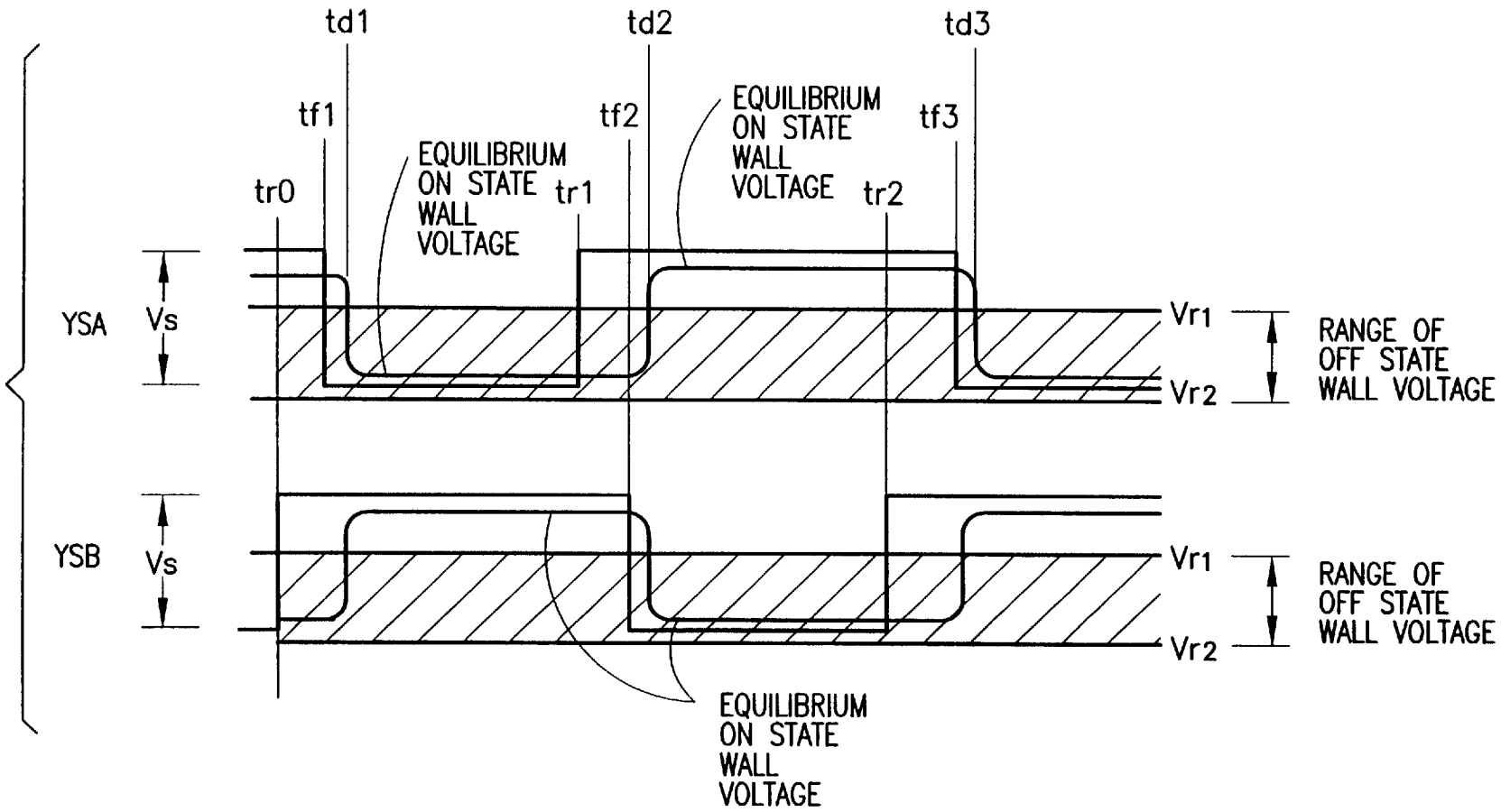
FIG. 18 shows the same sustain waveforms that were shown in FIG. 6*b* and the allowed values of wall voltages for both ON and OFF states.

FIG. 18 shows the same sustain waveforms that were shown in FIG. 6*b* and the allowed values of wall voltages for both the ON and OFF states. Note that at any given time between the discharges, the ON state wall voltage has a single equilibrium value. Alternatively the OFF state has a range of allowable wall voltages. Note that the wall voltages are defined for both the YSA and the YSB electrodes. These two wall voltages are meant to define the voltage across the substrate gaps between the respective sustain electrodes and the address electrodes. At any given time the YSA or YSB wall voltages are assigned to either the trigger cell or the state cell of the subpixel.

These two wall voltages can be independent and are coupled only if there is a conductive positive column that bridges across the sustain gap between the trigger cell and the state cell. In the case of the OFF state, where there is no conductive positive column, the wall voltages of the two cells are completely independent. In the case of the ON state, the conductive positive column couples the trigger cell and the state cell wall voltages so that during the period between discharges, one wall voltage is at a high level while the other wall voltage is at a low level.

The actual value of the equilibrium ON state wall voltage is determined by the principle that after the highly conductive discharge there are a sufficient number of electrons and positive ions in the substrate gap that flow to the walls to nearly completely reduce the voltage across the substrate gap to zero as shown in FIG. 5*f*. If the substrate gap voltage is zero then the wall voltage is equal to the sustain voltage. FIG. 18 shows the ON state wall voltage is nearly identical to the sustain voltage after the discharges.

The range of the OFF state wall voltages is bounded by the two wall voltages Vr1 and Vr2. If the OFF state wall voltage ventures outside of the Vr1 to Vr2 range, then weak discharges will serve to return the wall voltages back to the Vr1 to Vr2 range just as gravity would return the low state ball of FIG. 17 to the long flat plane if the ball ventured to the left or right lateral side walls adjacent to the plane.

The value of Vr1 is determined by the point where a weak discharge is initiated when the sustain voltage is low. For example, in FIG. 18 this corresponds to the time between tf1 and tr1 for YSA and to the time between tf2 and tr2 for YSB. When the sustain voltage is low, the dielectric covering the sustain electrode becomes the cathode. Since this dielectric usually has a high secondary emission material such as MgO, the substrate gap voltage at which a weak discharge might be initiated is relatively small.

For the experimental subpixels having the INV design of Table 1 and the measured characteristics of FIGS. 15 and 16, this Vr1 voltage was measured to be approximately 200 volts above the low level of the sustain voltage. The value of Vr2 is determined by the point where a weak discharge is initiated when the sustain voltage is high. For example, in FIG. 18 this corresponds to the time between tr1 and tf3 for YSA and to the time between tr0 and tf2 for YSB.

When the sustain voltage is high, the sustain electrode becomes the anode and the address electrode becomes the cathode. Since the phosphor layer covering the address electrode usually has no high secondary emission material such as MgO, the substrate gap voltage at which a weak discharge might be initiated is relatively high. For the experimental subpixels having the INV design of Table 1 and the measured characteristics of FIGS. 15 and 16, this Vr2 voltage was measured to be approximately 300 volts below the high level of the sustain voltage.

It is interesting to note the asymmetry of the OFF state wall voltage range relative to the high and low sustain voltage levels. Note that the center of the Vr1 to Vr2 range is lower than the point half way between the high sustain levels and the low sustain levels. The reason for this is that the substrate gap breakdown voltage is less when the sustain electrode is the cathode than when the address electrode is the cathode. This is because the dielectric covering the sustain electrode has a high secondary emission material such as MgO whereas the phosphor layer covering the address electrode usually has no high secondary emission material.

This set of circumstances allows the minimum value of the OFF state wall voltage range, Vr2, to be at a value below the lowest value of the sustain voltage as shown on FIG. 18. For example, the sustain voltage, used for the data of FIGS. 15 and 16 for the INV design, had a value Vs of 260 volts and the Vr2 was measured to be 300 volts, so that the OFF state wall voltage can in this case be 40 volts below the minimum level of the sustain voltage. However the maximum value of the OFF state wall voltage range, Vr1, cannot be greater or equal to the highest level of the sustain voltage since such an OFF state voltage would be coincident with the ON state wall voltage which would cause the OFF state to errantly discharge when the sustain voltage falls to the low level.

For example, if for the experimental INV design, Vs is 260 volts and Vr1 is 200 volts, then the highest level of the OFF state wall voltage is 60 volts below the highest level of the sustain voltage.

Figure 19:
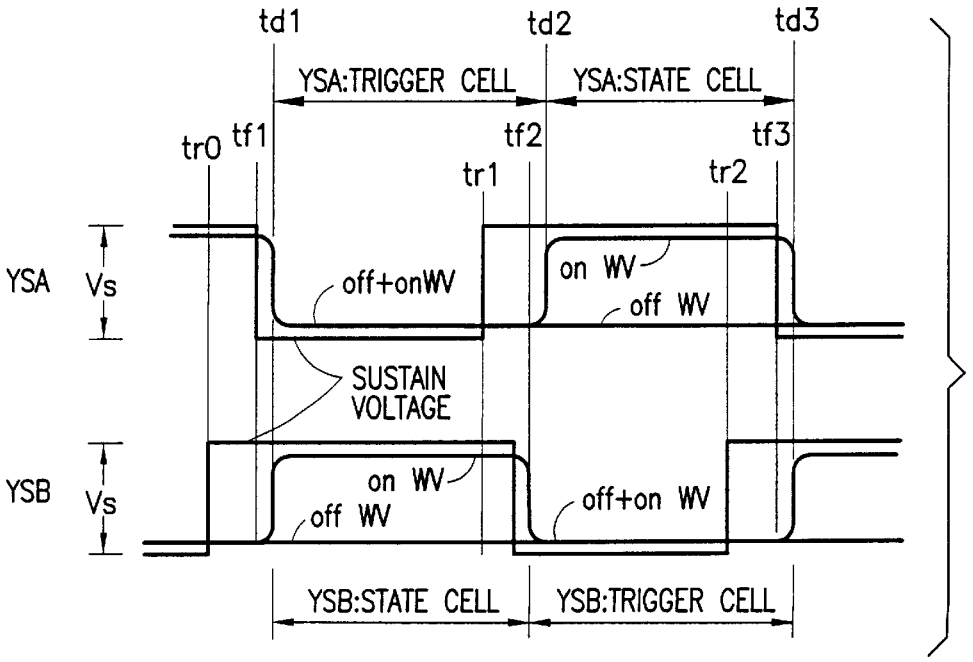
FIG. 19 shows an allowed choice of the OFF state wall voltage for the trigger cell and the state cell that is within the bounds described in FIG. 18.

The allowed range of OFF state wall voltages shown in FIG. 18 presents an interesting set of circumstances in that at certain times of the sustain cycle, the OFF state wall voltage of a given cell can have the exact same value as the ON state wall voltage of that cell. FIG. 19 shows an allowed choice of the OFF state wall voltage for the trigger cell and the state cell that is within the bounds described in FIG. 18 and where, for certain periods, the OFF state wall voltage is equal to the ON state wall voltage.

For the period between td1 and td2, the OFF state wall voltage and the ON state wall voltage are shown in FIG. 19 to be the same for the YSA sustain electrode which, during this period intersects with the trigger cell. Similarly, during the period between td2 and td3, the OFF state wall voltage and the ON state wall voltage are the same for the YSB sustain electrode which during this period intersects with the trigger cell. It is obvious that any cell in which the OFF state and the ON state wall voltages are at the same level for long periods without significant discharge activity, cannot hold any useful information about the state of the subpixel.

Thus, it is a general principle of the invention that the trigger cells hold no useful information about the state of the subpixel after the discharge that they may have triggered. On the other hand, the state cells in FIG. 19, one of which intersects the YSA electrode in the period between td2 and td3 and the other of which intersects the YSB sustain electrode during the period between td1 and td2, do have differing wall voltage levels for the ON and OFF states. Therefore the state cells can hold information about the state of the subpixel and this is the reason they are named state cells.

It is a feature of the invention that storage of the information of the state of a subpixel is exchanged between the two physical cells of the subpixel during each half sustain cycle. A given physical cell will hold the state of the subpixel information only during the half of the sustain cycle when it is the state cell. A state cell in the ON state will discharge when it turns into a trigger cell during the trigger cell sustain pulse. A state cell in the OFF state will not discharge when it turns into a trigger cell during the trigger cell sustain pulse.

Once these state cells turn into trigger cells they transfer the state information to the new state cells and the new trigger cells lose the information on the state of the subpixel.

Further Details Concerning the Sustain Waveforms

There are further important features regarding the waveforms shown in FIG. 6*b*. The YSA sustain voltage falls at tf1 and the trigger discharge is initiated at td1. Sometime after the completion of the discharge at time tr1, the YSA sustain voltage rises. After a short period, the YSB sustain waveform falls at time tf2 and the trigger discharge is initiated at time td2.

It is important that the rise of sustain voltage YSA at time tr1 occur before the beginning of the discharge at time td2 or if an appropriate safety factor is desired, then tr1 should occur before or at the same time as the fall of the YSB sustain voltage at time tf2. If the discharge at time td2 occurs before the rise of the YSA sustain voltage at tr1, it is likely that the subpixel will be erroneously erased.

Figure 7:
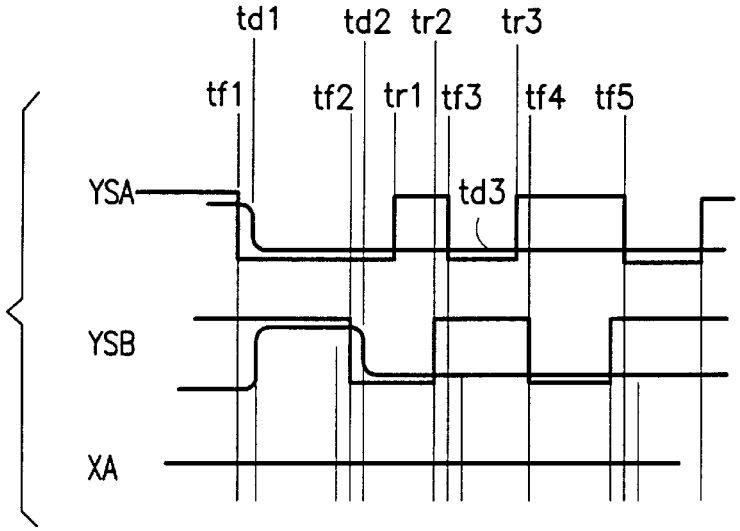
FIG. 7 illustrates a set of sustain waveforms that will create an errant erase operation.

This erasing action is shown in FIG. 7. The fall of the YSB sustain voltage at time tf2 will cause a discharge at the trigger cell at time td2 that initiates a positive column that extends into the state cell at time td2. If the sustain voltage YSA, which is applied to the state cell, is still at the low level as shown in FIG. 7 time td2, then the voltage across the substrate gap of the state cell is very near zero just before the trigger cell discharge. Then, when the trigger cell positive column extends into the state cell, there is no significant change of the wall voltage of the state cell (as shown in FIG. 7) for the YSA wall voltage at time td2.

When the YSA sustain voltage eventually rises at time tr1, the voltage across the state cell substrate gap is at the same level as the OFF state level. During the next sustain discharge time when the YSA sustainer falls at time tf3, the trigger cell will not fire at time td3 because the wall voltage of the trigger cell is at the OFF level, and so there is insufficient voltage across the trigger cell substrate gap to initiate a discharge. Note that once the subpixel is erased (at FIG. 7 time td2), there are no subsequent discharges during the remaining sustain pulses and the subpixel is placed in the OFF state by the erroneous erase at time td2.

While FIG. 7 shows how a single erroneous erase can occur, it is also possible and usually undesirable to have a set of sustain waveforms where the erase will occur every sustain cycle. Consider a set of sustain waveforms shown in FIG. 8 which are similar to the waveforms of FIG. 6*b* except that the waveforms are simply inverted. These FIG. 8 waveforms were found to not properly sustain the panel with the INV design dimensions shown in Table 1.

Figure 8:
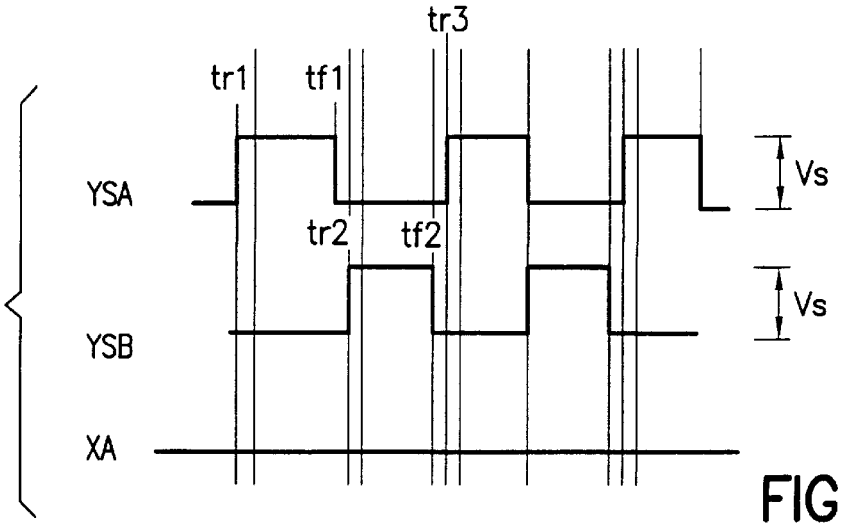
FIG. 8 illustrates a set of prior art sustain waveforms that will not operate with the invention.

While the measured minimum sustain voltage, Vsmin, of the FIG. 6*b* waveforms was 250 volts, the FIG. 8 waveforms would not maintain any sustain discharges even at Vs=350 volts. At Vs voltages of about 400 volts, sustain discharges could be maintained with the FIG. 8 waveforms but all of these discharges were only across the substrate gaps. There were no discharges across the sustain gaps even at the extremely high Vs voltage of 500 volts. There was no evidence of a positive column movement from the trigger cell to the state cell even at Vs=500 volts.

It is clear why the positive column generated in a trigger cell of the FIG. 8 waveforms does not move to discharge the state cell. For FIG. 8, the trigger cell intersects YSA at time tf1. If a trigger discharge were to occur, the positive column would move to the state cell that intersects sustain electrode YSB. However since YSB is at the low state at time tf1, the wall voltage of the state cell will be adjusted to equal the low value of the YSB sustain voltage which corresponds to an OFF state. In other words an erase would occur. A similar erase operation will occur at time tf2. Since any trigger cell discharge causes subpixels to be erased there is no possibility for the positive column discharge mode to exist across the sustain gap for the waveforms of FIG. 8.

Comparison of the Invention to the Prior Art

It is worthwhile to consider the similarities and differences between the ON state sustain discharge mode described above and the ON state sustain discharge mode utilized in prior art. The waveforms shown in FIG. 6*b* could be applied to a plasma panel having prior art electrode geometries, like those shown in Table 1 labeled F, N, M and P, and the panel would operate properly with the prior art ON state sustain discharge mode.

A major difference is that the prior art geometries with MgO cathodes allow a minimum sustain voltage Vsmin of about 170 volts, whereas the geometries of the invention, INV in Table 1, and which utilizes the same MgO cathode material as the prior art design, has a Vsmin of about 250 volts. This is significant because the substrate gap has the same value of approximately 110 micrometers for the prior art and the INV designs.

The reason for this very large Vsmin difference is the difference in the ON state sustain discharge modes. The ON state sustain discharge of the invention is initiated by a discharge across the substrate gap of the trigger cell, with sufficient amplitude so that the positive column extends from the trigger cell to the state cell. Vsmin is determined by the condition that the trigger cell discharge is just sufficiently intense to have a strong enough discharge to cause the positive column to extend to the state cell and significantly change the wall voltage of the state cell.

For prior art subpixel dimensions that utilize the same waveforms as FIG. 6*b*, the ON state sustain discharge initially occurs across the sustain gap between the two sustain electrodes and there is no significant discharge activity across the substrate gaps. This is because the prior art dimensions have an approximately one-to-one ratio of the sustain gap to the substrate gap as shown by the ratio of SusG/SubG shown in Table 1. This allows a large electric field to be generated across the sustain gap at the beginning of the ON state sustain discharge. This large electric field is caused by the contribution of the applied sustain voltages plus the charge on the dielectric of the YSA sustain electrode plus the charge on the dielectric of the YSB sustain electrode.

The large electric field across the sustain gap causes the prior art ON state sustain discharge to develop along the sustain gap. There is no significant discharge for the prior art along the substrate gap because the sustain voltages typically used in prior art geometries (range between 170 volts and 200 volts) are typically at or below the substrate gap breakdown voltage which is approximately 200 volts when the MgO is the cathode and approximately 300 volts when the phosphor is the cathode. This means that there is little chance at the prior art sustain voltages for discharges to be sustained across the substrate gap to the address electrode.

The existence of this major distinction of the ON state sustain discharge modes between the invention described here and the prior art can easily be measured by looking at the address electrode currents for the two ON state sustain discharges. FIG. 15 shows that at time t1 there is a small discharge current that appears on both the trigger cell sustain electrode YSA and the address electrode XA that peaks at time t2. This current is absent in the state cell sustain electrode YSB at time t1. At time t4 there is a very strong discharge between the trigger cell sustain electrode YSA and the state cell sustain electrode YSB that is demonstrated by the strong currents in both electrodes.

The prior art ON state sustain discharge mode has a strong discharge between the two sustain electrodes that is seemingly similar to that seen at time t4 in FIG. 15. The major difference is that the prior art sustain discharge does not show a discharge current similar to the one at time t1 between the trigger cell sustain electrode and the address electrode. This discharge does not occur in the prior art ON state sustain discharge because its sustain gap is much smaller than the sustain gap of this new invention. This smaller sustain gap of the prior art allows the strong ON state discharge to develop across the high electric field between the two sustain electrodes before any significant discharge between a sustain electrode and the address electrode can develop.

The considerably larger sustain gap of the new invention makes the electric field across the sustain gap so low that an initial discharge between the two sustain electrodes cannot occur. This means that the sustain voltage Vs of the invention must be increased over that of the prior art. The invention sustain gap is so large relative to the substrate gap that even with an increased sustain voltage Vs, the electric field across the sustain gap is too small to directly initiate a discharge across the sustain gap. Instead the electric field across the substrate gap is much larger than across the sustain gap, and the discharge across the substrate gap occurs at a much lower voltage than across the sustain gap in the new invention. This is why the trigger cell discharge across the substrate gap at time t1 of FIG. 15 appears before any discharge across the sustain gap.

Another difference between the prior art and this invention is the range of allowable waveforms. Since the prior art ON state sustain discharge occurs across the sustain gap, the cathode of the sustain discharge is always one of the high secondary emission dielectric layers covering one of the sustain electrodes. This means that it is not important whether the sustain voltage is high or low when the ON state sustain discharge occurs since both sustain electrodes have high secondary emission dielectrics that can serve as a low voltage cathode.

As discussed above it is highly desirable for the invention to have the ON state sustain discharge occur when the sustain electrode of the trigger cell is negative so that the high secondary emission dielectric of the trigger cell sustain electrode is the cathode. If the trigger cell discharge of the invention was to occur when the sustain electrode was positive, then the low secondary emission dielectric that covers the address electrode of the trigger cell would be the cathode and an undesirable high voltage discharge could occur.

A further difference between the prior art and this invention is the nature of the sustain pulse transition timing. Recall that for this new invention that, referring to FIG. 6*b*, it is important that the rise of the sustain voltage YSA at time tr1 occur before the beginning of the discharge at time td2 or if an appropriate safety factor is desired, then tr1 should occur before or at the same time as the fall of the YSB sustain voltage at time tf2. If the discharge at time td2 occurs before the rise of the YSA sustain voltage at tr1, then it is likely that the subpixel will be erroneously erased as shown in FIG. 7. Or in the extreme case of the FIG. 8 waveforms the subpixels will be erased every half sustain cycle for the new invention.

The prior art ON state sustain discharge does not have this same restriction. There is usually no restriction as to when the tr1 rise occurs in the prior art ON state sustain discharge. In fact most prior art systems in use today use waveforms similar to those of FIG. 8. This is because the prior art initial sustain discharge occurs across the sustain gap so that if the rise of YSA does not occur before the fall of YSB at tf2, there will not be sufficient voltage across the sustain gap or the substrate gap to initiate any discharge. If the tr1 rise of YSA occurs after the fall of YSB at tf2, the prior art ON state sustain discharge will be initiated by the tr1 rise of YSA and not the fall of YSB at tf2. Thus there is no opportunity for the ON state sustain discharge mode of the prior art to be erroneously erased by the phasing of the sustain pulse edges.

For example the inverted waveforms of FIG. 8 will sustain a prior art design correctly at a approximately the same low sustain voltage as the waveforms of FIG. 6*b*. Of course as discussed above, the invention described here works properly with the FIG. 6*b* waveforms but does not work with the FIG. 8 waveforms.

Advantages and Disadvantages of the Invention

The first major advantage of the invention is luminous efficiency. A PDP designed according to the invention has achieved a higher luminous efficiency than a similar panel designed according to the prior art. It is believed that this higher luminous efficiency is due to the use of the more efficient positive column compared to the lower efficiency negative glow.

High luminous efficiency is important because it can be used to obtain brighter panels, lower power panels or longer life panels.

Note that in Table 1, the prior art designs have used two types of electrodes: transparent and opaque. Transparent electrodes are usually made of materials such as tin oxide or indium tin oxide and are designed to allow the discharge light to easily escape through the electrode. Opaque electrodes must be made narrow so that they do not block too much discharge light.

The advantages of transparent electrodes are that a wide electrode can be used to increase the dielectric capacitance and therefore increase the brightness of the panel. If a similar wide electrode is used with opaque electrodes, most of the light, which in the prior art comes from the negative glow, is generated under the electrode and a large portion thereof is blocked. The advantage of the opaque electrode is that panel manufacturing cost is lower because transparent electrodes require a two step process of depositing a wide transparent electrode and then depositing an additional narrow opaque and highly conductive electrode on top of the transparent electrode in order to greatly reduce the resistance of the electrode to an acceptable level.

The simple opaque electrode design only requires the one step of depositing the opaque electrode to achieve the low resistance and so it is lower cost.

Because the invention generates most of its light from the positive column, light from the negative glow is not very important and so a transparent electrode is not needed to achieve high brightness. The data of FIG. 16 was taken from a panel that has opaque electrodes and so it is clear that the opaque electrodes do not block a very significant amount of the light. Thus the invention facilitates the use of opaque electrodes that are lower in cost than the transparent electrodes commonly used in prior art.

Another advantage of this invention is a lower electrode capacitance than for prior art designs. Because the sustain gap is larger in this invention, the electrode capacitance between sustain electrodes is necessarily lower. In addition the electrode connection arrangement shown in FIG. 3 further reduces the capacitance that the sustainer must drive. This is because in the prior art with simple alternating YSA and YSB sustain electrodes, every YSA electrode has a YSB electrode on either side of it and each of these two YSB electrodes has a capacitance associated with it. In the FIG. 3 design, a given YSA electrode has a YSA electrode on one side and a YSB electrode on the other side. The capacitance between the YSA electrode and its YSA neighbor is not important because the sustain voltage generator does not have to drive these capacitances to different potentials. Only the capacitance between the YSA electrode and its single YSB neighbor needs to be driven by the sustainer. This means that the FIG. 3 arrangement effectively reduces the sustain electrode to sustain electrode capacitance in half. Reducing this capacitance is important for reducing the power dissipation in the sustain and addressing circuits.

The capacitance reduction is substantial. This can be seen by comparing the capacitance's of the prior art P design in Table 1 with the invention INV design. The actual capacitance values were measured for each design using practical operational designs of 42 inch diagonal plasma panels having 640×480 full color subpixels with a 4:3 aspect ratio. The entire panel YSA to YSB sustain capacitance of the prior art P design was measured to be 83.3 nanofarads, whereas the invention INV design measured only 33.6 nanofarads. In addition the capacitance of all XA address electrodes connected in parallel to all sustain electrodes connected in parallel was measured to be 61.3 nanofarads in the prior art P design and was measured to be 48.9 nanofarads in the invention INV design. These reductions have a major impact on reducing the power dissipation and the cost of designs incorporating the invention.

It is expected that the invention will have an extended life due to reduced phosphor degradation. Phosphors lose their brightness with operational aging in plasma displays due to a number of differing effects. Two of these degradation mechanisms are due to the sputtering from the highly energetic ions of the negative glow. In the first mechanism, sputtering ions can directly degrade the phosphors by bombarding them with the high energy ions. In the second mechanism the phosphors can be degraded by coating them with UV opaque MgO that is sputtered from the MgO cathodes of the sustain dielectric by the high energy ions of the negative glow. These mechanisms can be a significant problem in prior art plasma displays.

The invention does not have these problems to the same degree as the prior art because the damaging energetic ions remain in the region of the negative glow. Such highly energetic ions are not produced by the positive column. Since most of the light from the invention comes from the positive column, the phosphor regions that are near the positive column are much more important for light emission than the phosphor regions near the negative glow. Thus, even if the invention has the same degradation rate of the phosphors near the negative glow as the prior art displays, the invention will have extended phosphor life because most of its light comes from the phosphors near the positive column that do not degrade from negative glow sputtering.

One seeming disadvantage of the new invention is its higher sustain voltage, when compared to prior art. A typical minimum sustain voltage of the prior art P design in Table 1 is 170 volts. However the minimum sustain voltage measured on the INV design was 250 volts. The higher voltage sustain circuits may be more costly for the invention than for the prior art. However when one considers the discharge current and power that the invention is required to supply, it is not clear that a higher voltage sustainer for the new invention will cost more than the prior art sustainer.

First, if the invention has a higher luminous efficiency, then for the same brightness between the invention and the prior art, the power requirements of the invention will be less and a lower sustain current will be needed just due to the reduced power requirement. There will also be an additional sustain current reduction due to the use of higher sustain voltage. This is because power is the product of voltage and current so that a design with increased voltage but with the same power will have lower current.

The cost of sustain circuits increases due to both higher voltage and higher current. The invention will have higher voltage but it will also have considerably lower current. These considerations coupled with the considerably lower sustain electrode capacitance of the invention will probably make the invention sustain circuit lower cost than the prior art.

Another major problem with AC plasma panels is the very rapidly changing current of the sustain discharge. This rapidly changing current is commonly measured with the time differential quantity dI/dt. High dI/dt causes large voltage drops across the stray inductances of the plasma panel and its circuits. These large voltage drops cause poor regulation of the waveforms of the plasma panel which can cause poor operation of the display. It is highly desirable to minimize the dI/dt of the plasma panel in order to maintain a high level of waveform regulation.

Fortunately the dI/dt of the invention is less than the dI/dt of the prior art. This is due to the growth rate of the current of the invention being limited by the growth rate of the long positive column and the growth rate of the prior art being limited by the growth rate of the much shorter negative glow. Since the long positive column grows slower the dI/dt of the invention is less than that of the prior art.

Because of the higher luminous efficiency of the invention and the higher voltage operation that allows a higher power to be delivered to the panel, a panel designed according to the invention can have a considerably higher luminance per discharge than one designed along the lines of the prior art. This means that it is possible to make some other desirable compromises in the design.

It is well known that the brightness of AC plasma display panels is generally proportional to the sustain frequency. This means that if the same luminance is desired for both the prior art and the invention PDP, then the average sustain frequency of the invention can be much lower than that of the prior art. This has the advantage of saving critical time in the subframe waveforms shown in FIG. 10. If the average sustain frequency of the invention is lowered, but the peak sustain frequency is maintained, then the length of time needed for the FIG. 10 sustain period can be reduced. This has the advantage of allowing the extra time to be used for a longer address period or for more subfields per frame time.

A longer address period is desirable if a PDP has more scan lines. This is important for higher resolution panels. More subfields per frame is important for improving the number of gray levels or increasing the image quality. The major point is that the performance of the display can be increased by reducing the average sustain frequency in this new invention.

It is important to realize that the advantages of this invention are easily achieved with minimal changes to the prior art panel design. For instance the PDP device itself requires very little modifications over the prior art in order to incorporate the invention. By simply redesigning the PDP front plate electrode geometry to a design similar to FIG. 3 and then incorporating this new front plate electrode design into an existing prior art device structure, a PDP structure incorporating the invention is achieved. This can be accomplished simply by changing the software that generates the front plate sustain electrode mask. There is no need to change any of the back plate design, panel materials or manufacturing processes.

Perhaps the greatest impact on PDP system design for the invention is the increased voltage required of the sustain circuit over the prior art. This requires higher voltage sustain transistors. However it is expected that the cost of the sustain circuit will be lower because of the lower current and power requirements discussed above. The address driver circuits for the invention can be the exact same ones used for the prior art designs.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An AC plasma panel comprising:

a plurality of addressable subpixel sites, each subpixel site including an address electrode positioned on one substrate and a first sustain electrode and a second sustain electrode positioned on an opposed substrate, each said electrode covered by a dielectric material, a dischargeable gas positioned between said substrates, an intersection between said address electrode and said first sustain electrode defining a first discharge site and an intersection between said address electrode and said second sustain electrode defining a second discharge site;

scan drive means, active during an address phase, for applying a negative going signal to said first sustain electrode;

address drive means, active during said address phase, for applying an address signal to said address electrode, and for creating a discharge of said gas at said first discharge site so as to cause a positive column to move along said address electrode to said second discharge site, said address signal, said positive column and a potential applied to said second sustain electrode cooperating to create a discharge which induces a wall voltage at said second discharge site in accordance with a determined subpixel value;

sustain drive means, active during a sustain phase, for applying sustain signals to said first sustain electrode and said second sustain electrode to thereby enable an independent discharge to initiate at said second discharge site between said second sustain electrode and said address electrode when said wall voltage at said second discharge site is indicative of said determined subpixel value;

wherein said sustain signals further cooperate to thereafter enable a discharge at said second discharge site to cause a positive column which moves along said address electrode to said first discharge site and enables a discharge to occur thereat that is indicative of said determined subpixel value; and further wherein said sustain electrodes are separated by a distance such that the power dissipated in said positive column is increased relative to a power dissipated in a negative glow portion of said discharge.

2. The AC plasma panel as recited in claim 1, wherein said address signal results in a wall potential on said dielectric material covering said address electrode that is more positive than a potential on the dielectric material covering said first sustain electrode during said negative-going signal.

3. The AC plasma panel as recited in claim 1, wherein continued application of said sustain signals to said first sustain electrode and said second sustain electrode causes alternating discharges at said first discharge site and said second discharge site as a result of positive columns that travel therebetween.

4. The AC plasma panel as recited in claim 1, wherein, said first sustain electrode comprises a single electrode trace and said second sustain electrode comprises a loop trace, one side of said loop trace servicing a first subpixel site and a second side of said loop trace servicing an adjacent subpixel site, along with a further first sustain electrode, a distance between said substrates defining a substrate gap and a distance between said single electrode trace and a side of an adjacent loop trace defining a sustain electrode gap, said sustain electrode gap being substantially larger than said substrate gap.

5. The AC plasma panel as recited in claim 1, wherein, prior to said address phase, said scan drive means includes set-up means operative during a set-up phase to apply an initial negative-going signal to at least one of said first sustain electrode and said second sustain electrode, to enable a discharge to be created which acts to establish first predetermined wall voltages on said dielectric materials.

6. The AC plasma panel as recited in claim 5, wherein, subsequent to said initial negative-going signal, said scan drive means applies a positive-going signal to at least one of said first sustain electrode and said second sustain electrode, to enable a discharge which acts to establish second predetermined wall voltages on said dielectric materials.

7. The AC plasma panel as recited in claim 6, wherein, subsequent to said positive-going signal, said scan drive means applies a subsequent negative-going signal to one said sustain electrode to cause a discharge which moves a wall voltage at said first discharge site to a potential that is sufficiently negative relative to a potential at said second discharge site to enable a subsequently created positive column to move to said second discharge site.

8. The AC plasma panel as recited in claim 7, wherein said initial negative-going signal, said positive-going signal and said subsequent negative-going signal are configured to achieve positive resistance discharges of said dischargeable gas.

9. The AC plasma panel as recited in claim 8, wherein said positive going signal is caused to occur sufficiently soon after said initial negative-going signal that priming particles created as a result of a discharge created by said initial negative-going signal aid in creation of said positive resistance discharge during application of said positive-going signal.

10. The AC plasma panel as recited in claim 1, wherein, prior to said address phase, said scan drive means includes set-up means operative during a set-up phase to apply an initial negative-going signal to one said sustain electrode while a positive voltage is applied to another said sustain electrode to enable discharges to be created which act to establish first predetermined wall voltages on said dielectric materials.

11. The AC plasma panel as recited in claim 10, wherein, subsequent to application of said initial negative-going signal, said set-up means applies a positive-going signal to said one said sustain electrode to enable a discharge which acts to establish second predetermined wall voltages on said dielectric materials.

12. The AC plasma panel as recited in claim 1, wherein, upon creation of a positive column through actuation of a discharge at one said discharge site and said positive column extending into another discharge site, a wall voltage results at said another discharge site that is dependent upon a level of potential on intersecting address and sustain electrodes at said another discharge site.

13. The AC plasma panel as recited in claim 1, wherein, said dielectric material on each of said sustain electrodes includes an insulator exhibiting a substantial secondary electron emission characteristic.

14. The AC plasma panel as recited in claim 1, wherein, said dielectric material on said address electrode comprises a phosphor.

15. The AC plasma panel as recited in claim 1, wherein, said first sustain electrode comprises a single trace sustain electrode and said second sustain electrode comprises at least a portion of a loop, one side of said loop servicing a first subpixel site and a second side of said loop servicing an adjacent subpixel site in conjunction with an additional single trace sustain electrode, each single trace sustain electrode further positioned adjacent a further single trace electrode to thereby comprise a single trace pair, said AC plasma panel further comprising:

a conductive isolation bar positioned within each loop, and between each single trace pair commonly energized by same potentials during said sustain phase of said display.

16. The AC plasma panel as recited in claim 15, wherein said conductive isolation bar is approximately centered between adjoining electrodes.

17. The AC plasma panel as recited in claim 15, wherein distances between adjacent single trace pairs and between sides of a loop, respectively comprise interpixel gaps, and conductive isolation bars present in said interpixel gaps exhibit an electrode width in a range from about 50% to about 80% of each said inter-pixel gap.

18. A method for operating an AC plasma panel having a plurality of addressable subpixel sites, each subpixel site including an address electrode positioned on one substrate and a first sustain electrode and a second sustain electrode positioned on an opposed substrate, each said electrode covered by a dielectric material, a dischargeable gas positioned between said substrates, an intersection between said address electrode and said first sustain electrode defining a first discharge site and an intersection between said address electrode and said second sustain electrode defining a second discharge site, said method comprising the steps of:

during an address phase, applying (i) a negative going signal to said first sustain electrode and (ii) an address signal to said address electrode, to create a discharge of said gas at said first discharge site which causes a positive column to migrate along said address electrode to said second discharge site, said address signal, said positive column and a potential applied to said second sustain electrode cooperating to create a discharge which induces a wall voltage at said second discharge site in accordance with a determined subpixel value;

during a sustain phase, applying sustain signals to said first sustain electrode and said second sustain electrode to thereby enable an independent discharge to initiate at said second discharge site between said second sustain electrode and said address electrode when said wall voltage at said second discharge site is indicative of said determined subpixel value, said sustain signals thereafter cooperating to enable a discharge at said second discharge site to cause a positive column to migrate along said address electrode to said first discharge site and to enable a discharge to occur thereat that is indicative of said determined subpixel value; and causing said discharges such that the power dissipated in said positive column is increased relative to a power dissipated in a negative glow portion of said discharge.

19. The method as recited in claim 18, wherein continued application of said sustain signals to said first sustain electrode and said second sustain electrode causes alternating discharges at said first discharge site and said second discharge site as a result of positive columns that travel therebetween.

20. The method as recited in claim 18, comprising the further step of:

during a set-up phase, prior to the address phase, applying an initial negative-going signal to at least one of said first sustain electrode and said second sustain electrode to enable discharges to be created which act to establish first predetermined wall voltages on said dielectric materials.

21. The method as recited in claim 20, comprising the further step of:

subsequent to said initial negative-going signal, applying a positive-going signal to at least one of said first sustain electrode and said second sustain electrode to enable a discharge thereat which acts to establish second predetermined wall voltages on said dielectric materials.

22. The method as recited in claim 21, comprising the still further step of:

after said positive-going signal, applying a subsequent negative-going signal to one said sustain electrode to cause a discharge which moves a wall voltage at said first discharge site to a potential that is sufficiently negative relative to a potential at said second discharge site to enable a subsequently created positive column to move to said second discharge site.

23. The method as recited in claim 22, wherein said initial negative-going signal, said positive-going signal and said subsequent negative-going signal are configured to achieve a positive resistance discharges of said dischargeable gas.

24. The method as recited in claim 23, wherein said positive going signal is caused to occur sufficiently soon after said initial negative-going signal that priming particles created as a result of a discharge created by said initial negative-going signal aid in creation of said positive resistance discharge during application of said positive-going signal.

25. The method as recited in claim 18, further comprising the step of:

prior to said address phase, applying an initial negative-going signal to one said sustain electrode while a positive voltage is applied to another said sustain electrode to enable discharges to be created which act to establish first predetermined wall voltages on said dielectric materials.

26. The method as recited in claim 25, comprising the further step of:

subsequent to application of said initial negative-going signal, applying a positive-going signal to said one said sustain electrode to enable discharges which act to establish second predetermined wall voltages on said dielectric materials.

27. The method as recited in claim 18, comprising the further step of:

creating a positive column through actuation of a discharge at one said discharge site, said positive column extending into another discharge site to enable creation of a wall voltage at said another discharge site that is further dependent upon a level of potential on intersecting address and sustain electrodes at said another discharge site.

28. An AC plasma panel having a plurality of addressable subpixel sites, each subpixel site including an address electrode positioned on one substrate and a first sustain electrode and a second sustain electrode positioned on an opposed substrate, each said electrode covered by a dielectric material, a dischargeable gas positioned between said substrates, an intersection between said address electrode and said first sustain electrode defining a first discharge site and an intersection between said address electrode and said second sustain electrode defining a second discharge site, said first sustain electrode and said second sustain electrode separated by a sustain gap distance, said AC plasma panel further comprising:

first drive means for establishing a wall voltage at said second discharge site in accordance with a determined subpixel value;

sustain drive means for applying sustain signals to said first sustain electrode and said second sustain electrode to enable a discharge to occur at said second discharge site when said wall voltage at said second discharge site is indicative of said determined subpixel value, successive sustain signals further cooperating to thereafter successively enable a discharge at said second discharge site to cause a positive column which moves along said address electrode to said first discharge site and enables a discharge to occur thereat that is indicative of said determined subpixel value, and a discharge at said first discharge site to cause a positive column which moves along said address electrode to said second discharge site and enables a discharge to occur thereat that is indicative of said determined subpixel value; and wherein said sustain gap distance is larger than a critical sustain gap distance between said first sustain electrode and said second sustain electrode, said critical sustain gap having a first minimum sustain voltage equal to a second minimum sustain voltage, said first minimum sustain voltage being the minimum voltage that would be required to sustain a discharge over said critical sustain gap distance between said first sustain electrode and said second sustain electrode, said second minimum sustain voltage being the minimum voltage that would be required to successively enable a discharge at said second discharge site to cause a positive column to move over said critical sustain gap distance along said address electrode to said first discharge site and to enable a discharge to occur thereat that is indicative of said determined subpixel value, and a further discharge at said first discharge site to cause a positive column to move along said address electrode to said second discharge site over said critical sustain gap distance and to enable a discharge to occur thereat that is indicative of said determined subpixel value.

29. The AC plasma panel as recited in claim 28, wherein continued application of said sustain signals to said first sustain electrode and said second sustain electrode cause alternating discharges at said first discharge site and said second discharge site as a result of positive columns that travel therebetween.

30. The AC plasma panel as recited in claim 28, wherein said first sustain electrode comprises a single electrode trace and said second sustain electrode comprises a loop trace, one side of said loop trace servicing a first subpixel site and a second side of said loop trace servicing an adjacent subpixel site, along with a further first sustain electrode, a distance between said substrates defining a substrate gap and a distance between said single electrode trace and a side of an adjacent loop trace defining said sustain gap distance, said sustain gap distance being substantially larger than said substrate gap.

31. The AC plasma panel as recited in claim 28, wherein said first drive means comprises:

scan drive means, active during an address phase, for applying a negative-going signal to said first sustain electrode; and address drive means, active during said address phase, for applying an address signal to said address electrode, and for creating a discharge of said gas at said first discharge site so as to cause a positive column to move along said address electrode to said second discharge site, said address signal, said positive column and a potential applied to said second sustain electrode cooperating to create a discharge which induces a wall voltage at said second discharge site in accordance with a determined subpixel value.

32. The AC plasma panel as recited in claim 31, wherein, prior to said address phase, said scan drive means includes set-up means operative during a set-up phase to apply an initial negative-going signal to one said sustain electrode while a positive voltage is applied to another said sustain electrode to enable discharges to be created which act to establish first predetermined wall voltages on said dielectric materials.

33. The AC plasma panel as recited in claim 32, wherein, subsequent to application of said initial negative-going signal, said set-up means applies a positive-going signal to said one said sustain electrode to enable a discharge which acts to establish second predetermined wall voltages on said dielectric materials.

34. The AC plasma panel as recited in claim 31, wherein, upon creation of a positive column through actuation of a discharge at one said discharge site and said positive column extending into another discharge site, a wall voltage results at said another discharge site that is dependent upon a level of potential on intersecting address and sustain electrodes at said another discharge site.

35. The AC plasma panel as recited in claim 28, wherein, said first drive means is operative, prior to an address phase, to perform a set-up operation wherein an initial negative-going signal is applied to at least one of said first sustain electrode and said second sustain electrode, to enable discharges to be created which act to establish first predetermined wall voltages on said dielectric materials.

36. The AC plasma panel as recited in claim 35, wherein, subsequent to said initial negative-going signal, said first drive means applies a positive-going signal to at least one of said first sustain electrode and said second sustain electrode to enable a discharge which acts to establish second predetermined wall voltages on said dielectric materials.

37. The AC plasma panel as recited in claim 36, wherein, subsequent to said positive-going signal, said first drive means applies a subsequent negative-going signal to one said sustain electrode to cause a discharge which moves a wall voltage at said first discharge site to a potential that is sufficiently negative relative to a potential at said second discharge site to enable a subsequently created positive column to move to said second discharge site.

38. The AC plasma panel as recited in claim 37, wherein said initial negative-going signal, said positive-going signal and said subsequent negative-going signal are configured to achieve a positive resistance discharge of said dischargeable gas.

39. The AC plasma panel as recited in claim 38, wherein said positive going signal is caused to occur sufficiently soon after said initial negative-going signal that priming particles created as a result of a discharge created by said initial negative-going signal aid in creation of said positive resistance discharge during application of said positive-going signal.

40. The AC plasma panel as recited in claim 28, wherein, said dielectric material on each of said sustain electrodes includes an insulator exhibiting a substantial secondary electron emission characteristic.

41. The AC plasma panel as recited in claim 28, wherein, said dielectric material on said address electrode comprises a phosphor.

42. An AC plasma panel having a plurality of addressable subpixel sites, each subpixel site including an address electrode positioned on one substrate and a first sustain electrode and a second sustain electrode positioned on an opposed substrate, each said electrode covered by a dielectric material, a dischargeable gas positioned between said substrates, an intersection between said address electrode and said first sustain electrode defining a first discharge site and an intersection between said address electrode and said second sustain electrode defining a second discharge site, said first sustain electrode and said second sustain electrode separated by a sustain gap distance, said AC plasma panel further comprising:

first drive means for establishing a wall voltage at said second discharge site in accordance with a determined subpixel value;

sustain drive means for applying sustain signals to said first sustain electrode and said second sustain electrode to enable a discharge to initiate at said second discharge site between said second sustain electrode and said address electrode when said wall voltage at said second discharge site is indicative of said determined subpixel value, successive sustain signals further cooperating to thereafter successively enable a discharge at said second discharge site to cause a positive column which moves along said address electrode to said first discharge site and enables a discharge to occur thereat that is indicative of said determined subpixel value, and a discharge at said first discharge site to cause a positive column which moves along said address electrode to said second discharge site and enables a discharge to occur thereat that is indicative of said determined subpixel value; and wherein said sustain signals exhibit a voltage level that is less than a minimum voltage that would be required to sustain a discharge over said sustain gap distance between said first sustain electrode and said second sustain electrode.

43. The AC plasma panel as recited in claim 28, wherein, said first sustain electrode comprises a single trace sustain electrode and said second sustain electrode comprises at least a portion of a loop, one side of said loop servicing a first subpixel site and a second side of said loop servicing an adjacent subpixel site in conjunction with an additional single trace sustain electrode, each single trace sustain electrode further positioned adjacent a further single trace electrode to thereby comprise a single trace pair, said AC plasma panel further comprising:

a conductive isolation bar positioned within each loop, and between each single trace pair commonly energized by same potentials during said sustain phase of said display.

44. The AC plasma panel as recited in claim 43, wherein said conductive isolation bar is approximately centered between adjoining electrodes.

45. The AC plasma panel as recited in claim 43, wherein distances between adjacent single trace pairs and between sides of a loop, respectively comprise interpixel gaps, and conductive isolation bars present in said interpixel gaps exhibit an electrode width in a range from about 50% to about 80% of each said inter-pixel gap.

46. An AC plasma panel comprising:

a plurality of addressable subpixel sites, each subpixel site comprising:

an address electrode positioned on one substrate;

a first and second electrode positioned on an opposing substrate and separated by a distance;

drive means for applying signals to said electrodes, said drive means operating to produce a positive column discharge between said address electrode and said first electrode which travels along said address electrode to said second electrode, said drive means further operating to produce a positive column discharge between said address electrode and said second electrode which travels along said address electrode to said first electrode;

isolation bars positioned between adjacent first or second electrodes of adjacent subpixel sites, said isolation bars operating to establish a negative charge in inter-electrode gaps between said adjacent first or second electrodes and to ensure that there is no discharge activity in said inter-electrode gaps.

47. The AC panel display of claim 46 wherein said distance is greater than a distance between adjacent subpixels.

48. The AC panel display of claim 46 wherein said plurality of addressable subpixel sites are arranged such that adjacent electrodes of adjacent sites have the same potential.

* * * * *